US005258750A

United States Patent [19]

Malcolm, Jr. et al.

[11] Patent Number: 5,258,750

[45] Date of Patent: Nov. 2, 1993

[54] COLOR SYNCHRONIZER AND WINDOWING SYSTEM FOR USE IN A VIDEO/GRAPHICS SYSTEM

[75] Inventors: Ronald D. Malcolm, Jr., Windham, N.H.; Richard R. Tricca, Haverhill, Mass.

[73] Assignee: New Media Graphics Corporation, Billerica, Mass.

[21] Appl. No.: 411,099

[22] Filed: Sep. 21, 1989

[51] Int. Cl.[5] ..... G09G 5/14

[52] U.S. Cl. ..... 340/721; 358/183; 395/154

[58] Field of Search ..... 340/721, 723, 724, 728, 340/747; 364/518, 521; 358/22, 182, 183; 395/153, 154

[56] References Cited

U.S. PATENT DOCUMENTS

| | | | |
|---|---|---|---|
| 4,204,206 | 5/1980 | Bakula et al. | 340/721 |
| 4,204,207 | 5/1980 | Bakula et al. | 340/723 |
| 4,204,208 | 5/1980 | McCarthy | 340/745 |
| 4,324,401 | 4/1982 | Stubben et al. | 273/85 G |
| 4,413,277 | 11/1983 | Murray | 358/93 |
| 4,425,581 | 1/1984 | Schweppe et al. | 358/148 |
| 4,482,893 | 11/1984 | Edelson | 340/747 |
| 4,498,098 | 2/1985 | Stell | 358/22 |
| 4,503,429 | 3/1985 | Schreiber | 340/799 |
| 4,518,984 | 5/1985 | Mitschke | 358/11 |
| 4,523,227 | 6/1985 | Hurst | 358/105 |
| 4,530,009 | 7/1985 | Mizokawa | 358/183 |
| 4,533,952 | 8/1985 | Norman, III | 358/160 |
| 4,554,582 | 11/1985 | Wine | 358/149 |
| 4,573,068 | 2/1986 | Dorsey et al. | 358/11 |
| 4,580,165 | 4/1986 | Patton et al. | 358/148 |
| 4,591,897 | 5/1986 | Edelson | 340/723 |
| 4,599,611 | 7/1986 | Bowker et al. | 340/721 |
| 4,628,305 | 12/1986 | Ikeda | 340/703 |
| 4,631,588 | 12/1986 | Barnes et al. | 358/149 |
| 4,639,765 | 1/1987 | D'Hont | 358/19 |
| 4,639,768 | 1/1987 | Ueno et al. | 358/22 |
| 4,644,401 | 2/1987 | Gaskins | 358/183 |
| 4,646,078 | 2/1987 | Knierim et al. | 340/728 |
| 4,647,971 | 3/1987 | Norman, III | 358/160 |
| 4,654,708 | 3/1987 | de la Guardia et al. | 358/148 |
| 4,665,438 | 5/1987 | Miron et al. | 358/183 |
| 4,673,983 | 6/1987 | Sarugaku et al. | 358/183 |
| 4,675,736 | 6/1987 | Lehmer et al. | 358/183 |
| 4,680,622 | 7/1987 | Barnes et al. | 358/22 |
| 4,680,634 | 7/1987 | Nanba et al. | 358/181 |
| 4,694,288 | 9/1987 | Harada | 340/721 |
| 4,697,176 | 9/1987 | Kawakami | 340/723 |
| 4,720,708 | 1/1988 | Takeda et al. | 340/814 |
| 4,725,831 | 2/1988 | Coleman | 340/747 |
| 4,746,983 | 5/1988 | Hakamada | 358/183 |
| 4,761,688 | 8/1988 | Hakamada | 358/183 |
| 4,774,582 | 9/1988 | Hakamada et al. | 358/183 |
| 4,777,531 | 10/1988 | Hakamada et al. | 358/183 |
| 4,811,407 | 3/1989 | Blokker, Jr. et al. | 382/1 |
| 4,812,909 | 3/1989 | Yokobayashi et al. | 358/183 |
| 4,855,831 | 8/1989 | Miyamoto et al. | 340/721 |

*Primary Examiner*—Richard Hjerpe

*Attorney, Agent, or Firm*—Ware, Fressola, Van Der Sluys & Adolphson

[57] ABSTRACT

A color synchronizer and windowing system for use in a video or video/graphics system which uses digital television technology integrated circuits to digitize the video information. The digitized video information is stored in a frame buffer as luminance and chrominance data samples. The frame buffer also stores a chrominance reference synchronization signal which is synchronized to the digitized chrominance data samples so as to properly identify the boundary for each chrominance data sample; wherein each such chrominance data sample is associated with a plurality of luminance data samples. This encoded data insures that the luminance and chrominance data samples are properly decoded on chrominance data sample boundaries even though the synchronization signal normally associated with the digital television technology integrated circuits is not available due to the storage of the luminance and chrominance data samples within the frame buffer. In this manner the digitized video information may be reconfigured or combined with graphic information in any desired fashion without loosing chrominance synchronization. The color synchronizer and windowing system for use in a video/graphics system provides a definition for windows and viewports which minimizes the amount of memory necessary to define windows and viewports as well as to be able to present such information to an associated display monitor on a real-time basis.

10 Claims, 18 Drawing Sheets

MONITOR ROW AND COLUMN LAYOUT

WINDOW & VIEWPORT GENERATION

COLOR SYNCHRONIZER AND WINDOWING SYSTEM FOR USE IN A VIDEO/GRAPHICS SYSTEM

TECHNICAL FIELD

The present invention is directed to a color synchronizer and a windowing system for use in a video/graphics system.

BACKGROUND OF THE INVENTION

There are a number of prior art graphics systems which incorporate the capability of combining two sources of video into a composite image. Representative of such prior art is U.S. Pat. No. 4,498,098, Stell, that describes an apparatus for combining a video signal with graphics and text from a computer. This particular patent shows the combination of two video signals by having both sources of video in an RGB format (that is the video signal is converted into its component red, green and blue signals) with a multiplexer switch selecting which of the two sources is to be displayed for each pixel of the display. Such a technique is unlike the present invention wherein a video source is converted into digital chrominance and luminance data samples which are stored in a frame buffer, along with a generated chrominance reference synchronization signal. This signal is later read with the chrominance and luminance data samples to form an RGB formatted output. Since such reading is independent of the data writing operation, the read data can be combined in any desired manner with graphic data so as to generate a desired overall effect.

Although U.S. Pat. No. 4,654,708, de la Guardia, et al, is directed to a digital video synchronization circuit, the technique disclosed in this reference converts an incoming synchronization signal to a digital format which is then transferred to a microprocessor which is programmed to recognize a particular synchronization pattern. The present invention uses a digital television integrated circuit chip set and stores chrominance reference synchronization information within the frame buffer so as to insure chrominance synchronization of the read chrominance and luminance data samples regardless of when such data is read from the frame buffer.

SUMMARY OF THE INVENTION

A color synchronizer and windowing system for use in a video/graphics system is disclosed which is capable of combining video and graphic information in a flicker-free, non-interlaced red, green, blue (RGB) output. The video/graphics system is capable of combining video information from a video disk player, video cassette recorder or television camera in combination with computer generated graphics such as the CGA, EGA, EGA+ and VGA graphics associated with IBM® compatible personal computers. The underlying concepts of the color synchronizer and windowing system are applicable to other graphics standards as well.

The video/graphics system is able to position video in selected regions of the associated display screen, cut and paste portions of video images into graphics screens, expand or contract the video image horizontally or vertically, control the brightness for variable fade-in and fade-out of the video or for pull-down to black, and further incorporates computer selectable hue/saturation levels, computer controlled freeze-frame and snap-shot capability. It is also able to store captured images to magnetic media such as a hard disk, as well as to manipulate captured images with computer graphic compatible application software such as graphics paint packages. The color synchronizer uses a digital television chip set in association with other circuitry as to maintain color (chrominance) synchronization of the digitized information.

By storing the chrominance synchronization reference information in the video frame buffer along with the digitized video data (chrominance and luminance data samples), several advantages are obtained by the present invention. Firstly, the digitized video data can be read by an associated host computer and processed. Since the chrominance reference synchronization information is stored with the video data, the host computer is able to determine the proper chrominance boundaries and is therefore able to manipulate this video data in a manner which maintains accurate chrominance boundary information.

Secondly, the digitized video data can be output to a storage device such as a hard disk or a floppy diskette and retrieved at a later time with assurance that the displayed information will be correct since the chrominance reference synchronization information is maintained with the video data. Furthermore, the present invention conveys the chrominance reference synchronization information between its video frame buffer and the video code/decode unit (VCU) on a continuous basis per displayed video line thereby allowing multiple smaller sized video images to be displayed simultaneously side-by-side. Due to the fact that these smaller images are captured at different times, the color synchronization when going from one image to the next changes. Nevertheless, since this chrominance reference synchronization information is provided as the video line is displayed, the proper color synchronization is maintained throughout the displayed line.

Furthermore, the present invention's chrominance synchronization method enables a live image to be displayed simultaneously with a frozen image. This result is due to the fact that the chrominance reference synchronization information changes continuously on a line-by-line basis as the live image is being captured into the frame buffer. The boundaries which can exist between displayed images on any given line of the display will have chrominance synchronization discontinuities. These discontinuities are corrected by the present invention since all digitized video within the frame buffer also includes chrominance reference information. Thus if a live image is to be displayed within a frozen image, the start boundaries of the live image and the frozen image will be properly displayed due to the chrominance reference synchronization information stored in the frame buffer.

Furthermore the present invention incorporates a new technique for displaying windows in a graphic system as well as for the display of video information on the associated graphic screen.

Traditionally, windows in a graphic system are generated using a bitmap. Such a bitmap typically overlays the graphic image and provides the mechanism for seeing that image. Since the bitmap must be able to overlay any part of the graphic image, it necessarily has to have a size equal to that of the screen size. Therefore each time a window is created, all of the bits in the overlaid plane need to be defined, a time-consuming task; and secondly, the amount of memory required for the bit plane must be equal to that of the entire screen size.

The present invention defines windows in a different manner. Instead of using a bitmap to define windows, it defines windows through a data structure which defines the start and stop point of a window for each line of the window. The stored data then comprises start and stop information for the window on a line-by-line basis.

In addition, the present invention is able to display the stored video information on any particular portion of the display screen. It does this through a mechanism called a viewport which in fact is a data structure which defines the row and column to be read from the frame buffer for presentation on a given line of the associated monitor.

Both the window and viewport data structures are combined into a composite data structure known as a display list which forms the basis of a control mechanism for directing the associated hardware to place the digitized video and window information on the screen. In addition to the window and viewport data structures, each display list entry includes an on/off state that specifies whether the window element for a given row is to be displayed.

Thus for an incoming video signal comprising up to 475 lines of displayable information (475 rows), the data is stored in the frame memory having at least 475 rows of video data. The display list on the other hand has at least as many entries as the vertical resolution of the graphics board associated with the system. If the graphics board has 480 lines of vertical resolution, then at least 480 data entries are used to form the display list. The reason for this requirement is that each line of the generated graphics is presented to the associated monitor and therefore it may be desired to present video information with any displayed graphics line.

Since color synchronization information is maintained in the frame buffer, the video information in the frame buffer may be presented anywhere on the associated display monitor without loss of color synchronization.

OBJECTS OF THE INVENTION

Therefore, a principal object of the present invention is to provide a color synchronizer and windowing system for use in a video system or a video/graphics system for combining video and/or graphic and video information onto an associated display monitor, the color synchronizer incorporating chrominance synchronization circuitry used in association with a video frame grabber for maintaining chrominance synchronization information within the frame buffer along with associated chrominance and luminance data samples from the digitized video input.

A further object of the present invention is to provide a color synchronizer and windowing system wherein the windowing system is defined by a data structure comprising start and stop information for window elements on a line-by-line basis for the associated display monitor.

A still further object of the present invention is to provide a color synchronizer and windowing system wherein the window data structure is combined with a viewport data structure that defines for each displayed line, the row and column where the video data is to be obtained from the frame grabber. In addition, this display list data structure includes information concerning the ON or OFF status of the associated window element for each line of the generated display.

Another object of the present invention is to provide a color synchronizer and windowing system wherein the chrominance reference synchronization information stored in the frame buffer is used in conjunction with a reference signal initiated by a horizontal blanking signal which effectively disables the clock associated with the video code/decode unit (VCU) until the chrominance reference information indicates the boundary for the next unit of chroma information; thereby maintaining proper color output of the associated display regardless of the data retrieved from the frame buffer for presentation on any given line of the video display.

Other objects of the present invention will in part be obvious and will in part appear hereinafter.

DRAWINGS

For a fuller understanding of the nature and objects of the present invention, reference should be made to the following detailed description taken in connection with the accompanying drawings, in which:

FIGS. 1A-1, 1A-2, 1A-3, 1B-1 and 1B-2 form an overall block diagram of a video/graphics system incorporating a color synchronizer and windowing system according to the present invention.

FIGS. 1A-1, 1A-2, 1A-3, 1B-1 and 1B-2 are put together.

FIG. 2 is a diagram showing the rows and pixel (columns) associated with the digital television chip set used in conjunction with the present video/graphics system.

FIG. 3 is a diagrammatic representation of the internal memory structure of the frame buffer forming part of the color synchronizer and video/graphic system.

FIG. 4 is a diagrammatic representation of the luminance and chrominance data sample and subsample transfers over four clock cycles.

Figure 8:
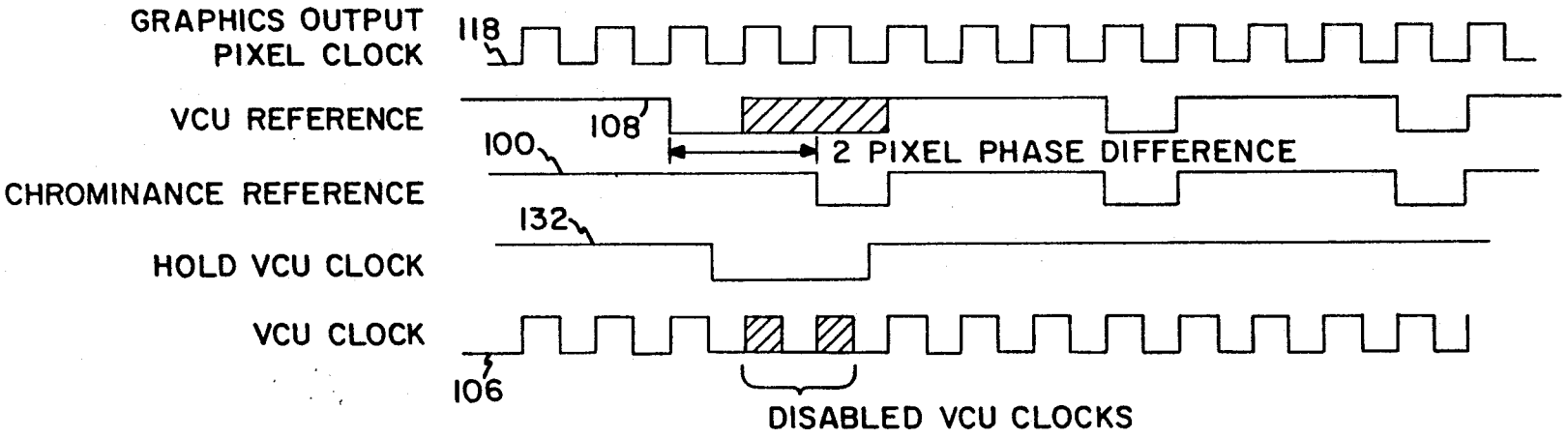

FIG. 8 comprises a plurality of waveforms associated with the chrominance synchronization output module.

Figure 9:
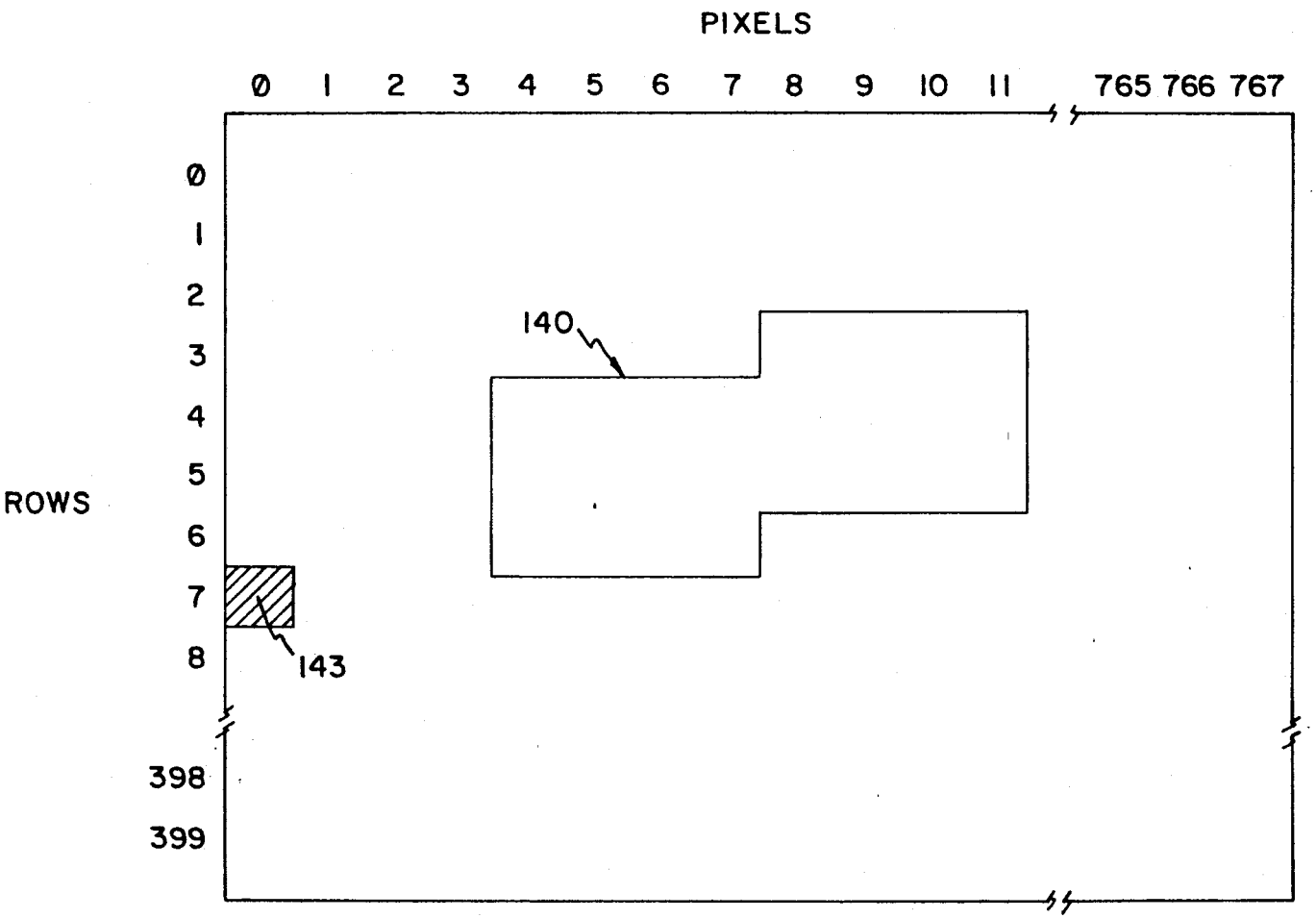

FIG. 9 is a diagrammatic representation of an overall window formed by a plurality of window row elements according to the present invention.

Figure 10:
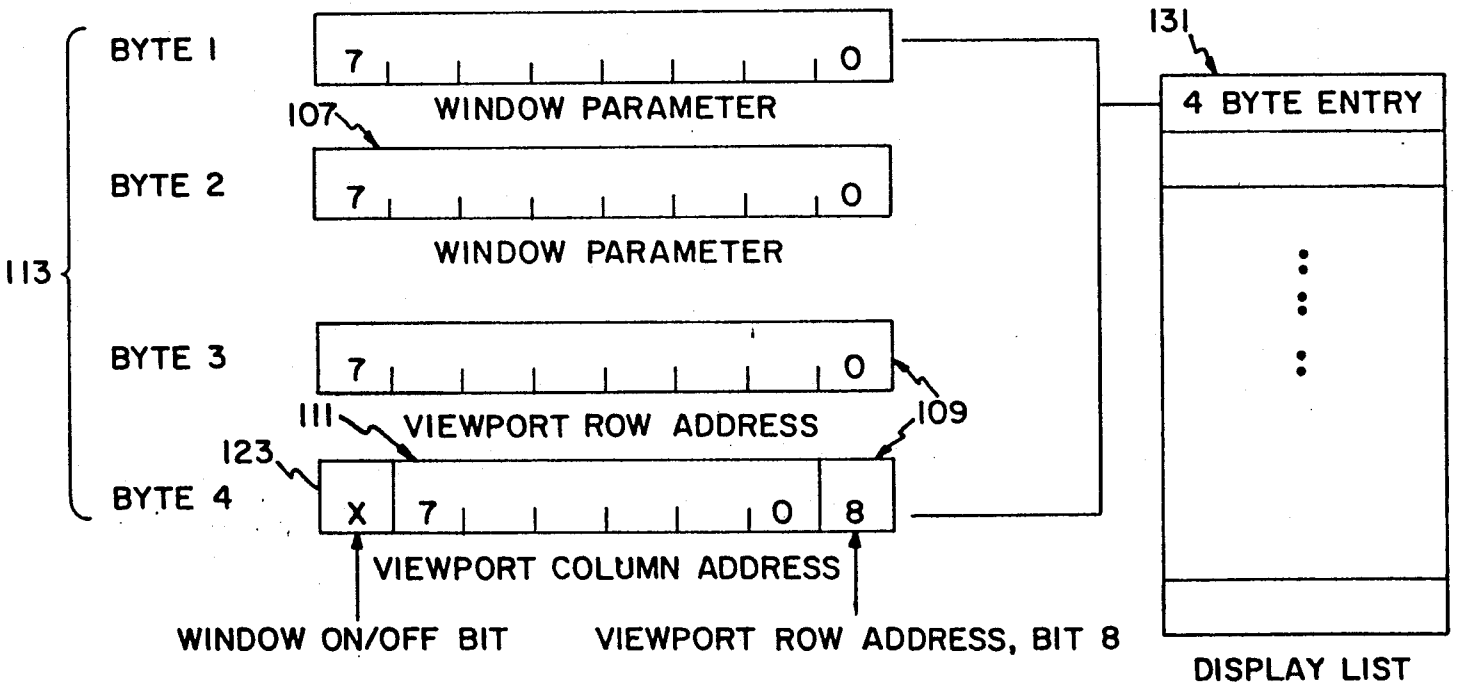

FIG. 10 is a diagram showing the data structure for defining windows, viewports and the resulting display list.

Figure 11:
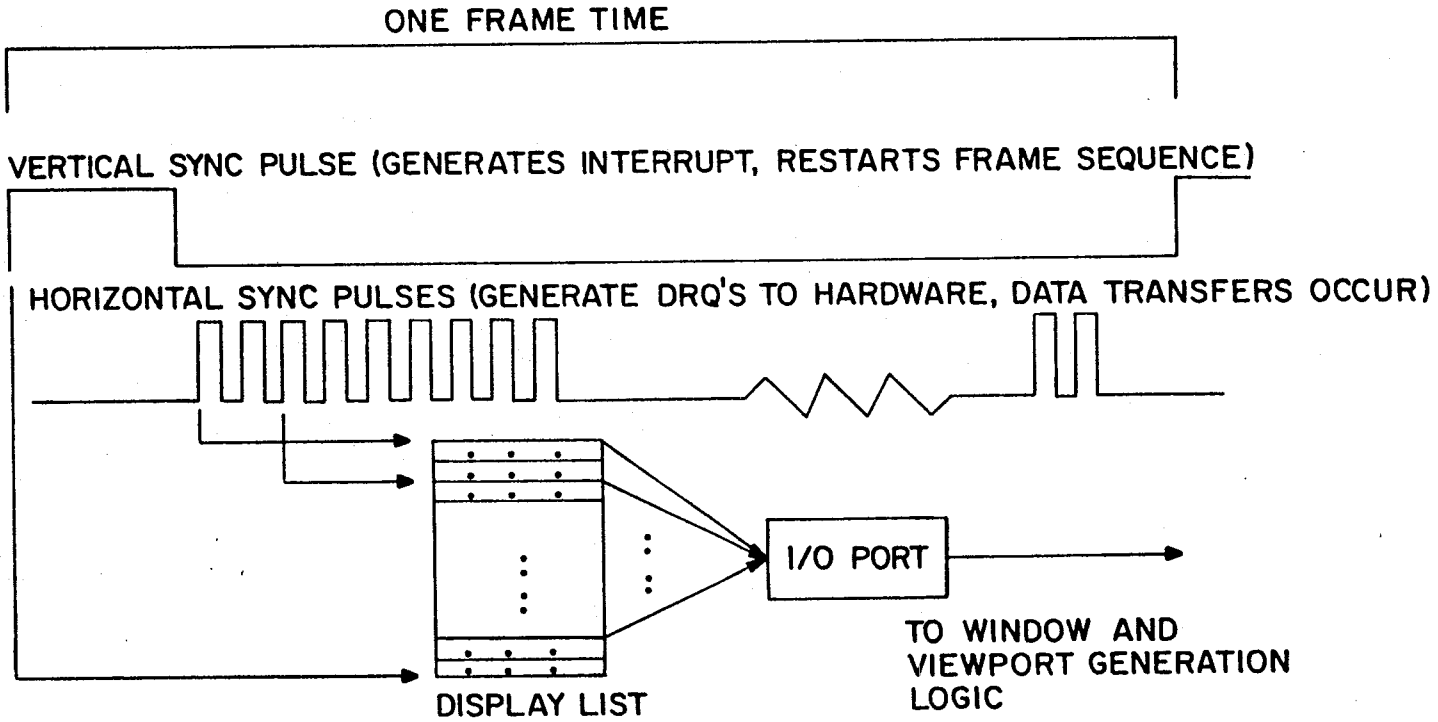

FIG. 11 is a diagrammatic representation of data output transfers from the display list during one frame time.

Figure 12C:
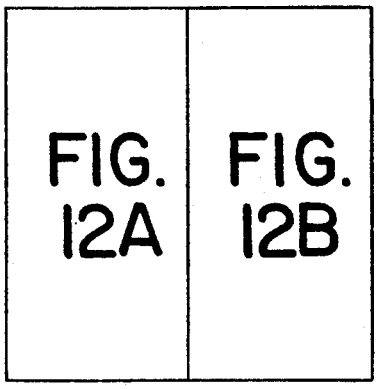
Figures 1, 1A:
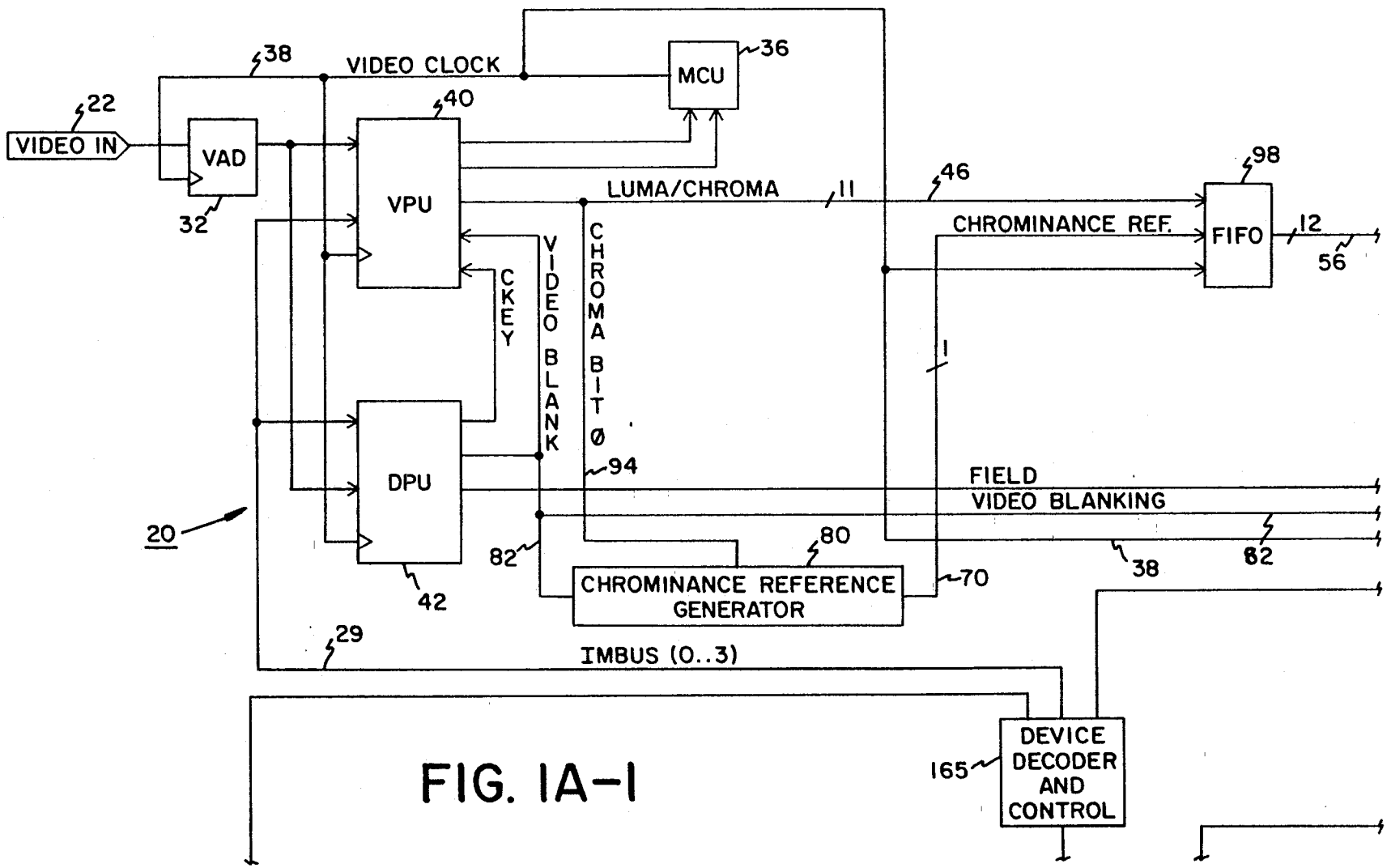
Figures 1, 1A, 2:
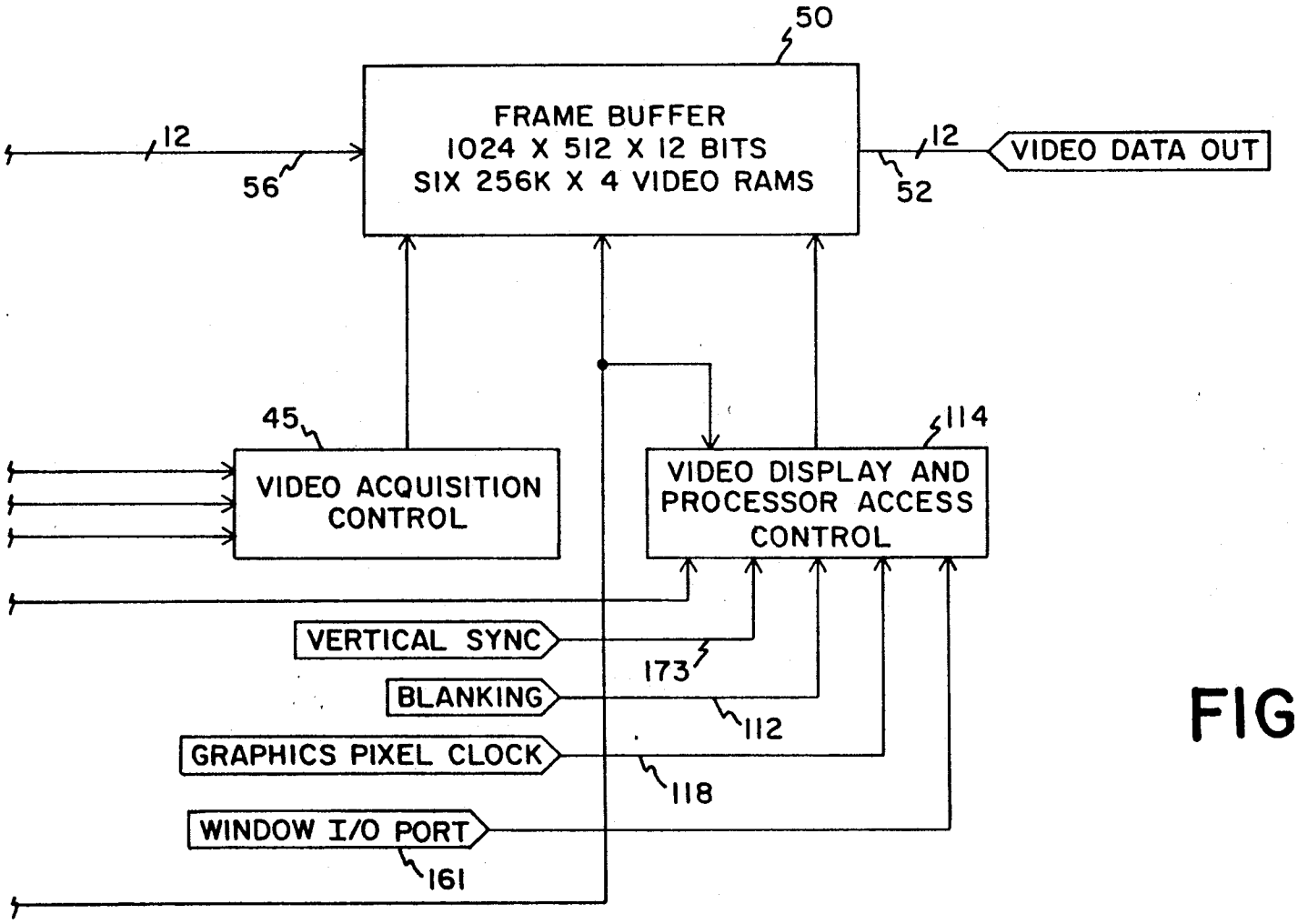
Figures 1, 1A, 2, 3:
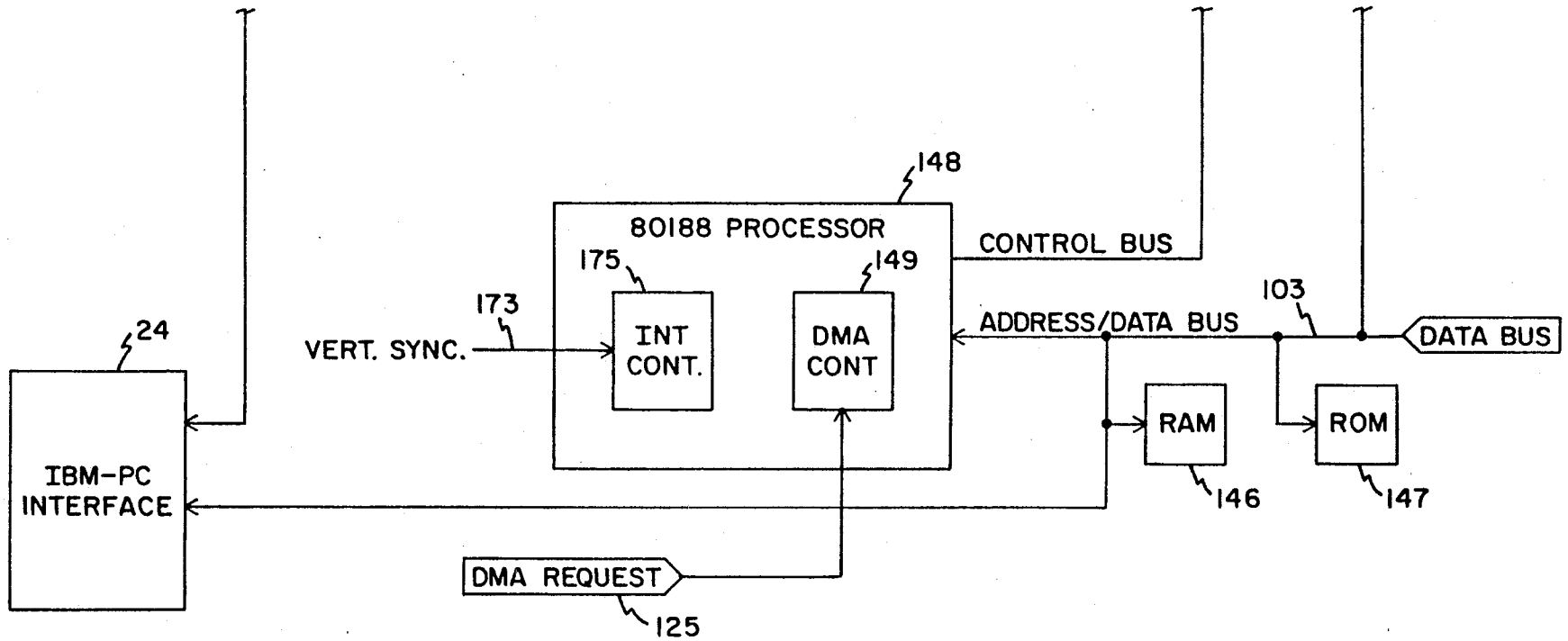
Figures 1, 1B:
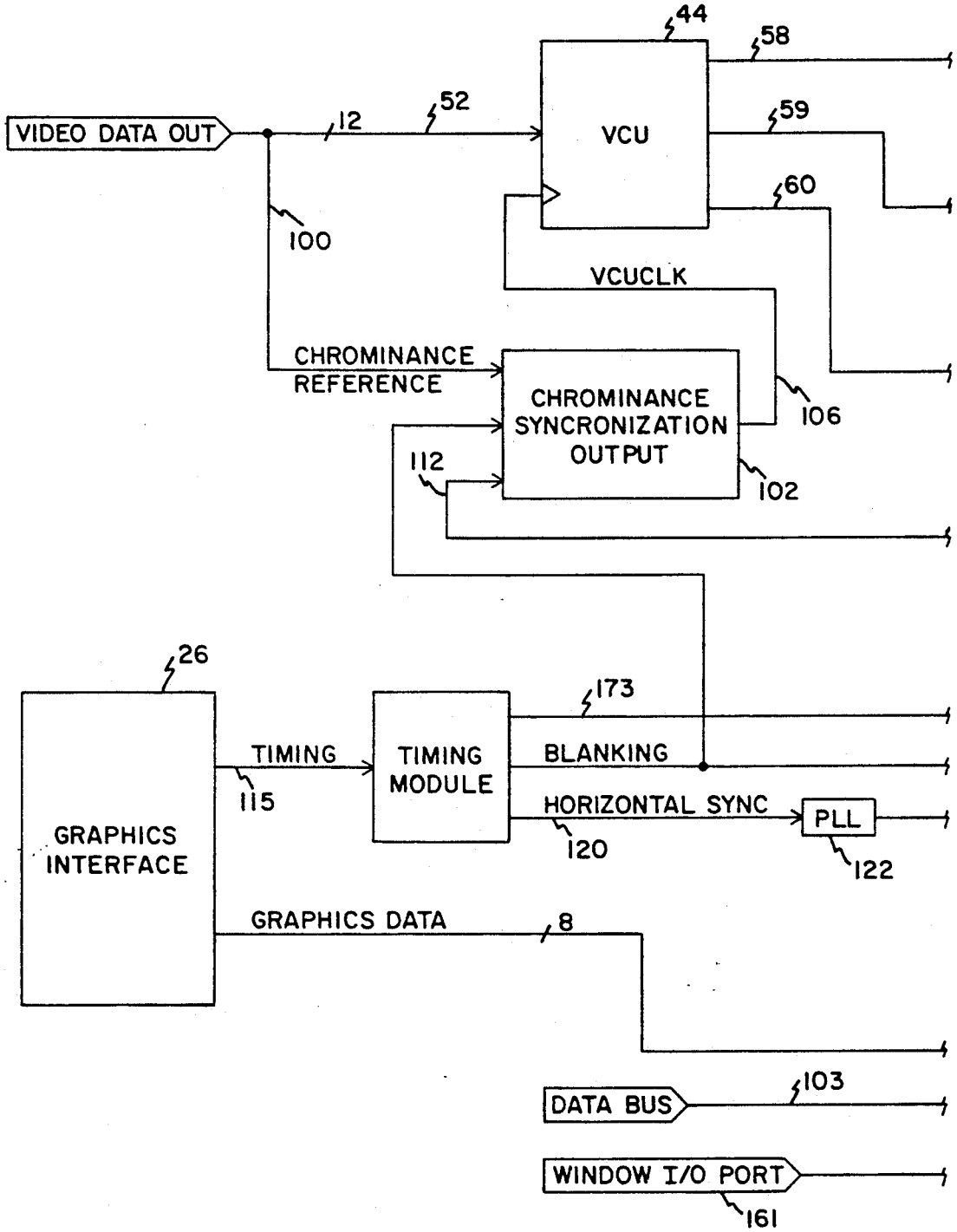
Figures 1, 1B, 2:
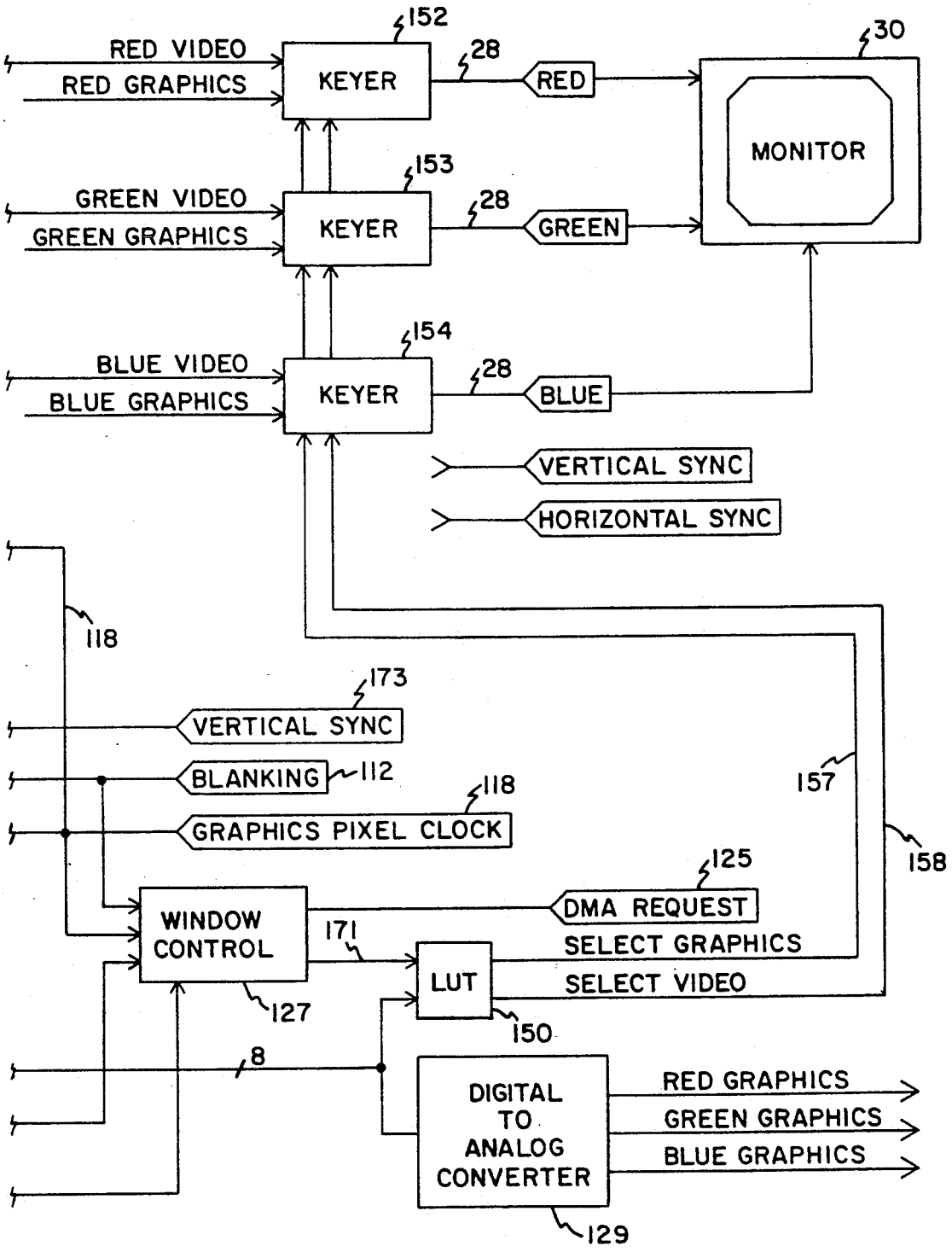
Figure 2:
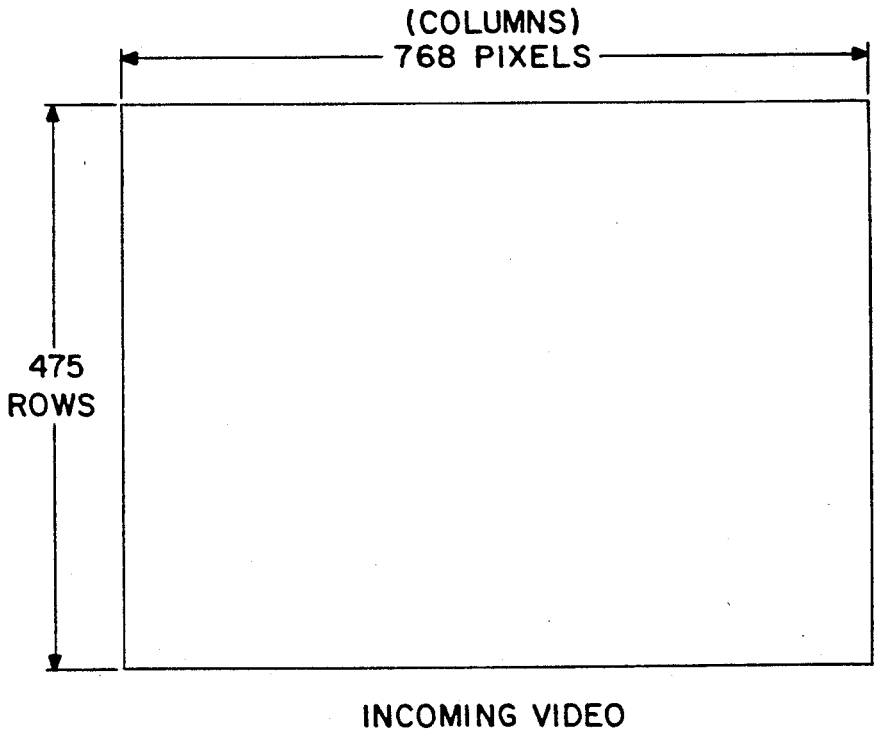
Figure 3:
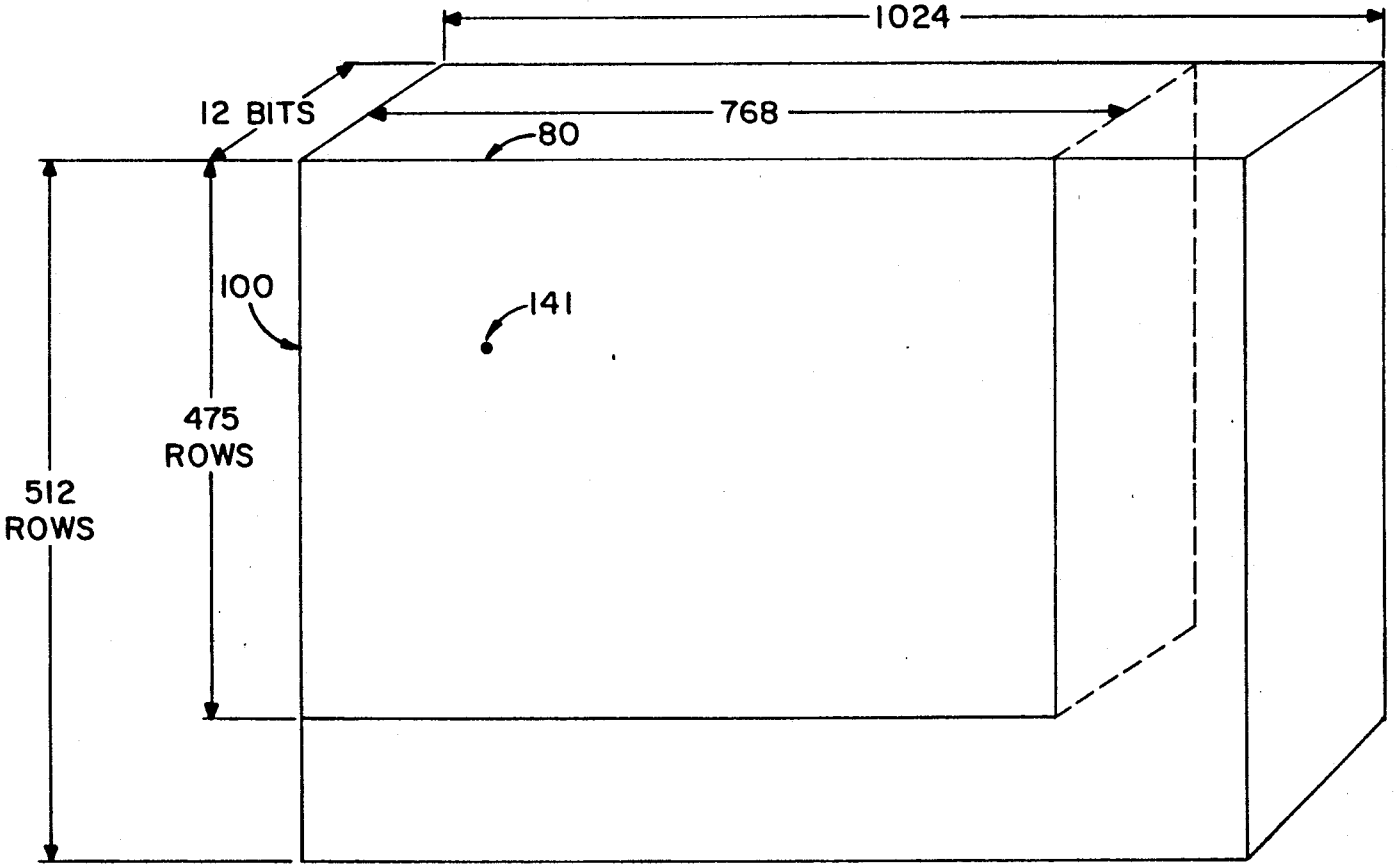
Figure 4:
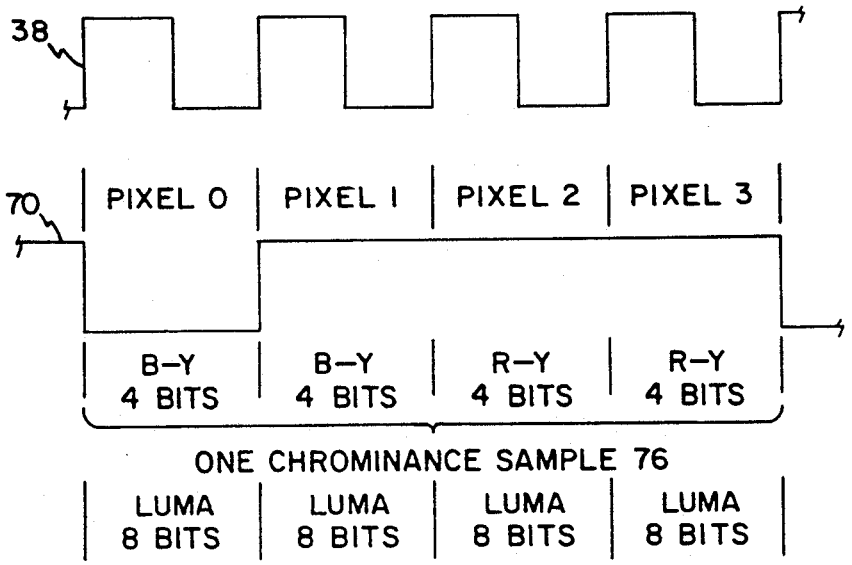
Figure 12A:
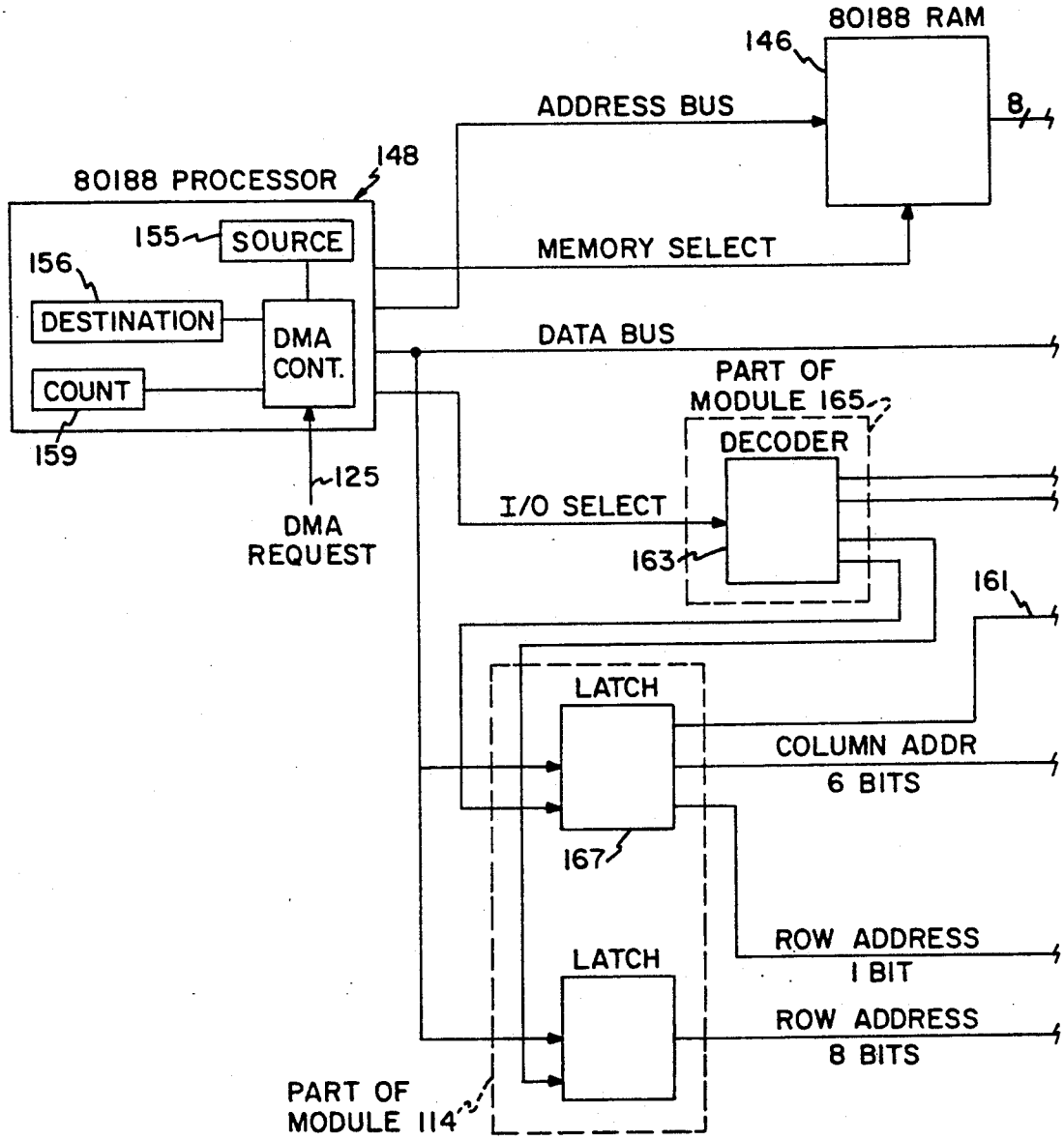
Figure 12B:
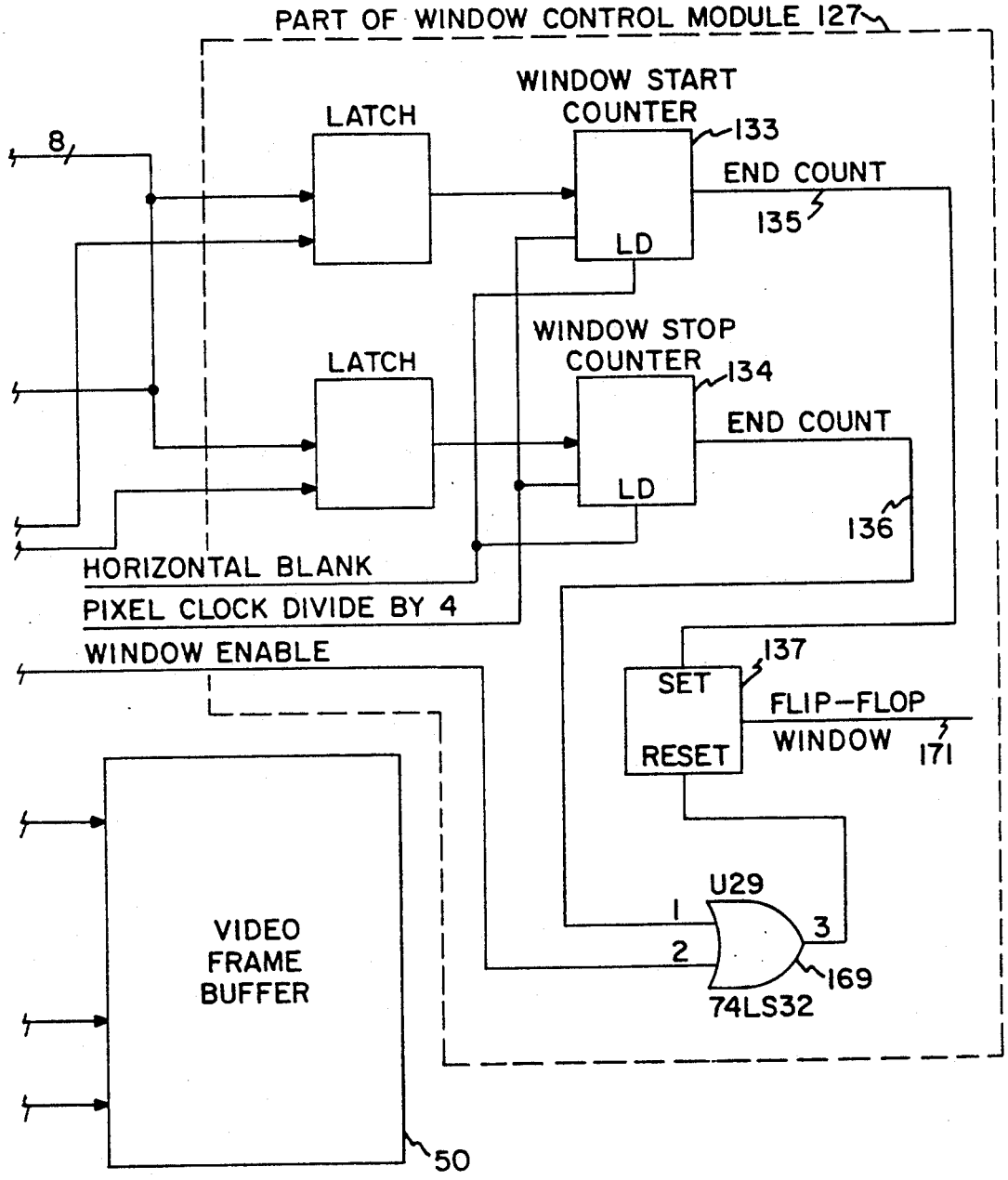

FIGS. 12A, 12B and 12C are detailed block diagrams of the window and viewport generation circuitry of the present invention.

BEST MODE FOR CARRYING OUT THE INVENTION

Figures 1, 1A, 2, 3, 4:
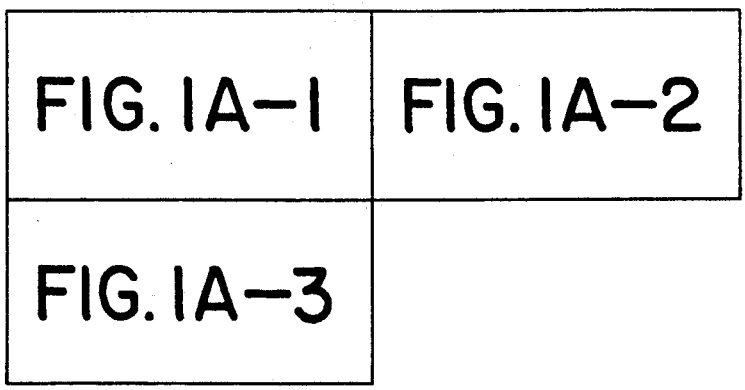
FIGS. 1A-4 and 1B-3 are diagrams showing how
Figures 1, 1B, 2, 3:
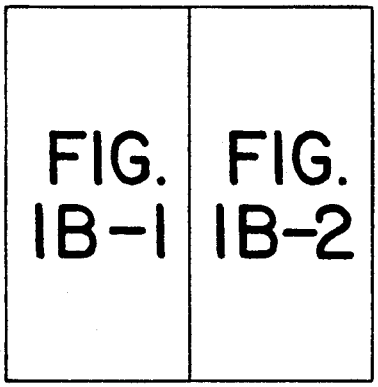

As best seen in FIG. 1 comprising FIGS. 1A and 1B, the present invention is a color synchronizer and windowing system typically for use in a video/graphics system 20. The video/graphics system includes a video input 22, an interface 24 to a computer (not shown) such as an IBM-PC ® compatible digital computer, a graphics board interface 26 for connection to the feature connector of an EGA or VGA type graphics board (not shown) usually mounted within the computer, and RGB outputs 28 for conveying red, green and blue color information to an associated display monitor 30. The video/graphics system is intended to interconnect with a computer via computer interface 24 and with a graphics board within that computer via graphics interface 26. The video information at video input 22 may be from a video disc player, a VCR, or a video camera or other source of video information. The output display monitor 30 may be any type of EGA/VGA monitor which accepts an RGB input such as the IBM PS/2 TM color monitor, manufactured by the IBM Corporation, or other EGA/VGA type monitors.

Although the enclosed video/graphics system is intended for use with an EGA or VGA type graphics board having 480 lines of vertical resolution, the color synchronizer and windowing system can be used with other graphics standards such as the IBM 8514 ® standard. In addition, although the color synchronizer is disclosed for use with a video/graphics system, it can also be used for the presentation of video information alone wherein the displayed video information is an adaptation of the digitized video information stored within frame buffer 50.

As also seen in FIG. 1C, the incoming video signal is presented to analog to digital converter 32 which generates a seven bit digitized output on bus 34. A clock module 36 generates a video clock signal on output 38 which is presented to the analog to digital converter 32 for properly performing the analog to digital conversion. This timing information is also used to clock a video processing unit (VPU) 40, a deflection processor unit (DPU) 42, a video acquisition control module 45, and a first-in, first-out (FIFO) module 98.

The seven bit digitized output information from analog to digital converter 32 is presented to VPU 40 and to DPU 42. The VPU provides real-time signal processing including the following functions: a code converter, an NTSC comb filter, a chroma bandpass filter, a luminance filter with peaking facility, a contrast multiplier with limiter for the luminance signal, an all color signal processing circuit for automatic color control (ACC), a color killer, identification, decoder and hue correction, a color saturation multiplier with multiplexer for the color different signals, a IM bus interface circuit, circuitry for measuring dark current (CRT spot-cutoff), white level and photo current, and transfer circuitry for this data.

The DPU performs video clamping, horizontal and vertical synchronization separation, horizontal synchronization, normal horizontal deflection, vertical synchronization, and normal vertical deflection.

The video analog to digital converter 32, the clock unit 36, the video processing unit 40, the deflection processor unit 42, and a video code/decode (VCU) unit 44 are all designed for interconnection and all are sold by ITT Semiconductors, 470 Broadway, Lawrence, Mass. 01841 and form part of a digital television chip set. The specific product numbers and the acronyms used herein are set forth in TABLE 1 below.

TABLE 1

| Digital Television Chip Set | | |
|---|---|---|
| REFERENCE NUMERALS | CHIP DESCRIPTION | ITT PRODUCT NO. |
| 32 | Video Analog to Digital Converter (VAD) | ITT VAD 2150 |
| 36 | Clock Generator (Clock or MCU) | ITT MCU 2632 |
| 40 | Video Processor Unit (VPU) | ITT CVPU 2233 |
| 42 | Deflection Processor Unit (DPU) | ITT DPU 2533 |
| 44 | Video Code/Decode Unit Video Processor (VCU) | ITT VCU 2134 |

As also seen in FIG. 1C, VPU 40 generates eight bits forming a luminance data sample and four bits forming a chrominance data subsample, of which eleven bits (seven luminance and four chrominance) are presented to FIFO stack 98 by bus 46. This data along with one bit of chrominance reference synchronization information (as explained below) is stored in a dual ported 1024 by 512 by 12 bit frame buffer 50, under control of video acquisition control module 45. The data storage within frame buffer 50 is shown in FIG. 3 while the incoming digitized video format is shown in FIG. 2. As seen in FIG. 2, the incoming digitized video typically comprises 475 rows (lines), each row containing 768 pixels when the digital television chip set is operated in its National Television System Committee (NTSC) format. The NTSC format is used as the video standard for television in the United States, Canada and elsewhere. When the chip set is operated in the phase alteration line (PAL) format (a format used in parts of Europe) the digitized video comprises 575 rows, each row containing 860 pixels. The frame buffer as shown in FIG. 3 contains twelve bits of information for each pixel in each row and contains additional memory for the passage of status and parameter data normally transferred directly between the VPU and VCU during the vertical flyback period as described more fully below. This status and parameter data is generated by processor 148 and transferred to the frame buffer over address/data bus 103.

The color synchronizer of the present invention comprises a chrominance reference generator module 80 and a chrominance synchronization output module 102. When the digital television chip set is used for its intended television application, the video processor unit is connected to the video code/decode unit and a number of measurements are taken and data exchanged between the VPU and the VCU during vertical flyback; that is, during the period of time that the display monitor's electron beam moves from the lower portion of the screen to the upper portion of the screen to start the next frame of video information. In particular, chroma data transfer is interrupted during the vertical flyback to enable the transfer of seventy-two bits of data which are used by the VCU to set voltage levels of RGB video signals (such as black level and peak-to-peak amplitude).

In order to better understand the inter-relationship between the VPU 40 and the VCU 44, reference should again be made to FIG. 2 which shows an incoming video signal comprising 475 rows, each row having 768 pixels of information. Each pixel of information normally comprises eight bits of luminance information and four bits of chrominance information. However, one complete sample of chrominance information comprises sixteen bits (2 bytes) and is therefore presented in four consecutive pixels. Therefore each group of four consecutive pixels that start on a chrominance sample boundary has the same color although their luminance (or brightness) may vary from pixel to pixel. The reason for this is that color information is not as discernible to the human eye as brightness and therefore less chrominance information is necessary to convey a given quality of a video picture.

Figure 5:
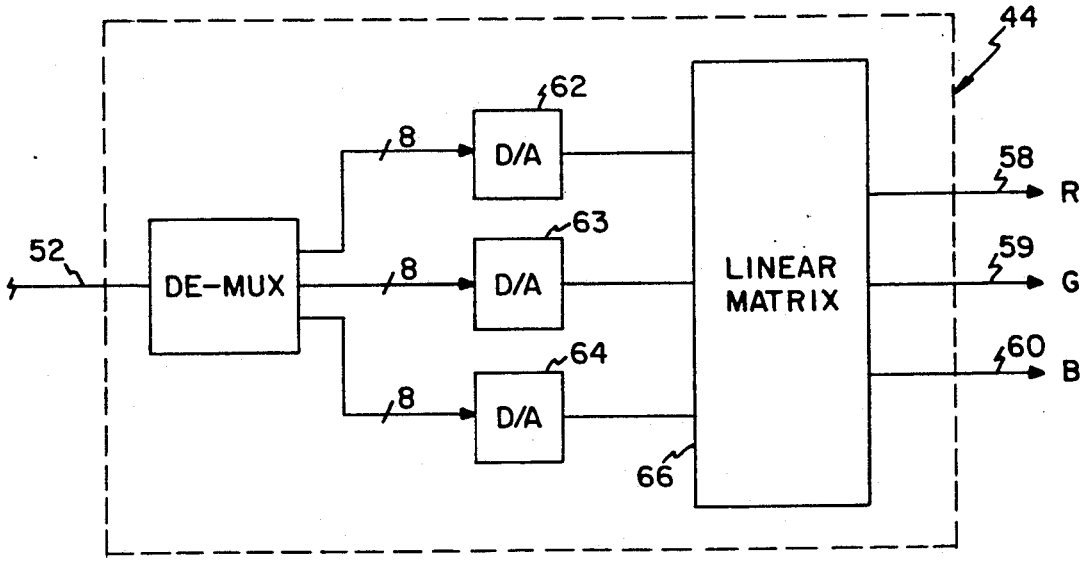
FIG. 5 is a diagrammatic representation of the video code/decode unit used in the color synchronizer of the present invention.

FIG. 4 diagrammatically shows the video clock signal on output 38. During each video clock cycle, four bits of chrominance information (a chrominance subsample) and eight bits of luminance information (a luminance sample) are generated by the video processor unit 40. FIG. 5 is a diagrammatic representation of VCU 44. As seen in FIG. 5, VCU 44 actually operates on twenty-four bits of information in order to generate the red, green and blue output signals 58, 59 and 60 for each pixel, via demultiplexor 61, digital to analog convertors 62, 63 and 64 and associated linear matrix 66. However, the blue minus luminance (B-Y) and red minus luminance (R-Y) values are the same for four consecutive luminance pixel values. The blue minus luminance (B-Y) and red minus luminance (R-Y) chrominance signals are commonly used to give full color information of a video signal. It is seen by observing FIGS. 4 and 5 that the chrominance data sample must be presented as sixteen bits per each four luminance data samples.

This incoming chrominance data is stored within the VCU as eight bits for both the B-Y and the R-Y chrominance signals before presentation to D to A converters 62–64. It is therefore apparent that unless the chrominance data sample is synchronized with the luminance data samples, the color associated with each pixel will be incorrect.

As explained earlier, this chrominance synchronization is normally achieved during each vertical flyback along with other data transferred over one of the chrominance data lines (the C3 chrominance line associated with the VPU 40) so that the color is synchronized for each horizontal scan line; i.e., each row as shown in FIG. 2.

Thus without the color synchronizer of the present invention, storing chrominance and luminance data in a dual-ported frame buffer would not convey color synchronization information from the VPU to the VCU, which would normally be the case when the chips are used in standard digital television.

In summary, the digital television chip set digitizes the incoming video into a luminance (black and white) data sample and a chrominance (color) data sample with the luminance data sample having a resolution of eight bits per digital sample and with 768 such samples occurring during the visible portion of one horizontal video scan line as best seen in FIG. 2. The chrominance sample has a resolution of sixteen bits but there are only 192 such samples occurring during one horizontal scan line; that is, one per four luminance samples.

Normally when the VPU is connected to the VCU, this information is presented between them in a multiplex fashion in order to minimize the storage requirements for the digitized video. For VPU 40, the chrominance information is output four bits at a time requiring four pixel clocks to output the full sixteen bit value. Thus during the visible portion of one video line such as one row shown in FIG. 2, 768 samples of video information, each comprising twelve bits of data, (eight luminance and four chrominance) are output from the video processor unit 40 as conceptually seen in FIG. 4.

Normally the VCU 44 receives these twelve bits of video data, demultiplexes the four chrominance subsamples back into one sixteen bit sample and converts the digital data back into an analog form. To insure proper demultiplexing of the chrominance sample, a reference clock is normally sent by the VPU to the VCU during the video vertical blanking period. The VCU synchronizes itself to this reference and thus demultiplexes the chrominance sample in the proper order (on chrominance sample boundaries).

Since a frame buffer 50 is interposed between these two integrated circuits, the present invention must preserve chrominance synchronization information.

Figure 6:
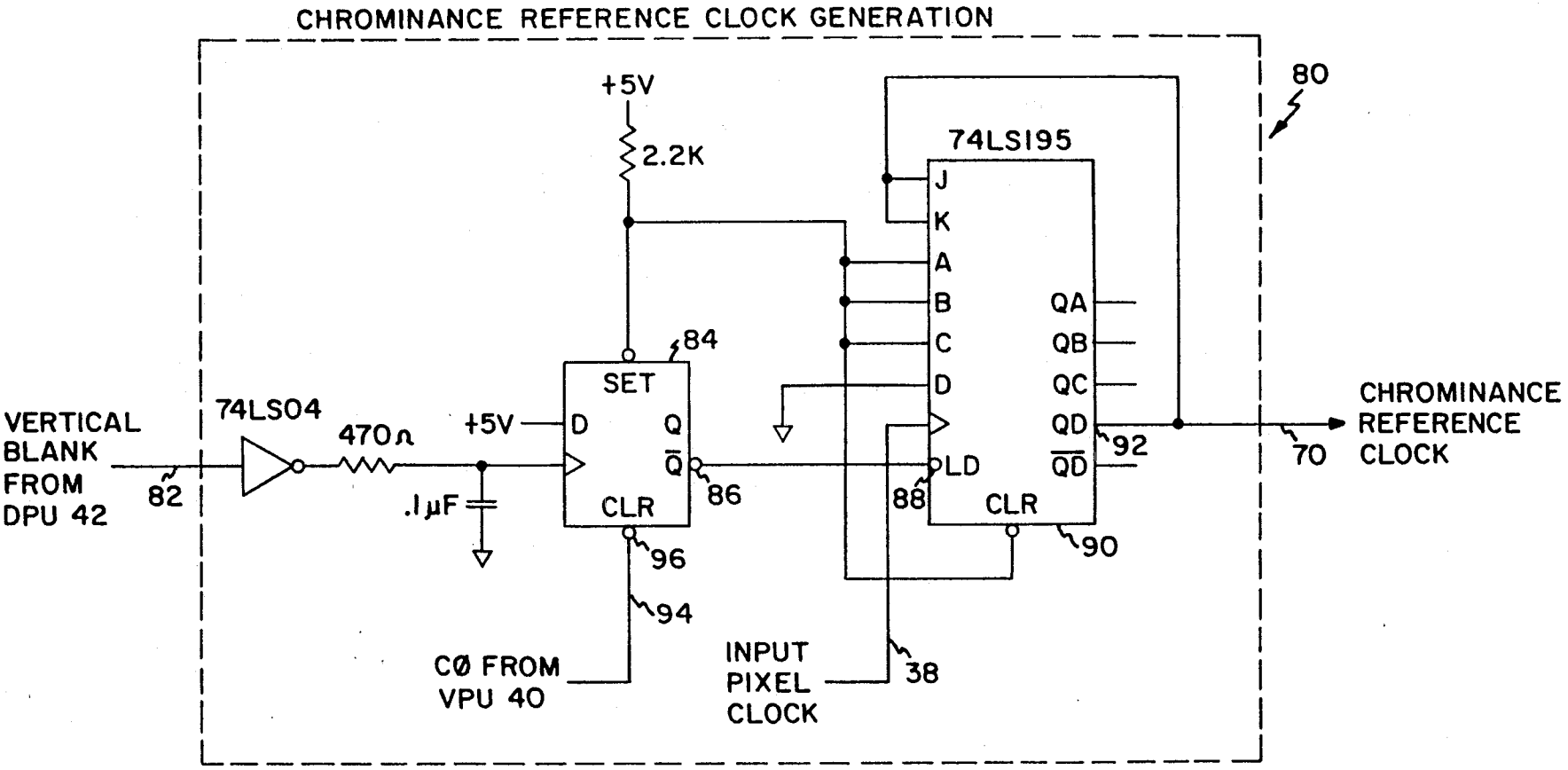
FIG. 6 is a detailed schematic diagram of the chrominance reference generator module forming part of the color synchronizer of the present invention.

In order to obtain proper chrominance synchronization, a chrominance reference clock signal 70 is generated such as shown in FIGS. 1C and 6. This signal has a waveform as shown in FIG. 4. It is seen in FIG. 4 that the chrominance reference clock is aligned with the first four bit chrominance subsample and thus can be used by the VCU 44 to properly align the incoming chrominance sample as sent to it on frame buffer output bus 52. It is also seen that the input pixel clock signal 38 from clock module 36 is used to align the chrominance reference clock signal with the input pixel clock.

The chrominance reference clock is generated in the present invention by a chrominance reference generator 80 as best seen in FIGS. 1 and 6. A vertical blank signal is generated on the composite blanking line of DPU 42 during the vertical flyback and a horizontal blank signal is generated during each horizontal flyback. This signal, after inversion, is presented to flip-flop 84. The Q bar output 86 of the flip-flop is connected to the load data (LD) input 88 of shift register 90 so that the $Q_D$ output 92 of the shift register generates waveform 70 shown in FIG. 4. It is also seen that the least significant chrominance bit, C0, from the VPU 40 (C0 output line designated by reference 94) is presented to the clear (CLR) input 96 of flip-flop 84 so as to insure the synchronization of the chrominance reference clock 70 with the incoming luminance and chrominance data.

The most significant seven luminance bits and the four chrominance bits are transferred to first-in, first-out stack (FIFO) 98 along with one bit of data from the chrominance reference clock 70. The least significant luminance bit is therefore not used and is replaced by the chrominance reference clock bit. These twelve bits of data are then transferred to the frame buffer by FIFO 98 over bus 56. This data is stored in the frame buffer as twelve bits of associated data representing one pixel of digitized incoming video in a manner as diagrammatically represented in FIG. 3.

Although one luminance bit is not used in the current implementation of the present invention, it would be apparent to one of ordinary skill in the art that by incorporating a frame buffer memory having more than twelve bits of storage per pixel sample, the full eight bits of luminance data could be stored within frame buffer 50.

Figure 7C:
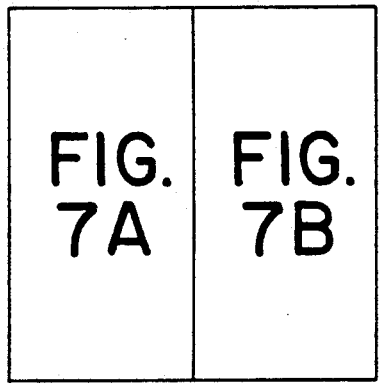
FIGS. 7A, 7B and 7C are detailed schematic diagrams of the chrominance synchronization output module forming part of the color synchronizer of the present invention.
Figure 7A:
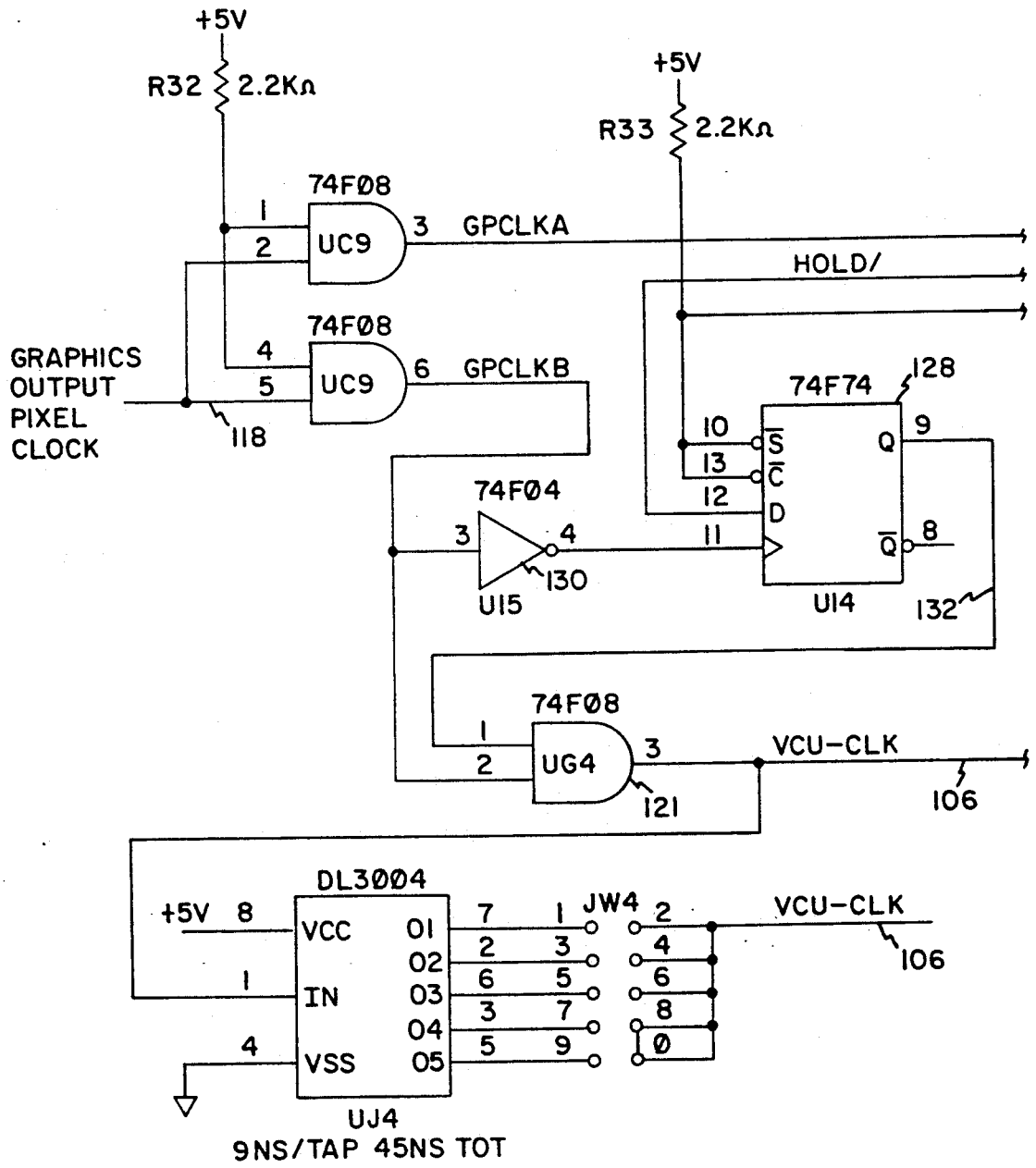
Figure 7B:
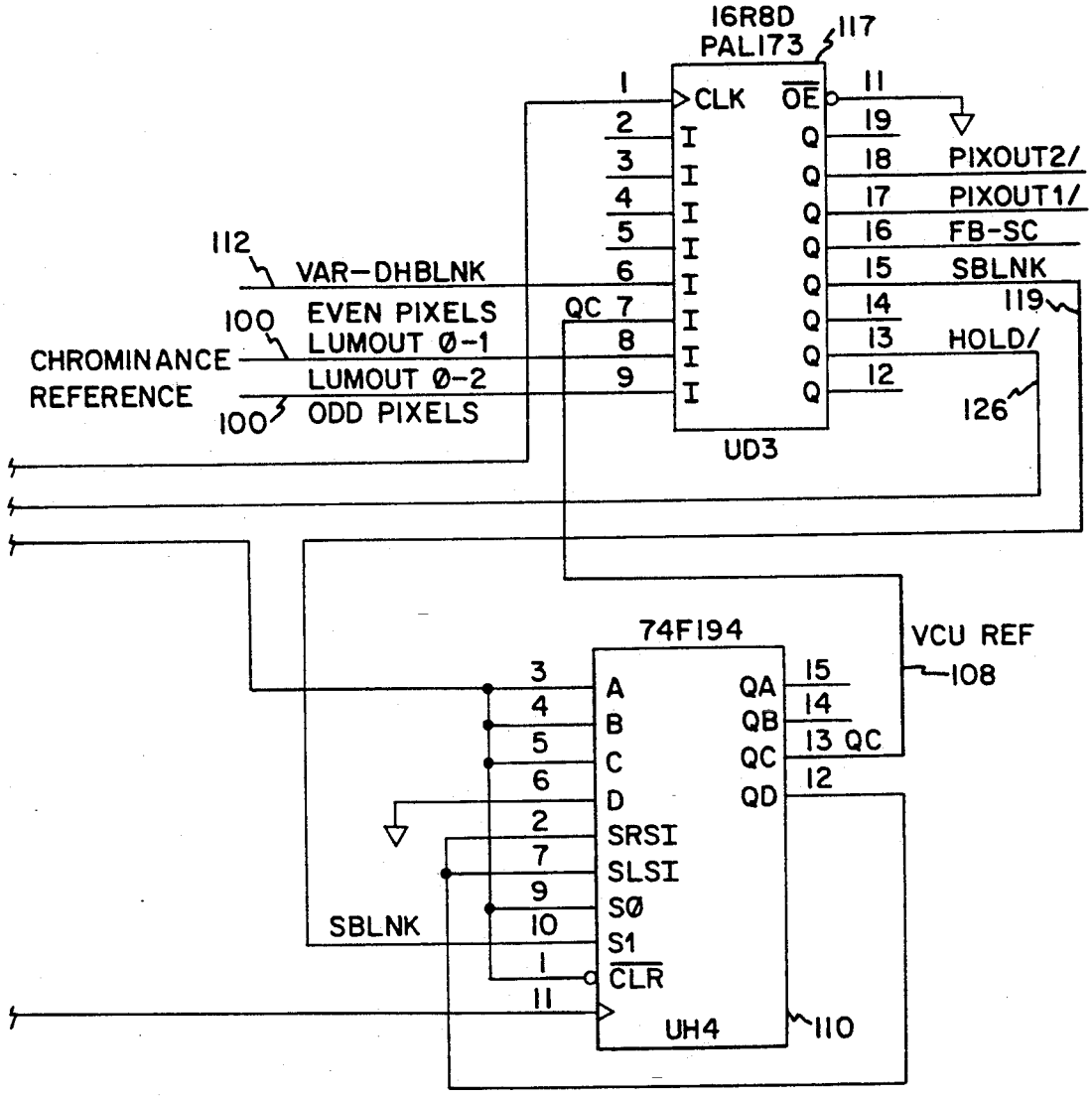

When the digital video data is read from the frame buffer 50, the chrominance reference clock signal data is also output on bus 52 via line 100 as best seen in FIGS. 1C and 7. This chrominance reference clock signal is used to control the generation of a video clock signal (VCUCLK) 106.

The VCU chrominance synchronization is performed in part by a VCU chrominance reference clock signal 108 (VCUREF) whose generation is best seen in FIG. 7. FIG. 7 shows the circuitry within chrominance synchronization output module 102. Internally, a VCU chrominance reference (VCUREF) signal is generated that is clocked to the graphics horizontal blank signal 112 but with a frequency equal to one-fourth the graphics output pixel clock frequency (GPCLK 118). The VCUREF signal therefore nominally represents the chrominance sixteen bit sample boundary which is to be used by the VCU to demultiplex four consecutive chrominance subsamples into one such sixteen bit chrominance sample. The phase of the VCU REF signal is not necessarily the same as the chrominance reference clock signal on line 100. The phase difference between these two reference signals is used to prevent the generated VCU clock signal 106 from operating until the two reference clocks are synchronized with each other.

FIG. 8 displays the waveforms associated with generation of the VCU clock (VCUCLK) signal 106. It is there seen that the chrominance synchronization output module 102 internally generates a HOLD VCU clock signal 132 that disables the VCU clock signal 106 until the chrominance reference clock signal on line 100 occurs. At this point, the chrominance reference clock causes a HOLD VCU clock signal 132 to change state thereby allowing the VCU clock to resume operation in synchronism with the graphics pixel clock 118. At this time VCU clock 106 is synchronized to the chrominance sixteen bit data samples arriving at the VCU from the frame buffer.

As seen in FIG. 7, a VCU reference signal 108 is generated by shift register 110 which is clocked to the graphics horizontal blank signal 112 that is received from timing signal 115 via graphics interface 26 (see FIG. 1). A programmable array logic device (PAL) 117 generates an output blanking signal (SBLNK) 119 which in turn controls shift register 110. The input pin and node declarations for PAL 117 are given in Table 2 while the output pin and node declarations are given in Table 3.

TABLE 2

| INPUT PIN AND NODE DECLARATIONS" | | |
|---|---|---|
| GPCLKA | PIN 1; | x"Graphics Pixel Clock |
| DHBLNK | PIN 6; | "Graphics Horizontal Blank |
| QC | PIN 7; | "VCU Chrominance Reference |
| LUMA0 | PIN 8; | "Frame Buffer Pixel Data Bit 0: Even Pixels |
| LUMA1 | PIN 9; | "Frame Buffer Pixel Data Bit 0: Odd Pixels |

TABLE 3

| "OUTPUT PIN AND NODE DECLARATIONS | | |
|---|---|---|
| LO0 | PIN 19; | "Latched Pixel Data Bit 0: Even Pixels |
| PIXOUT2 | PIN 18; | "Odd Pixels Output Enable |
| PIXOUT1 | PIN 17; | "Even Pixels Output Enable |
| FBSC | PIN 16; | "Video Ram Shift Register Clock |
| SDHBLNK | PIN 15; | "Synchronized Graphics Blank |
| SBLNK | PIN 14; | "Graphics Blank Synchronized With VCU Reference |
| HOLD | PIN 13; | "Hold VCU Clock |
| LO1 | PIN 12; | "Latched Pixel Data Bit 0: Odd Pixels |

The frequency of this VCU reference is equal to one fourth the graphics pixel clock signal 118 which in turn is generated by the graphics horizontal synchronization signal 120 and phase lock loop 122 (see FIG. 1). The VCU reference signal 108 is compared to the chrominance reference signal 100 so as to generate the VCU clock signal 106 in phase alignment with the chrominance reference input and thereby insures that VCU 44 uses the chrominance data on correct chrominance sample boundaries.

In order to achieve this result, PAL 117 receives the chrominance reference signal 100 for both the odd and even pixels and the VCU reference signal 108 and generates a HOLD signal 126 that goes low for a period of time equal to the phase difference between the chrominance reference signal and the VCU reference signal. The HOLD signal 126 goes low when the VCU reference signal is low and the chrominance signal is high and this HOLD signal is held low as long as the chrominance reference signal is high.

The L00 and L01 signals respectively associated with pins 19 and 12 of PAL 117 combine to form an internal chrominance reference signal which is compared to the VCU reference signal 108 (input QC, see Table 2). Any phase difference between the two reference signals generates a HOLD signal 126 which temporarily stops the VCUCLK signal 106 until the two references are synchronized.

The specific equations associated with PAL 117 are set forth in Table 4.

TABLE 4

```
/SDHBLNK   := /DHBLNK ;
/SBLNK     := SBLNK * /DHBLNK * /QC
           + /SBLNK * /DHBLNK;
/PIXOUT2   := /SBLNK * /PIXOUT1 * PIXOUT2;
/PIXOUT1   := /SBLNK * /FBSC * /OC * PIXOUT1
           * PIXOUT2
           + /SBLNK * PIXOUT1 * /PIXOUT2;
/FBSC      := /SBLNK * FBSC ;
/HOLD      := /QC * LO0 * /PIXOUT1
           + /QC * LO1 * /PIXOUT2
           + /HOLD * LO0 * /PIXOUT1
           + /HOLD * LO1 * /PIXOUT2 ;
LO0        := /LUMA0 * /FBSC
           +/LO0 * FBSC;
LO1        := /LUMA1 * /FBSC
           + /LO1 * FBSC;
```

Flip-flop 128 and inverter 130 are used to generate the hold VCU clock signal 132 which insures that a change in state of the hold signal only occurs when the pixel clock signal 118 is low. The purpose for insuring that the hold VCU clock signal is only allowed to change state when the pixel clock signal is low is that otherwise the hold VCU clock transition could cause the VCU clock signal 106 to have an electronic glitch which in turn could force the VCU 44 to operate erratically.

When the hold VCU clock signal 132 is ANDED with the graphics pixel clock by gate 121, the VCU clock has the same frequency as the graphics pixel clock as long as the hold VCU clock signal is high. When the hold VCU clock signal is low, thereby indicating that there exists a phase difference between the chrominance reference signal on line 100 and the VCU reference signal 108, the VCU clock is held low thereby preventing the VCU 44 from being clocked. This prevention of the VCU from being clocked thereby allows the chrominance data and the chrominance reference signal to align themselves with the VCU reference and thus insures that the generation of the red, green and blue video signals 58, 59 and 60 by the VCU are properly generated in view of the chrominance sixteen bit data sample.

By holding the VCU clock so as to be phase aligned with the chrominance reference signal 100, the chrominance data is demultiplexed in the proper fashion as originally stored in the frame buffer regardless of when that data is read from the frame buffer and regardless of what frequency the data is being read (i.e., the graphics pixel clock frequency).

WINDOW AND VIEWPORT GENERATION

Windows in most video/graphics systems represent regions where video information is to be displayed on an associated display monitor. Most prior art systems generate windows by means of a bit map plane. In such prior art systems, to create a window, contiguous bits within an area that represents the window are set "ON" so as to allow display of the underlying video information. These "ON" bits thereby define the shape and size of the window. This technique for generating windows has the disadvantage of requiring all bits in the overlay plane to be set each time the window is generated. Such an operation is time consuming and requires a relatively large amount of memory since each pixel of the display monitor must have a bit assigned to it in the overlay plane.

The present invention generates windows in a different manner. Instead of using a bitmap overlay plane to define each window shape and location, a data structure is used to define the start and stop locations for the window on a row by row basis. FIG. 9 depicts a portion of display monitor 30 showing an overall window 140 comprising four window row elements. Only the pixel start and stop locations for each row element are specified to define the overall window.

Thus the window start and stop parameters are used to effectively define the columns (i.e., the pixels) where each window row element is to start and stop. In effect any window is simply a list of start and stop locations. Since the video display typically comprises 470 rows and 768 pixels per row, and since the memory map comprises 1,024 pixel locations by 512 rows (compare FIGS. 3 and 9), there are in effect, 1,024 possible window starting and stopping positions for each row of pixels (some of which are outside of the video display area). However, the present implementation of the window system uses eight bits to define the window start location and eight bits to define the window stop location. Eight bits have 256 permutations ($2^8=256$) and consequently the resolution of the window start and stop location is four pixels ($1024/256=4$). Of course, if greater resolution is desired, more bits can be used to define the start and stop locations. If more than one window element is desired per row, additional start and stop locations can be defined per row.

FIG. 10 illustrates the data structure for defining each window row element. The window start parameter 105 is stored as byte #1 of a four byte data entry 113. The window stop parameter 107 is stored as byte #2. These two bytes along with bytes #3 and #4 regarding viewport information (see below) define a data entry for one row of video to be presented on monitor 30. This four byte data entry is stored in a display list 131. There are as many data entries 113 in this display list as there are rows for the associated graphics display card.

A viewport is another data structure which defines where a line of digitized video information from frame buffer 50 is to be placed on the screen. The first unit of information 109 in this data structure comprises nine bits and specifies the frame buffer row address where video data is to be read while the second unit of information 111 comprises six bits and specifies the first column of that frame buffer row which is to become the first column shown on the associated monitor. The dual ported frame buffer incorporates a high speed register which obtains the selected video information. This information is then available to the remaining circuitry.

Since the viewport row address comprises nine bits, it has 512 possible permutations ($2^9=512$) which allows any row of the frame buffer to be accessed. The viewport column address is six bits and therefore has sixty-four permutations ($2^6=64$) and consequently for a 1,024 pixel width frame buffer, each six bit value has a resolution of sixteen bits ($1024/64=16$). That is, the digitized video can be read starting on sixteen pixel boundaries. For example, the video read from the frame buffer can start at pixel 0, or pixel 16, or pixel 32, etc.

An example of the addressing scheme is shown in FIG. 3. If for instance the 80th pixel in row 100 (shown by reference numeral 141) of the frame buffer is to become the first displayed video pixel for the seventh row of the associated monitor (see FIG. 9 at reference numeral location 143), then the viewport entry for row number seven (the eighth video output line) would contain the following addresses:

| | |
|---|---|
| 1 1 0 0 1 0 0 | for decimal 100, and |
| 1 0 1 0 0 0 0 | for decimal 80 |

The values stored in bytes 3 and 4 of the display list (see FIG. 10) for the eighth four byte display list entry would be:

| |
|---|
| 0 1 1 0 0 1 0 0 |
| X 0 0 0 1 0 1 0 |

The "X" above is the window ON/OFF status bit and thus is not relevant to the viewport information. The reason for changing the binary value 1010000 to 101 is simply because the viewport column (pixel) address is on 16 bit boundaries (see above) and therefore 10000 binary, which equals 16 decimals, is truncated to 1.

The last bit 123 in byte #4 of four byte data entry 113 specifies whether the window row element associated with the viewport is ON or OFF.

As seen in FIG. 10, both the window and viewport data structures are combined as a four byte entry 142 which is stored in a display list 131.

For a VGA graphics card the display list is organized as a structure containing 512, four byte entries. It is the data within this display list which is transferred from the random access memory 146 to window control module 127 as seen in FIG. 1C.

It is the ability for the information within the display list to be transferred and used on a real-time basis that allows video information to be manipulated and displayed with graphic information from the EGA/VGA interface. This technique allows the video/graphics system to perform many of its graphic and video capabilities, including its ability to automatically configure itself for different graphic modes which generate varying vertical resolutions.

In operation, the window and viewport definitions are first created by the user through use of the interconnected computer. This information is transferred to RAM 146 via computer interface 24 (see program modules WINDOPR.C, INSTANCE.C and VPOPR.C in the annexed program listing, Appendix) These definitions describe the shape of the windows and how the video should be displayed on the monitor. The window(s) and associated viewport(s) are combined into four byte entries and stored in the display list. Each four byte entry is transferred one byte at a time by means of direct memory access (DMA) from RAM 146 to the window control module 127. The window control module controls the display of frame buffer RGB video data and graphics RGB data as output by VCU 44 and digital to analog graphics converter module 129 respectively to video keyers 152, 153 and 154. It does this function by controlling the operations of look-up table (LUT) module 150 which in turn generates a "select graphics" signal 157 or a "select video" signal 158 that controls operation of video keyers 152–154. Thus the window and viewport information are presented to display monitor 30 on a real-time basis.

As shown in FIG. 12, window control module 127 comprises a window start counter 133 which is loaded with the 8 bit window start value forming the first byte of each 4 byte display list entry (see FIG. 10). The value in this counter is decremented by one for each four pixels displayed on monitor 30. When this value equals zero the window start end count line 135 is activated, thereby setting flip-flop 137 and thus window line 171. This line when set to its ON state defines where the window element is active. When set by line 135 it thus denotes the pixel in the current horizontal line where the window element starts.

At the same time a window stop counter 134 is loaded with its corresponding 8 bit value from the same display list entry. This count value is also decremented by one for each four pixels displayed. When the count equals zero, a window stop end count signal 136 resets flip-flop 137 thereby terminating the window element for the current horizontal line of the monitor.

As also seen in FIGS. 1C, 10 and 12, one bit of each display list entry represents whether the window element is enabled. If it is enabled, the window enable line 161 is set to its ON state via decoder 163 forming part of device decoder and control module 165 (see FIG. 1C) and latch 167 forming part of video display and processor access control module 114 (see FIG. 1C). Line 161 is presented to OR gate 169 so as to maintain flip-flop 137 in its reset state if line 161 is in the OFF state.

FIG. 12 illustrates the operation of the window and viewport mechanism. As there seen, the direct memory access (DMA) controller 149 within CPU 148 contains several registers which are used in this mechanism. The "source" register 155 and the "destination" register 156 respectively indicate where the controller should obtain display list data within RAM 146 and where this read data should be sent. The "count" register 159 is loaded with the number of transfers to be performed.

When initiated through software (Appendix, INTSV-C.ASM module), the controller transfers, without processor intervention, a number of bytes equal to that stored in the "count" register with each byte containing data derived from the "source" address and presented to the "destination" address, subject to a "data request" (DRQ) signal 125 issued by window control module 127. When each data transfer is completed, the source register is incremented, thus pointing to the next byte entry in the display list stored in RAM 146 to be transferred to module 127. After each data transfer, the count register is decremented by one. When the count register equals zero, the controller automatically disables itself, thereby preventing the transfer of any additional data. Since the destination of the data is a single hardware input/output (I/O) port, the destination register is not changed.

This direct memory access process is initiated when the vertical synchronization signal 173 from the graphics board connected to the graphics interface 24 (see FIG. 1C) generates an interrupt to the interrupt controller portion 175 of central processing unit 148. The interrupt handling routine first disables the controller which stops the transfer of any additional data. This disablement of the controller is possible since the monitor, during the vertical retrace period, does not display any information since its electron beam is turned off during the vertical retrace time.

Second, the interrupt routine receives the vertical synchronization signal which thereby implies that a frame of information has been displayed and it is time to start a new display. The service routine resets the source register to its original value which is the first entry in the display list. The destination address is the same and therefore is not reset.

To insure that the controller count register does not disable itself (that is reach a zero count) before the graphics card has finished generating a frame, the count register is ideally set to a value equal to the number of lines being generated by the graphics card times the number of bytes in the display list per line. This number is not always possible to generate since the number of lines of graphics associated with the particular board may vary. In order to compensate for the uncertainty concerning the number of lines associated with the graphics display, the present invention implements an algorithm which assumes that a large number of graphic lines are to be generated. This number is chosen to be larger than any possible value for any board which can be placed into the associated computer.

Before resetting, the count register to the service routine reads the current value of this register. This value corresponds to the number of additional requests the DMA controller could have transferred before automatically disabling itself. The original count value minus this remaining value is therefore equal to the number of requests actually made by the graphics board. It is on this basis that the present invention automatically tracks on a per frame basis the number of graphic lines actually generated by the graphics board. This number is important to the algorithm associated with the transfer of color information from the frame buffer to the VCU (see Table 6, module AMAIN.C). Finally, before the vertical synchronization pulse is ended, the service routine re-enables the direct memory access controller.

Following the vertical synchronization pulse, a train of horizontal synchronization pulses are received. The horizontal synchronization information is connected such that each time it occurs, it generates a data request (DRQ) to the DMA controller. The controller responds by transferring a four byte entry from the display list to the hardware I/O port. Each horizontal synchronization pulse therefore triggers a stream of 4 bytes and the cycle terminates with each vertical synchronization signal 173 (see FIG. 1C).

A single channel of the central processing unit DMA controller is used to perform the data transfers. It is synchronized to both the horizontal and vertical timing signals of the graphics board.

The overall sequence of events that occurs for the display of each frame of information is presented in FIG. 11.

The source code for the computer program modules, including those pertaining to window and viewport generation are stored in read only memory (ROM) 147. The window and viewport program modules are presented in Appendix which is an appended computer printout. A summary of the functions performed by the program modules is presented in Table 5. The modules are written in either Microsoft C Version 4.0 or Intel 80188 assembler.

TABLE 5

COMPUTER PROGRAM MODULE DESCRIPTIONS

WINDOPR.C Window Operations
This module contains functions dealing with all aspects of the windows. Included are routines to create, add and delete window nodes. Also included are routines which generate the actual vector lists for primitive window shapes and routines which do translation of the vector lists, etc.

INSTANCE.C Instancing Operations
This module contains functions analogous to many of those in WINDOPR.C. Included are routines to create, add and delete instance nodes. Routines which provide much of the basic functionality of the system, such as moving an instance, creating multiple instances, instance coordinate translation, dissolve, invert, and other functions are included here.

VPOPR.C Viewport and Display List Operations
Included are routines to create, add and delete viewport nodes; routines which create viewport vector lists as well as mapping them to display lists. All viewport and display list special effects (panning, exchange, viewport block moves, etc.) are done here. Setting, retrieving, deleting baselines (display list functions) are done here as well.

FORMAT.C Data Formatter
This module consists of routines which format various data structures for transfer across the interface. Most data, such as window, viewport and macro definitions are used in a compressed format by the system. The format routines typically compress/decompress the data and perform error checking and normalization of the data.

AMAIN.C Main
This module contains routines which generally deal with interfacing the software to its underlying hardware, or actual control of the hardware. Routines in this category read and write the IMbus 29 (see FIG. 1) and I/O within the system, and determine current operating parameters, such as the number of graphics and video lines being received. Contained here are routines to read/write/test the frame buffer and synchronization information.

VWDMA.C VW DMA Control
This module contains routines which perform initialization and start/stop the two available direct memory access (DMA) channels.

TASKS3.C VCU Configuration and Control
This module is responsible for building the VCU data packet, serializing it and writing it into the frame buffer. Build_vcu() creates a data structure with the contents being what must be transferred to the VCU. Whatis_lastrow() calculates where in the display list to insert pointers pointing to the VCU data written in the frame buffer.

INTSVC.ASM Interrupt Handler Services
Contains all routines which service interrupt requests. Among these are the real time clock handler, communications handler and the handler which tracks graphics vertical blank and horizontal sync request on a per frame basis.

IMMAIN.ASM Low Level Start-up Code, IMbus Drivers
This assembly language module is used to start and configure the system, and perform some of the power-up tests. Also included here is the driver to read/write the IMbus 29 at the physical level Thus what has been described is a color synchronizer and windowing system for use in a video/graphics system which is able to combine digitized video information from a video source such as a video disc player, video cassette recorder, video camera and the like, with graphic data associated with a computer. This composite display uses a new type of window system which incorporates windows and viewports.

The video graphics system uses a digital television technology chip set for digitizing the incoming video information and combines this digitized video information as stored in a frame buffer with the graphics information from the computer by means of a color synchronization system so as to maintain proper chrominance information from the digitized video even though the normal synchronization information used in the digital television technology chip set is not used because of the frame buffer. Furthermore the present invention generates windows; that is, defining regions wherein video or graphics information can be seen on the associated monitor such that the windows are defined by start and stop locations for each row of the video monitor onto which the window is to be formed. In this manner the window system avoids use of a bitmap graphic technique commonly used in the prior art.

Furthermore the present invention defines what video information is to be displayed on the monitor by means of a viewport wherein the viewport defines the row and column of the frame buffer for obtaining video information for a given line of the associated monitor. The combination of the window data structure and the viewport data structure is defined as an entry item in a display list wherein the display list is defined for each row of the the associated graphics standard (vertical resolution of the monitor). Through use of this display list, the manipulation of the video information with the graphic information is facilitated and is achievable on a real-time basis.

It will thus be seen that the objects set forth above, and those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

APPENDIX

The following programming modules are included:

1. WINDOPR.C
2. INSTANCE.C
3. VPOPR.C
4. FORMAT.C
5. AMAIN.C
6. VWDMA.C
7. TASKS3.C
8. INTSVC.ASM
9. IMMAIN.ASM

```
/*****************************************************************************
*                                                                            *
*                                                                            *
*                    N e w   M e d i a   G r a p h i c s                     *
*                    ----------------------------------                      *
*                                                                            *
*                         V I D E O   W I N D O W S                          *
*                         -------------------------                          *
*                                                                            *
*                                                                            *
*        Module name:  WINDOPR.C                                             *
*        Version:      1.00                                                  *
*        Revision:     0                                                     *
*        Date:         Feb-88                                                *
*                                                                            *
*        Author:       R. Tricca                                             *
*                                                                            *
*                                                                            *
*****************************************************************************/

#include <vwinc.h> #include <stdio.h> #include <atmplts.h> #include <define.h>
#include
<struct.h>

#include "common.h"

#ifdef HDROHK

    #include "vwmodhdr.h"

#endif


IMPORT WINLIST *wlfront;


/*****************************************************************************
    ADDNODE

    Add a new node to a list of nodes.

        Scan linked list of nodes, if we don't find a matching node
        number, create a new node and insert it into the list; create a
        data buffer and point to it.

        Returns: If successful, pointer to new node,
                 otherwise null pointer                                      */


WINLIST *addnode(nodename, status)
    int nodename, status;

{

    register WINLIST *pnode;
    register char *pbuf;


    if((nodename != 0) && locate_window(nodename) == NULLP ){

        if((pbuf = malloc(sizeof(WINBUF))) != NULLP ){

            if(( pnode = (WINLIST *)malloc( sizeof(WINLIST))) != NULLP ){

                pnode->wnum = nodename ;            /* stuff new node   */
                pnode->wstatus = NULL ;
                pnode->pwin = (WINBUF *)pbuf ;
```

```
                pnode->next = wlfront ;                /* link in new node */
                wlfront = pnode;

                return(pnode);                        /* return address of node */

            } /* end inner if */

            else
                free((char *)pbuf);                   /* release window buffer */


        } /* end mid if */


    } /* end outer if */


    return( (WINLIST *)NULLP ); /* either no heap or window already defined */


} /* end addnode */

/*****************************************************************************
    DELETE NODE

        Delete a window node from the linked list.

        Scan linked list of window nodes, if we find matching window number
        remove node from the list and return its memory back to the heap

        Remember: A node cannot be deleted until both the instance list point
                  and the window definition pointer are null

        Returns: The node number deleted if successful.
                 Otherwise ~node number                                        */


delnode(wn)
    int wn; {
    register WINLIST *pw, *prv;
    BOOLEAN r;


    if((prv = pw = wlfront) != NULLP){

        while((r = pw->wnum != wn) && (pw->next != NULLP)){
            prv = pw ;
            pw = pw->next ;
        }

        if(!r){                                  /* !r means we found a match */
            if(pw->pwin != NULLP){
                free((char *)pw->pwin);          /* free the window buffer    */
                pw->pwin = NULLP;
            }
                if(pw == wlfront)
                    wlfront = wlfront->next;
                else
                    prv->next = pw->next ;

                free((char *)pw);                /* free the node             */
                return(wn);
        }

    } /* end outer if */

    return( ~wn );

} /* end delnode */
```

```
/*****************************************************************************
    LOCATE WINDOW

            This routine returns the address of the selected window node.

            Each window node is assigned a name by the user when the
            window is created.

            Returns: A pointer to the node containing the window if successful
                     otherwise a null pointer                                  */



WINLIST *locate_window(wn)
    int wn;      /* window number */

{

    register WINLIST *pw;
    BOOLEAN r;


    /* scan linked list of window nodes, if we find matching window number
       return the nodes address

    if( (pw = wlfront) != NULLP ){
        while(( r = pw->wnum != wn ) && ( pw = pw->next ) != NULLP );

        if( !r )
            return( pw );
    }

    return( (WINLIST *)NULLP );


} /* end locate_window */



/*****************************************************************************
    REPORT WINDOW NODE

        This routine builds an informational packet about the window node
        selected and sends the info back to the PC.


    Returns: RET_OK
             ~RET_OK

*/

wreport(wn)
    unsigned wn;

{

    register REPORT *p;
    register WINLIST *pw, *pwl;

    WININS *pins;


    if((p = (REPORT *)malloc(sizeof(REPORT))) != NULLP){
```

```
        if((pw = locate_window(wn)) != NULLP){

            p->wr.wn = wn;
            p->wr.status = 0;
            p->wr.x3 = pw->x3;
            p->wr.y3 = pw->y3;

            p->wr.idefined = 0;
            pins = pw->pins;

            while(pins != NULLP){
                p->wr.idefined++;
                pins = pins->next;
            }

        }


        p->wr.wdefined = 0;
        pwl = wlfront;

        while(pwl != NULLP){
            p->wr.wdefined++;
            pwl = pwl->next;
        }


        xfr_data((char far *)p, sizeof(REPORT), SENDATA, TRUE);
        free((char *)p);
        return(RET_OK);

    }

    else

        return(~RET_OK);



} /* end window report */

/*****************************************************************************
    CLOSE ALL WINDOWS

        Close down every window in the system. Return all memory deallocated
        back to the heap. This function implies that all instances will be
        closed as well.


        Returns:    The number of windows which were closed

*/


wcloseall()

{

    register WINLIST *pw;

    register wclosed;


    wclosed = 0;


    while((pw = wlfront) != NULLP)
        wclosed = (close(pw->wnum,WINDOW_OFF)== pw-[illegible]) ? wclosed++ : wclos-
;
```

```
    return(wclosed);


} /* end wcloseall */



/*****************************************************************************
    CLOSE WINDOW
        Close a window definition. If the WINDOW_OFF parameter is set, then
        erase all instances of the window from the currently defined screen.
        If WINDOW_ON is selected, then close the window definition, but leave
        any window instances on the screen.

        P.S: Remember, closing the root instance of a window implies closing
             all instances of the window.

        Returns:    if successful, the window number closed,
                    otherwise, ~(window number closed);                    */


close(wn, onoff)
    int wn, onoff;

{

    if(iclose(wn, 0, onoff) == RET_OK)
        return(delnode(wn) == wn ? wn : ~wn);


    return(~wn);


} /* end close */


/*****************************************************************************
    MAKE_WINDOW

        Make_window unpacks the window name, shape & size parameters,
        and then creates an appropriate window. This window is then
        added to the linked list of window nodes. Its characteristics can then
        be applied to either the foreground or background screens.

        Make_windows can only be used to create a new window definition.
        If a search of currently defined windows indicates the window already
        exists, then a new one isn't created

        Returns: if successful, the number of the window(an int)
                 or
                 ~window number
*/


make_window(wn, shape, width, lengh)
    int wn, shape, width, lengh;

{

    register WINLIST *pnode;

    IMPORT unsigned mincols, minrows, maxcols, maxrows;
    unsigned wmax;
```

```
    if((pnode = addnode(wn, 0)) != NULLP ){
        width = (WINRES > width || width > maxcols) ? maxcols : width;
        /* RMVD 4/11/89 lengh = (MINWIN > lengh || lengh > maxrows)? maxrows -
1 :
                        lengh;*/

        lengh = (MINWIN > lengh || lengh > maxrows) ? maxrows : lengh;

        if(shape == ELLIPSE)
            draw_ellipse(pnode->pwin, width, lengh);

        else
            draw_rectangle(pnode->pwin, width, lengh);


        pnode->x3 = width;
        pnode->y3 = lengh;


        return(wn);
    }

    else
        return(~wn);


} /* end make_window */


/*****************************************************************************
    EXTRACT

        Extract a segment of the display list instancing information and with
        it create a new window definition, equivalent to any other window
        definition

*/


extract_window(wn, start, end)
    int wn, start, end;

{       }

/*****************************************************************************
    GROW WINDOW

        Grow the definition of a window. */

grow_window(wn)
    unsigned wn;


{   return;     }



/*****************************************************************************

    DRAW_RECTANGLE

        Generates a 2D rectangle with the coordinate map given, into a
        a buffer. Intended to create a window in the users window buffer.

        Windows are always created with point x1,y1 = 0.


        Returns RET_OK  if everything went smoothly, otherwise
                ~RET_OK if passed a null pointer for the window buffer  */
```

```
draw_rectangle(wbuf, x3, y3)
    int x3, y3 ;
    register WINBUF *wbuf;

{

    register int i;


    if(wbuf != NULLP){

        memset( (char *)wbuf, '\0', sizeof(WINBUF) );

        x3 /= WINRES;

        if(x3 >= MAXCOLS / WINRES)
            x3 = MAXCOLS / WINRES - 1;

        for(i = 0; i < y3; wbuf->w[i].wstart = 0, wbuf->w[i].wend = x3, i++);

        return(RET_OK);

    }

    else
        return(~RET_OK);


} /* end draw rectangle */


/*****************************************************************************

    DRAW_ELLIPSE

        Generate a 2D ellipse into the buffer provided.

        If you want to understand whats going on here, simply turn to page 445
        of "FUNDAMENTALS OF INTERACTIVE COMPUTER GRAPHICS" BY  FOLEY & VAN DAM

        Where xrad = x radius
              yrad = y radius


        Returns: RET_OK if everything went smoothly.
                 ERR_NULLP if passed a null pointer for the window buffer */




draw_ellipse(wbuf, diameter, eccentricity)
    WINBUF *wbuf;
    unsignec diameter, eccentricity;


{
    WB *pointbuf;
    register int x, y;
    int d;
    unsignec radius;


    if(wbuf != NULLP){

        memset((char *)wbuf, 0, sizeof(WINBUF));

        if(diameter > MAXROWS || diameter > MAXCOLS)
            diameter = MAXROWS < MAXCOLS ? MAXROWS - 1 : MAXCOLS - 1;
```

```
        if((pointbuf = (WB *)malloc(sizeof(WB))) != NULLP){

            memset((char *)pointbuf, 0, sizeof(WB));

            y = (radius = diameter / 2);
            d = 3 - (2 * radius);


            for(x = 0; x < y; x++){

                points(pointbuf, radius, x, y);

                d += (d < 0) ? (4 * x) + 6 : 4 * (x - y--) + 10;

            } /* end for */


            if(x == y)
                points(pointbuf, radius, x, y);


            win_decode(pointbuf, wbuf);

            free((char *)pointbuf);          /* release heap back to system */


            return(RET_OK);


        } /* end if */


    } /* end if */


    return(RET_OK);


} /* end draw_ellipse */


/*****************************************************************************
    POINTS

        From the x, y coordinates passed in, generate an additional 7 points
        around the circle(taking advantage of the symmetry), and stuff them to
        the buffer.


        Returns: Always returns RET_OK

*/


points(buf, radius, x, y)
    register WB *buf;
    register int radius;
    int x, y;


{


    buf->w[radius - y].end   =  x + radius; /* generate top quarter      */
    buf->w[radius - y].start = -x + radius;

    buf->w[radius - x].end   =  y + radius; /* generate top mid quarter */
    buf->w[radius - x].start = -y + radius;
```

```
    buf->w[radius + y].end   =  x + radius; /* generate bot quarter      */
    buf->w[radius + y].start = -x + radius;

    buf->w[radius + x].end   =  y + radius; /* generate bot mid quarter */
    buf->w[radius + x].start = -y + radius;


    return(RET_OK);


} /* end points */


/*****************************************************************************
    HOME WINDOW

        Take a window definition and translate it down to the X & Y baselines.
        If the window already touches the baselines, then simply return.

        The x3, y3 point contained in the node description for this window
        will be updated.

        Input: A window definition number.

        Returns: RET_OK
                 ~RET_OK                                                    */


home_window(wn)
    int wn;

{

    WINLIST *pnode;
    register WINBUF *wbuf;
    register WINEL *wel;
    int i, y1, y3, x1, x3, olo ;


    if((pnode = locate_window(wn)) != NULL_P){

        if(fnd_wbnd((wbuf = pnode->pwin), &y1, &y3, &x1, &x3) == WINDOW_PRESE
}

            if( y1 != 0 || x1 != 0 )

                for( i = y1; i <= y3; i++ ){
                    wbuf->w[i - y1].wstart = wbuf->w[i].wstart - x1;
                    wbuf->w[i - y1].wend = wbuf->w[i].wend - x1;
                    wbuf->w[i].wstart = wbuf->w[i].wend = 0;
                }

        pnode->x3 = x3 - x1;
        pnode->y3 = y3 - y1;


        return(RET_OK);


    } /* end outer if */


    return(~RET_OK);


} /* end home_window */
```

```
/*****************************************************************************

    FND_WBND

        Find window boundaries. Pass in a window buffer and min/max pointers
        and this routine will return the outermost points of the window.
        The window can be any shape.

        Input: Four pointers
                    top, bottom, left and right window extrema;

        Output: the extremes of the window shape, or zero if no window defined

        Returns: WINDOW_PRESENT if the window has been defined
                or
                  NO_WINDOW   if all buffer addresses are clear
*/
- -



fnd_wbnd( wbuf, t, b, l, r )
        WINBUF *wbuf;
        int *t, *b, *l, *r;

{

    IMPORT unsigned maxrows, maxcols;
    WINEL *pp;

    USHORT *p;
    int i;



    *t = -1;
    *b = maxrows;
    *l = maxcols;
    *r = 0;

    p  = (USHORT *)wbuf;                    /* scan to first start address */
    while( (*( p + ++(*t)) == 0) && ( *t < maxrows ) ) ;

    if( *t == maxrows ){          /* return all zeroes if no window defined */
        *t = *b = *l = 0;
        return( NO_WINDOW );
    }

    else{
        p  = (USHORT *)wbuf;                /* scan back to last address    */
        while( *( p + --(*b)) == 0 && ( *b >= 0 ) );
        for( i = *t; i <= *b; i++ ){
            pp = (WINEL *)wbuf + i ;

            if(pp->wstart < *l )

                *l = pp->wstart;

            if( pp->wend > *r )
                *r = pp->wend;

        } /* end for */

    } /* end else */

    return(WINDOW_PRESENT);


} /* end find window boundaries */
```

```
/*****************************************************************************
*                                                                            *
*                                                                            *
*                    N e w   M e d i a   G r a p h i c s                     *
*                    ----------------------------------                      *
*                                                                            *
*                        V I D E O   W I N D O W S                           *
*                        -------------------------                           *
*                                                                            *
*                                                                            *
*        Module name:  INSTANCE.C                                            *
*        Version:      1.00                                                  *
*        Revision:     0                                                     *
*        Date:         Mar-88                                                *
*                                                                            *
*        Author:       R. Tricca                                             *
*                                                                            *
*                                                                            *
*                                                                            *
*****************************************************************************/


#include <vwinc.h> #include <stdio.h> #include <atmplts.h> #include <define.h>
#include
<cstruct.h>


#ifdef HDRCHK

    #include "vwmodhdr.h"

#endif


    IMPORT WINLIST *wlfirst;
    IMPORT unsigned minrows, maxrows, mincols, maxcols;
    IMPORT BOT *curstrm;


/*****************************************************************************
    LOCATE INSTANCE

            This routine returns the address of the selected window instance
            node.

            Each instance node is assigned a number by the user when the
            window is created.

            Returns: A pointer to the node containing the instance if
                     successful otherwise, a null pointer                  */



WININS *locate_instance(wn, in)
    int wn, in;                     /*  window number, instance number  */
{

    register WINLIST *pw;
    register WININS  *pins;
    BOOLEAN r;


    /* scan linked list of window nodes, if we find matching window number,
       then attempt to locate the instance requested                      */

    if(( pw = locate_window(wn)) != NULLP){
        pins = pw->pins;
```

```
        if( pins != NULLP ){
            while(( r = pins->inum != in ) && ( pins = pins->next ) != NULLP )

            if( !r )
                return( pins );
        }

    }

    return((WININS *)NULLP);


} /* end locate_instance */


/*****************************************************************************
*
 - -  REPORT INSTANCE

        This routine builds an informational packet about the window node
        selected and sends the info back to the PC.


    Returns: RET_OK
             ~RET_OK

*/



ireport(wn, in)
    unsigned wn, in;

{

    register REPORT *p;
    register WINLIST *pw;

    WININS *pins, *pi;


    if((p = (REPORT *)malloc(sizeof(REPORT))) != NULLP){

        if((pi = locate_instance(wn, in)) != NULLP){

            p->ir.in = in;
            p->ir.status = 0;
            p->ir.x1 = pi->x;
            p->ir.y1 = pi->y;

        }

        if((pw = locate_window(wn)) != NULLP){

            p->ir.idefined = 0;
            pins = pw->pins;

            while(pins != NULLP){
                p->ir.idefined++;
                pins = pins->next;
            }


        }


        xfr_data((char far *)p, sizeof(REPORT), SENDATA, TRUE);
        free((char *)p);
        return(RET_OK);
```

```
}

else

        return(~RET_OK);



} /* end instance report */


/*****************************************************************************

    NEXT INSTANCE
        This function takes as parameters a window number and a pointer to an
        instance node. It returns a pointer to the NEXT instance node in the
        list, AFTER FIRST CHECKING TO INSURE SURE THAT BOTH THE WINDOW
        DEFINITION NODE AND THE INSTANCE NODE HAVE NOT BEEN DELETED SINCE THE
        LAST NEXT_INSTANCE() REQUEST.

        Passing in a null pointer means start from the top of the list.
        Receiving a null pointer back indicates that the end of the list has
        been reached. If the node requested has been deleted, the function
        return value will be ~RET_OK, and the pointer returned will be null.

        P.S. This is a critical routine, don't screw around with it.

*/


next_instance(wn, pins)
    int wn;
    register WININS **pins; {

    BOOLEAN r;
    WINLIST *wnode;
    register WININS *p;


    if((wnode = locate_window(wn)) != NULLP){

        p = wnode->pins;                /* point to first list element */

        if(*pins == NULLP){             /* point user there also if NULL rqst*/
            *pins = p;

            if(p != NULLP)              /* if an instance list exists, return*/
                return(RET_OK);         /* first instance node               */
        }
        else
            if(p != NULLP){
                while( (r = p != *pins) && p->next != NULLP )
                    p = p->next;

                if( !r ){               /* !r means p = pins */
                    *pins = p->next;
                    return(RET_OK);
                }
            }

    }

    *pins = NULLP;      /* either the window or instance has been deleted */
    return(~RET_OK);    /* or empty instance list                         */


} /* end next instance */
```

```
/*****************************************************************************
    ADDINS

    Add a new instance node to the list of nodes.

        Scan linked list of window nodes, if we don't find a matching node
        number, then we can't create an instance of that window. otherwise,
        create a new instance node and insert it into the list.

        Remember: Window instance zero is the root instance; a special case.
                  Do not allow window instance 0 to be created.

        Returns: If successful, pointer to new node,
                 otherwise null pointer                                    */


WININS *add_instance( wn, iname, status )
    int wn, iname, status;

{

    register WINLIST *pnode;
    register WININS *pins;


    if( (iname != 0) && (pnode = locate_window(wn)) != NULLP){

        if( locate_instance(wn, iname) == NULLP){

            if(( pins = (WININS *)malloc( sizeof(WININS))) != NULLP ){

                pins->inum = iname ;          /* stuff new node           */
                pins->instat = status ;       /* curntly not using status */
                pins->x = pins->y = 0;

                pins->next = pnode->pins;     /* link in new node         */
                pnode->pins= pins ;

                return(pins);                 /* return address of node   */

            } /* end inner if */

        } /* end next inner if */

    } /* outermost if  */


    return( (WININS *)NULLP );  /* either no heap, window already defined,
                                   or window instance already defined       */

} /* end add instance node */


/*****************************************************************************
    MOVE

    Move an instance of a window from its current location to a new location

    Be sure both the window definition and instance exist.
    If the instance doesn't already exist, create it and place it at 0,0.
    Delete the old instance with 'iturn()' , update instance list and then
    install new instance with 'copy()'.

    This function supports instance zero windowing features.

        Returns:  RET_OK
                  or ~RET_OK                                               */
```

```
move(wn, in, x, y, onoff)
    int wn, in, x, y, onoff;

{

    register WINLIST *pnode;
    WININS *pins;
    int stat, yprime, ycnt;


    if((pnode = locate_window(wn)) != NULLP){

        if((in != INSTANCE_ZERO) && (pins = locate_instance(wn, in)) == NULLP){

            if((pins = add_instance(wn, in, 0)) == NULLP)
                return(~RET_OK);
            else
                return(copy(pnode, pins, (unsigned)x, (unsigned)y, onoff));
        }

        else{

            if(in == INSTANCE_ZERO){
                pins = NULLP;

                while(next_instance(wn, &pins) == RET_OK && pins != NULLP){

                    ishift(pnode, pins, y, &yprime, &ycnt);
                    iturn(pnode, pins, yprime, ycnt, WINDOW_OFF);
                    copy(pnode, pins, (unsigned)x, (unsigned)y, onoff);

                } /* while next_instance */
            }

            else
                if((pins = locate_instance(wn, in)) != NULLP){
                    ishift(pnode, pins, y, &yprime, &ycnt);
                    iturn(pnode, pins, yprime, ycnt, WINDOW_OFF);
                    copy(pnode, pins, (unsigned)x, (unsigned)y, onoff);
                }

            return(RET_OK);

        } /* end outer else */


    } /* outermost if  */


    return(~RET_OK);


} /* end move */


/*****************************************************************************
    COPY

        Copy the definition of a window to an instance on the screen. The
        window instance must already have been created. Reguardless of the
        X,Y parameters passed in, the window instance will be clipped to a
        valid size. Windows do not wrap, either horizontally or vertically.


        Returns: RET_OK
                 or  ~RET_OK if error                                        */
```

```
copy(pnode, pins, x, y, onoff)
    register WINLIST *pnode;
    register WININS *pins;
    unsigned x, y;
    int onoff;

{

    ADT *pl;
    unsigned i, k, maxc, start, end;


    if(x >= mincols && x < maxcols && y >= minrows && y < maxrows){

        x /= WINRES;
        maxc = maxcols / WINRES;

                                        /* k = number of lines to operate on */
        k = ((pnode->y3 + y) >= maxrows) ? (maxrows - y) : pnode->y3;


        for(i = 0; i < k; i++){

            if((start = pnode->pwin->w[i].wstart + x) >= maxc)
                start = maxc - 2;

            if((end = pnode->pwin->w[i].wend + x) >= maxc)
                end = maxc - 1;

            (pl = (ADT *)(&curscrn->a[i + y]))->win_on = start;

            pl->win_off = end;

            if(onoff == WINDOW_ON)
                pl->vpcas |= VIDEO_ON;
            else
                pl->vpcas &= ~VIDEO_ON;

        } /* end for */


        pins->y = y;        /* update now because everything went smoothly */
        pins->x = x * WINRES;

        return(RET_OK);


    } /* end outer if */


    else

        return(~RET_OK);


} /* end copy */


/*****************************************************************************
    DELINS

        Delete a window instance node from the window instance list.

        Scan linked list of window nodes, if matching window number found,
        then scan instance list of that window for the requested instance.
        If it exists, remove from the instance list and return its memory back
        to the heap.
```

```
        This function should only be called indirectly through iclose().
        (which supports instance zero)

        Returns: The instance number deleted if successful. (don't forget what
                 the window number was !)
                 Otherwise ~instance number                                    */


del_instance(pnode, in)
    register WINLIST *pnode;
    int in;

{

    register WININS *pins, *prvpins;

    BOOLEAN r;


    if(pnode != NULLP){
        prvpins = pins = pnode->pins;

        if(pins != NULLP){

            while((r = pins->inum != in) && (pins->next) != NULLP){
                prvpins = pins ;
                pins = pins->next ;
            }

            if( !r ){

                if(pins == pnode->pins)
                    pnode->pins = (pnode->pins)->next;      /* beauty, eh ? */

                else
                    prvpins->next = pins->next ;

                free((char *)pins);
                return(in);

            } /* end inner if */

        } /* end mid if */

    } /* end outer if */

    return(~in);


} /* end delete instance node */


/*****************************************************************************
    ICLOSE
        Close an instance of a window. If the WINDOW_OFF parameter is set,
        then erase the instance from the screen.

        If the window root instance is selected, close all instances.
        Attempting to close a window which does not exist is fair play.

        This function supports instance zero windows

        Returns: always returns RET_OK                                       */


iclose(wn, inum, onoff)
    int wn, inum, onoff;
```

```
{

    register WINLIST *wnode;
    WININS  *pins;


    if((wnode = locate_window(wn)) != NULLP){

        if(inum == INSTANCE_ZERO){
            pins = NULLP;

            while((next_instance(wn, &pins) == RET_OK) && pins != NULLP){

                if(onoff == WINDOW_OFF)
                    iturn(wnode, pins, MAXROWS+1, MAXROWS+1, WINDOW_OFF);

                del_instance(wnode, pins->inum);
                pins = NULLP;

            } /* end while */

        }

        else
            if(( pins = locate_instance(wn, inum)) != NULLP){

                if(onoff == WINDOW_OFF)
                    iturn(wnode, pins, MAXROWS+1, MAXROWS+1, WINDOW_OFF);

                    del_instance(wnode, inum);
            }

    }

    return(RET_OK);


} /* end iclose */

/*****************************************************************************
    WONOFF
        Turns the visible window instance on or off, leaving the window
        definition and window instance definition intact.

        It is perfectly legal to attempt to turn off a window instance which
        does not exist

        This routines supports instance zero windowing functions.

        Returns: Always returns RET_OK                                    */



wonoff(wn, inum, onoff)
    int wn, inum, onoff;

{

    register WINLIST *wnode;
    WININS  *pins;


    if((wnode = locate_window(wn)) != NULLP){

        if(inum == INSTANCE_ZERO){
            pins = NULLP;
            while((next_instance(wn, &pins)) == RET_OK && pins != NULLP )
                iturn(wnode, pins, MAXROWS+1, MAXROWS+1, onoff);
```

```
        }

        else
            if(( pins = locate_instance(wn, inum)) != NULLP)
                iturn(wnode, pins, MAXROWS+1, MAXROWS+1, onoff);

    }


    return(RET_OK);


} /* end wonoff */


/*****************************************************************************
    ISHIFT

        Calculates a 'y' direction raster shift based upon the current location
        of a window instance and a new position. The function is primarily
        used by move() to determine the fewest number of window rasters which
        must be turned off when moving an instance. Only rasters which will be
        left behind and not overwritten by the new instance position must
        explicitly be turned off.

        Returns: function returns RET_OK or ~RET_OK.

                The returned parameters indicate the start raster and a count
                of the number of rasters the instance will move by.
                i.e. the section of the instance no longer valid.


*/


ishift(pnode, pins, y, yprime, ycnt)
    WINLIST *pnode;
    WININS *pins;
    int y, *yprime, *ycnt;

{

    register unsigned cur_y, size;


    if(pnode != NULLP && pins != NULLP){

        cur_y = pins->y;
        size = pnode->y0;

        if(y > cur_y){
            *yprime = cur_y;
            *ycnt = y - cur_y;
        }
        else{
            *yprime = y + size;
            *ycnt = cur_y - y;
        }

        return(RET_OK);
    }

    else{
        *ycnt = 0;
        return(~RET_OK);
    }


} /* end ishift */
```

```
/*****************************************************************************
    ITURN

        Turns the window instance on or off, leaving the window definition
        intact. If the num parameter is >=  MAXROWS the entire instance will
        be turned on/off. Otherwise, only the segment
        described by these two parameters will be updated. The window is only
        turned on when it fits within the currently
        defined viewport. Portions of the window which do not reside within
        the viewport space are not turned on.


        RETURNS:  WINDOW_ON   WINDOW_OFF  NO_WINDOW
                or  ERR_NULLP                                                 */



iturn(pnode, pins, start, num, onoff)
    WINLIST *pnode;                     /* pointer to window node          */
    WININS *pins;                       /* pointer to window instance node  */
    unsigned start, num, onoff;

{

    int i, y, yend, status;



    if(pnode != NULLP && pins != NULLP){

        if(num > pnode->y3 || (num > maxrows)){
            yend = ((yend = pins->y + pnode->y3) <= maxrows) ? yend : maxrows;
            i = pins->y;
        }
        else{
            yend = (yend = start + num) <= maxrows ? yend : maxrows;
            i = start <= yend ? start : minrows;
        }


        if(onoff == WINDOW_OFF)
            for(; i < yend; curscrn->a[i++].vpcas &= ~VIDEO_ON);
        else
            if(onoff == WINDOW_ON)
                for(; i < yend; curscrn->a[i++].vpcas |= VIDEO_ON);
        else
            onoff = NO_WINDOW;


        status = onoff;

    }
    else
        status = ERR_NULLP;


    return(status);


} /* end iturn */



/*****************************************************************************

    DISSOLVE

        Dissolve is a slightly more elegant way to turn a window off/on.
```

```
        It selectively turns off the rasters within a window one by one.

        The algorithm is fairly simply: Keep dividing the window interval in
        half. Turn off the rasters that fall on the interval boundary through-
        out the whole window. finally scan the buffer and shut off every raster
        just in case we missed some due to math calculation rounoff.

        This function supports instance zero.


            Returns: Always returns RET_OK
*/



dissolve(wn, inum, mode, opr)
    int wn, inum, mode, opr;

{

    register WINLIST *wnode;
    WININS  *pins;



    if((wnode = locate_window(wn)) != NULLP){

        mode = (mode != WSWEEP && mode != WSTACK) ? WSTACK : mode;

        if(inum == INSTANCE_ZERO){
            pins = NULLP;

            while(next_instance(wn, &pins) == RET_OK && pins != NULLP )
                dissolve_instance(wnode, pins, mode, opr);
        }

        else
            if(( pins = locate_instance(wn, inum)) != NULLP)
                dissolve_instance(wnode, pins, mode, opr);

    }

    return(RET_OK);


} /* end dissolve */


/*****************************************************************************
    DISSOLVE INSTANCE

        dissolve a window instance

        Yes, I realize that rasters are going to be cleared more than once;
        but who cares ? we have to slow the process down anyway, and the code
        is much simpler this way !


        Returns: */


dissolve_instance(wnode, pins, mode, opr)

    WINLIST *wnode;
    WININS *pins;
    int mode, opr;

{

    IMPORT fixwipe;                         /* set by the function "special()"  */
```

```
    register i, j;

    static BOOLEAN direction = DOWN;
    int size, interval, base, timeout;



    if(wnode != NULLP && pins != NULLP){

        base = pins->y;
        size = (size = base + wnode->y3) > maxrows ? maxrows : size;

        interval = (mode == [illegible]) ? 1 : size - 1;
        opr = (opr == WIN[illegible] 1 : 0;

        timeout = (wnode [illegible] rows / 2) ) ? 400 : 900;

        do{

            if(direction == DOWN){

                for(i = base; i < size; i += interval){
                    curscrn->a[i].vpcas &= ~VIDEO_ON;

                    if(opr)
                        curscrn->a[i].vpcas |= VIDEO_ON;

                    for(j = 0; j < timeout; j++);

                } /* end inner for */

                direction = (fixwipe == 0) ? UP : fixwipe;

            }

            else{

                for(i = size - 1; i >= base; i -= interval){
                    curscrn->a[i].vpcas &= ~VIDEO_ON;

                    if(opr)
                        curscrn->a[i].vpcas |= VIDEO_ON;

                    for(j = 0; j < timeout; j++);

                } /* end inner for */

                direction = (fixwipe == 0) ? DOWN : fixwipe;

            }

        } while((interval >>= 1) > 0);

    } /* end outer for */

    return(RET_OK);

} /* end dissolve instance */

/*****************************************************************************

    INVERT

        Inverts the raster within visible window instance.
        This routines supports instance zero windowing functions.

        Returns: Always returns RET_OK                                    */
```

```
invert(wn, inum)
    int wn, inum;

{


    register WINLIST *wnode;
    WININS  *pins;



    if((wnode = locate_window(wn)) != NULLP){

        if(inum == INSTANCE_ZERO){
            pins = NULLP;
            while(next_instance(wn, &pins) == RET_OK && pins != NULLP )
                invert_instance(wnode, pins);
        }

        else
            if(( pins = locate_instance(wn, inum)) != NULLP)
                invert_instance(wnode, pins);

    }

    return(RET_OK);


} /* end invert */


/*****************************************************************************
*
     INVERT WINDOW INSTANCE

         Invert the rasters within a window instance. i.e. put the top rasters
         at the bottom, and the bottom rasters at the top.

         Should only be called from invert().

         Returns: instance number if successful, otherwise ~instance number. */


invert_instance(wnode, pins)
     WINLIST *wnode;
     WININS *pins;

{

     register ADT *cst, *csb;
     int top, bot;


     if(wnode != NULLP && pins != NULLP){


         top = (pins->y < minrows || pins->y >= maxrows) ? minrows : pins->y;
         bot = (bot = top + wnode->y2 - 1) >= maxrows ? maxrows - 1 : bot;


         for( ; top < bot; top++, bot-- ){

             cst = (ADT [illegible] rn->a[top]);              /* funky, eh ? */
             csb = (ADT [illegible] rn->a[bot]);

             cst->vpras [illegible] .vpras;
             csb->vpras [illegible] .vpras;                   /* invert ras */
```

```
            cst->vpras [illegible] vpras;

            cst->vpcas [illegible] vpcas;
            csb->vpcas [illegible] vpcas;                    /* invert cas */
            cst->vpcas [illegible] vpcas;
        }

        return(pins->inum);

    }
    else
        return(~pins->inum);


} /* end invert window instance */


/*****************************************************************************
    OVERLAY

        Overlays a window instance onto the visible screen. The new shape
        seen is a composite of whatever windows were already there, and the
        new one. The new left window boundary is the smaller of the window
        open parameter being overwritten, and the new window open parameter.

        The new right window boundary is the larger of the two window close
        values.

        There is no instance on/ instance off parameter for overlay(). The
        instance is always turned on. Overlaying an instance has precedence
        over an instance which is off. The operation is equivalent to an
        instance move().

        Overlay supports instance zero.



*/


overlay(wn, in, x, y)
    int wn, in, x, y;


{       }



overlay_instance(pnode, pins, x, y)
    register WINLIST *pnode;
    register WININS *pins;
    int x, y;


{   return; }
```

```
/*****************************************************************************
*
*
*                    N e w   M e d i a   G r a p h i c s
*                    ----------------------------------
*
*                        V I D E O   W I N D O W S
*                        -------------------------
*
*
*       Module name:  VPOPR.C
*       Version:      1.00
*       Revision:     0
*       Date:         Feb-88
*       *                                    *
*       Author:       R. Tricca                                    *
*                                                                  *
*
*
*****************************************************************************/


#include <vwinc.h> #include <stdio.h> #include <atmplts.h> #include <define.h>
#include
 <cstruct.h>


#ifdef HDRCHK

    #include "vwmodhdr.h"

#endif


    IMPORT unsigned minrows, maxrows, mincols, maxcols;
    IMPORT vpmax;
    IMPORT BDT *curscrn;


    IMPORT VPLIST *vpfront;


/*****************************************************************************
    ADD VIEWPORT NODE

    Add a new node to a list of nodes.

        Scan linked list of nodes, if we don't find a matching node
        number, create a new node and insert it into the list; create a
        data buffer and point to it.

        Viewport numbering begins at one. Viewport zero is illegal.

        Returns: If successful, pointer to new node,
                 otherwise null pointer                                  */



VPLIST *addvpn(nodename)
    int nodename;

{


    register VPLIST *pnode;
    register char *pbuf;
```

```
    if((nodename > 0) && locate_vp(nodename) == NULLP ){

        if(( pbuf = malloc( sizeof(BDT))) != NULLP ){

            if(( pnode = (VPLIST *)malloc( sizeof(VPLIST))) != NULLP ){

                pnode->num = nodename ;              /* stuff new node   */
                pnode->status = NULL ;
                pnode->pvp = (BDT *)pbuf ;

                pnode->next = vpfront ;              /* link in new node */
                vpfront = pnode;

                return(pnode);                    /* return address of node */

            } /* end inner if */

            else
                free((char *)pbuf);               /* release viewport buffer */


        } /* end middle if */

    } /* end outer if */


    return( (VPLIST *)NULLP );  /* either no heap or viewport already defined *\
/



} /* end addvpn */

/*****************************************************************************
    DELETE NODE

        Delete a viewport node from the linked list.

        Scan linked list of viewport nodes, if we find matching vp number
        remove node from the list and return its memory back to the heap

        Returns: The node number deleted if successful.
                 Otherwise ~node number                                    */


delvpn(vn)
    int vn; {


    register VPLIST *pv, *prv;
    BOOLEAN r;



    if((prv = pv = vpfront) != NULLP){

        while((r = pv->num != vn) && (pv->next != NULLP)){
            prv = pv ;
            pv = pv->next ;
        }

        if(!r){                                   /* !r means we found a match */
            if(pv->pvp != NULLP){
                free((char *)pv->pvp);            /* release viewport buffer */
                pv->pvp = NULLP;
            }

            if(pv == vpfront)
                vpfront = pv->next;
            else
                prv->next = pv->next ;
```

```
            free((char *)pv);                /* release viewport node   */

            return(vn);

        } /* end inner if */

    } /* end outer if */

    return(~vn);

} /* end delete viewport node */

/*****************************************************************************
    LOCATE VIEWPORT
            This routine returns the address of the selected viewport node.

            Each viewport is assigned a name by the user when created.

            Returns: A pointer to the node containing the vp if successful
                     otherwise a null pointer                                 */


VPLIST *locate_vp(vp)
    int vp;                  /* vp number */

{


    register VPLIST *pv;
    BOOLEAN r;



    if( (pv = vpfront) != NULLP ){
        while(( r = pv->num != vp ) && ( pv = pv->next ) != NULLP );

        if( !r )
            return( pv );
    }

    return( (VPLIST *)NULLP );


} /* end locate_vp */




/*****************************************************************************
    REPORT VIEWPORT NODE

        This routines builds an informational packet about the viewport node
        selected and sends the info back to the PC.


    Returns: RET_OK
             ~RET_OK

*/


vpreport(vpn)
    unsigned vpn;

{


    register REPORT *p;
    register VPLIST *pv;
    VPLIST *pvl;
```

```
    unsignec s, r;


    if((p = (REPORT *)malloc(sizeof(REPORT))) != NULLP){

        if((pv = locate_vp(vpn)) != NULLP){

            p->vr.vn        = vpn;
            p->vr.status    = 0;
            p->vr.x1        = Fn2_cas(r = pv->pvp->a[0].vpcas);
            p->vr.y1        = pv->pvp->a[0].vpras + ((r & RASMSB) << 8);
        }


        p->vr.vpdefined = 0;
        pvl = vpfront;


        while(pvl != NULLP){
            p->vr.vpdefined++;
            pvl = pvl->next;
        }

        xfr_data((char far *)p, sizeof(REPORT), SENDATA, TRUE);
        free((char *)p);
        return(RET_OK);

    }

    else

        return(~RET_OK);


} /* end viewport report */




/*****************************************************************************
    CLOSE ALL VIEWPORTS

        Close down every viewport in the system. Return all memory deallocated
        back to the heap.


        Returns: The number of viewports which were closed. */


vpcloseall()

{

    register VPLIST *pv;

    register vpclosed;


    vpclosed = 0;

    while((pv = vpfront) != NULLP)
        vpclosed = (close_vp(pv->num) == pv->num) ? vpclosed++ : vpclosed;

    return(vpclosed);

} /* end vpcloseall */
```

```
/*****************************************************************************
    CLOSE VIEWPORT
        Close a viewport definition.

        Returns:    if successful, the viewport number closed,
                    otherwise, ~vp                                          */


close_vp(vp)
    int vp;

{

        return(delvpn(vp));


} /* end close viewport */


/*****************************************************************************
    VPTODL
        Copies the viewport selected to the current working display list.
        Windowing information within the display list is left undisturbed.

        The VP must already exist.


        Returns: viewport number(vn) passed in, if successful,
                 otherwise ~vn (no heap or vp already exits)                */


vptodl(vn)
    int vn;

{

    register ADT *csrc, *cdes;

    VPLIST *node;

    int i, j;


    if((node = locate_vp(vn)) != (VPLIST *)NULLP)

        if(curscrn != NULLP){

            for(i = minrows; i <= vpmax /* maxrows */; i++){

                csrc = (ADT *)(&node->pvp->a[i]);
                cdes = (ADT *)(&curscrn->a[i]);

                j = cdes->vpcas & VIDEO_ON; /* get destination window status */

                cdes->vpras = csrc->vpras;
                cdes->vpcas = csrc->vpcas & ~VIDEO_ON | j;

            }

            return(vn);
        }


    return(~vn);


} /* end vptodl */
```

```
/*****************************************************************************

    MAKE_VP

        Make viewport unpacks and converts the viewport size and location
        parameters to the values required by genscan, then calls genscan
        to create the viewport ras and cas address map, which is then fed
        to the video hardware via the video dma channel.

        It tries its hardest to insure the viewport endpoints are valid,
        and if they aren't, attempts to validate them.

        Returns: number of scan lines generated
                 or
                 ~RET_OK
*/


make_vp(name, x, y)
    unsigned name, x, y;

{

    IMPORT alg, vidcols;
    unsigned n;

    register VPLIST *vnode;


    if((vnode = addvpn(name)) != NULLP){

        x = (x > vidcols - 1) ? 0 : x;

        y = (y > (n = whatis_vactive()) ? 0 : y);

        return(genscan(vnode->pvp, x, y, alg));

    }

    return(~RET_OK);


} /* end make viewport */

/*****************************************************************************
    MOVE_VP

        Move a block of viewport rasters. This function moves the block of
        rasters currently loaded onto the build screen to the new des_x1,
        des_y1 position indicated. The viewport is moved starting at the first
        defined viewport address.

        This function physically moves a section of the ras/cas map to
        another area in the viewport. The result is that the same exact video
        image piece will be displayed at two different locations on the screen


        Only the viewport moves, windows stay where they are.

        Returns: RET_OK if successful
                 or
                 ~RET_OK on failure                                        */


move_vp(src_y1, des_y1, count)
    unsigned src_y1, des_y1, count;
```

```
{

    register ADT *css, *csd;
    int i, j, k, m, n, ras;

    BOOLEAN flag;


    if(src_y1 >= minrows && src_y1 <= maxrows
        && des_y1 >= minrows && des_y1 <= maxrows)

        if(count > 0 && count < (maxrows - minrows)){

            j = (des_y1 + count) > maxrows + 1 ? maxrows - des_y1 + 1 : count;
            k = (src_y1 + count) > maxrows + 1 ? maxrows - src_y1 + 1 : count;

            count = (k <= j) ? k : j;


            flag  = (src_y1 < des_y1);

            m = src_y1 + count - 1;
            n = des_y1 + count - 1;



            for(i = 0; i < count; i++){

                if(flag){
                    css = (ADT *)(&curscrn->a[m - i]);
                    csd = (ADT *)(&curscrn->a[n - i]);
                }
                else{
                    css = (ADT *)(&curscrn->a[i + src_y1]);
                    csd = (ADT *)(&curscrn->a[i + des_y1]);
                }

                j = csd->vpcas & VIDEO_ON ; /* get destination window status */

                csd->vpras = css->vpras;
                csd->vpcas = (css->vpcas & ~VIDEO_ON) | j;


            } /* end inner for */



            return(RET_OK);


        } /* end inner if */


    return(~RET_OK);

} /* end move viewport block */

/*****************************************************************************
    PAN_SEG

        This function pans a section of the viewport through the window in
        any direction.

        Panning distance is not limited to the size of the current graphics
        mode. It is valid for the complete NTSC source. All rows and columns
        can be panned through.
```

```
        Only the contents of the viewport change. The window remains fixed
        in place.

        Returns:    RET_OK
                    ~RET_OK
*/


pan_seg(mode, dir, dist, speed, y1_ras, num)
    int mode, dir, dist, speed, y1_ras, num;

{


    IMPORT BDT *dspscrn;
    IMPORT vpmin, vpmax;

    VPLIST *pnode;
    register ADT *pel;
    register i;
    BDT *screen;


    int j, incr, n, cas, ras, abs_incr;
    unsigned stat, s;

    int vs;


        if(mode == D_LIST)
            screen = dspscrn;           /* pan the current build screen */

        else
            if((pnode = locate_vp(mode)) != NULLP )
                screen = pnode->pvp;    /* pan a viewport definition    */

        else
            return(~RET_OK);            /* don't know what to pan       */

         switch(dir){

             case RIGHT: incr = -VRES;
                         break;

             case UP:    incr = 1;
                         break;

             case DOWN:  incr = -1;
                         break;

             default:    incr = VRES;
                         break;
         }

         vs = whatis_vactive();          /* get number of active video lines */


         if(dir == RIGHT || dir == LEFT)
             dist=dist < MAXACO_COLS ? (dist/VRES)*VRES :(MAXACO_COLS/VRES)*VRES
;

         else{
             dist = (dist > 0 && dist <= vs) ? dist : vs;
             speed = (speed < NOWAIT || speed == 0) ? NOWAIT : speed / 500;
         }

                                         /* if we can't see it, don't wait */
         if(dspscrn != screen || speed > SLOW || speed < NOWAIT){
             speed = NOWAIT;
             incr = incr < 0 ? -dist : dist;
         }


         abs_incr = incr < 0 ? -incr : incr;
```

```
for(j = 0; j < dist; j += abs_incr ){

    for(s = 0; s < speed; s++);

    if((n = num + y1_ras) > maxrows)
        n = maxrows;

    for(i = y1_ras; i < n; i++){

        pel = (ADT *)(&screen->a[i]); /* Crank this baby up to full
                                         speed */

        switch(dir){

            case LEFT:
            case RIGHT:
                cas = Fn2_cas(stat = pel->vpcas);
                stat &= ~CASMASK;

                if((cas+=incr) >= (int)mincols && cas < (int)maxcols);

                else
                    cas = (cas < (int)mincols) ? maxcols - 1 : mincols;

                pel->vpcas = Fn1_cas(cas) | stat;

                break;

            case UP:
            case DOWN:
                stat = ((cas = pel->vpcas) & RASMSB) << 8;
                ras = pel->vpras + stat;

                if((ras += incr) >= (int)vpmin && ras < (int)vs);

                else
                    ras = (ras < (int)vpmin) ? vs - 1 : vpmin;

                cas &= ~RASMSB;
                cas |= (ras >> 8) & RASMSB;
                pel->vpcas = cas;
                pel->vpras = ras;

                break;


            default:

                break;


        } /* end switch */


    } /* end inner for */


} /* end outer for */


return(RET_OK);


} /* end pan_seg() */
```

```
/*****************************************************************************
    GETRAS_VP

        Get a specified dlist viewport ras. Do as quickly as possible.

        Returns: raster value

        P.S. There's no error checking, don't make any mistakes */


getras_vp(row)
    unsigned row;

{

    register ADT *cst;


        cst = (ADT *)(&curscrn->a[row]);

        return(FnZ_ras(cst->vpcas, cst->vpras));


} /* end getras */

/*****************************************************************************
    SETRAS_VP

        Force a specified dlist viewport ras to a specific value.

        Returns: If all's well RET_OK

        P.S. There's no error checking, don't make any mistakes

*/


setras_vp(row, ras)
    unsigned row, ras;

{

    register ADT *cst;
    unsigned cas;


        cst = (ADT *)(&curscrn->a[row]);

        cas = cst->vpcas;
        cas &= ~RASMSB;
        cas |= (ras >> 8) & RASMSB;

        cst->vpcas = cas;
        cst->vpras = ras;


        return(RET_OK);


} /* end setras_vp */
```

```
/*****************************************************************************
    EXCHANGE
        Exchange blocks of viewport rasters. This function exchanges raster
        blocks defined on the current build screen, not the viewport
        definition rasters. Windows stay where they are.

        The blocks may intersect each other.

        Returns: RET_OK if successful
                 or
                 ~RET_OK on failure                                        */



exchange(src_y1, des_y1, count)
    unsigned src_y1, des_y1, count;

{

    register ADT *cst, *csb;

    int i, j, k;


    if(src_y1 >= minrows && src_y1 < maxrows
        && des_y1 >= minrows && des_y1 < maxrows)

        if(count > 0 && count < (maxrows - minrows)){

            if(src_y1 > des_y1){     /* force src to be < des     */
                src_y1 ^= des_y1;    /* reduces bounds checking   */
                des_y1 ^= src_y1;
                src_y1 ^= des_y1;
            }

            count = (src_y1 + count <= des_y1) ? count : des_y1 - src_y1;

            count = (des_y1 + count) > maxrows ? maxrows - des_y1 : count;


            for(i = 0; i < count; i++){

                cst = (ADT *)(&curscrn->a[i + src_y1]);
                csb = (ADT *)(&curscrn->a[i + des_y1]);

                j = cst->vpcas & VIDEO_ON;  /* extract window on/off info */
                k = csb->vpcas & VIDEO_ON;

                cst->vpcas &= ~VIDEO_ON;    /* shut of window rasters     */
                csb->vpcas &= ~VIDEO_ON;

                cst->vpras ^= csb->vpras;   /* exchange ras info          */
                csb->vpras ^= cst->vpras;
                cst->vpras ^= csb->vpras;

                cst->vpcas ^= csb->vpcas;   /* exchange cas info          */
                csb->vpcas ^= cst->vpcas;
                cst->vpcas ^= csb->vpcas;

                cst->vpcas |= j;            /* update window on/off mode  */
                csb->vpcas |= k;


            } /* end inner for */

            return(RET_OK);
```

```
        }/* end inner if */

    return(~RET_OK);

} /* end exchange */

/*****************************************************************************
    EXTRACT
        Extract all viewport information from the current build screen and
        create a new viewport with it. This viewport is then added to the
        list of viewports, and is exactly equivalent to any other viewport.

        Returns: RET_OK if successful
                 or
                 ~RET_OK on failure                                          */
- -



extract(vp)
    int vp;     /* number of viewport we want created */

{

    VPLIST *new_vp;
    int i;


    if((new_vp = addvpn(vp)) != NULLP){

        for(i = 0; i < MAXROWS; i++){

            new_vp->pvp->a[i].vpras = curscrn->a[i].vpras;
            new_vp->pvp->a[i].vpcas = curscrn->a[i].vpcas & ~VIDEO_ON;

        } /* end for */

        return(RET_OK);

    }

    return(~RET_OK);


} /* end extract */

/*****************************************************************************

    The baseline functions listed below are special cases of the viewport
    functions. Since I don't want the code littered with exceptions, they
    get there own little section here.                                      */


    static BDT *base_view = NULLP;  /* only est_basline(), rst_baseline &&
                                       del_baseline() need to know about this *
/


/*****************************************************************************
    ESTABLISH BASELINE VIEWPORT

        This routine creates a baseline viewport from the currently
        displayed display list, to which the user can return at any time.
```

```
        Returns: RET_OK if base viewport (re)established
                 else
                  ~RET_OK
*/


est_baseline() {

    IMPORT BDT *dspscrn;


        if(dspscrn != NULLP){

            if(base_view == NULLP){

                if((base_view = (BDT *)malloc( sizeof(BDT))) == NULLP)
                    return(~RET_OK);

            }

            memcpy( (char *)base_view, (char *)dspscrn, sizeof(BDT) );
            return(RET_OK);

        }
        else
            return(~RET_OK);



} /* end est_baseline */


/*****************************************************************************
    RESTORE BASELINE

        This routine copies the baseline viewport, if it exists, to the
        currently displayed dlist.

        Returns: RET_OK if copy operation succeeded
                 else
                  ~RET_OK
*/


rst_baseline() {

    IMPORT BDT *dspscrn;


        if(base_view != NULLP && dspscrn != NULLP){
            memcpy( (char *)dspscrn, (char *)base_view, sizeof(BDT) );
            return(RET_OK);
        }
        else
            return(~RET_OK);


} /* end restore baseline */


/*****************************************************************************
    DELETE BASELINE

        This routine returns the memory reserved for baseline viewport
        back to the system.
```

```
        Returns: RET_OK
                 ~RET_OK

*/


del_baseline()

{


    if(base_view != NULLP){
        free((char *)base_view);            /* release baseline buffer  */
        base_view = NULLP;                  /* wipe this baby out       */
        return(RET_OK);
    }

    else
        return(~RET_OK);


} /* end del_baseline */




/*************************************************************************
*                                                                        *
*                                                                        *
*                                                                        *
*                  N e w   M e d i a   G r a p h i c s                   *
*                  ----------------------------------                    *
*                                                                        *
*                      V I D E O   W I N D O W S                         *
*                      -------------------------                         *
*                                                                        *
*                                                                        *
*       Module name: FORMAT.C                                            *
*       Version:     1.00                                                *
*       Revision:    0                                                   *
*       Date:        MAY-89                                              *
*       *                                  *
*       Author:      R. Tricca                                           *
                                                          *
*                                                                        *
*                                                                        *
*************************************************************************/


#include <stdio.h> #include <vwinc.h> #include <atmplts.h> #include <dma_def.h>
 #include
<ioport.h> #include <define.h> #include <cstruct.h> #include "common.h"


#ifdef HDRCHK

    #include "vwmodhdr.h"

#endif


    IMPORT IO_MAP iomap;
    IMPORT CMNDBUF *cmndbuf;
    IMPORT unsigned minrows, maxrows, mincols, maxcols;
```

```
/*****************************************************************************
    COMMAND REFORMAT

        This function converts a structure of type CMNDBUF to one of type
        CMACBUF. Doing this strips the now unecessary checksum and status
        information off the packet and adds a pointer which is necessary if
        the command is to be executed in macro mode. Execmnd() is only
        expected to eat packets of the converted type.

        Since it is unwise to assume the buffer structures are identical,
        we must copy each element by hand, rather than using a buffer copy
        operation.

        It would be undesirable.


        Returns: If successful, a pointer to the new packet
                 else a NULL pointer.                                        */



CMACBUF *cmndrefmt(cbuf)
    register CMNDBUF *cbuf;

{

    static CMACBUF buf = { 0 };

    register CMACBUF *pbuf;


    if(cbuf != NULLP){

        pbuf = &buf;
        pbuf->command = cbuf->command;

        pbuf->params[0] = cbuf->params[0];
        pbuf->params[1] = cbuf->params[1];
        pbuf->params[2] = cbuf->params[2];
        pbuf->params[3] = cbuf->params[3];

        pbuf->params[4] = cbuf->params[4];
        pbuf->params[5] = cbuf->params[5];
        pbuf->params[6] = cbuf->params[6];
        pbuf->params[7] = cbuf->params[7];

        pbuf->next = NULLP;

        return(&buf);   /* Conversion always done into this static buffer */
    }

    else
        return(NULLP);



} /* end command reformat */

/*****************************************************************************
    DISPLAY LIST ENCODE

        Convert VW format display list definition to PC format.

        Returns: RET_OK if all went well,
                 else
                  ~RET_OK
*/
```

```
dl_encode(sbuf, dbuf)
    register DLT  *sbuf;
    register UDLT *dbuf;

{

    int i, cas;                         /* ras = y      cas = x */


    if(sbuf != NULLP && dbuf != NULLP){

        for(i = 0; i < MAXROWS; i++){

            dbuf->dl[i].win_on = sbuf->a[i].win_on * WINRES;
            dbuf->dl[i].win_off= sbuf->a[i].win_off* WINRES;

            cas = sbuf->a[i].vpcas;
            dbuf->dl[i].vpcas = Fn2_cas(cas);
            dbuf->dl[i].vpras = ((cas & 1) << 8) | sbuf->a[i].vpras;

        }

        return(RET_OK);

    }

    else
        return(~RET_OK);


} /* end display list encoc  :

/*****************************************************************************
    DISPLAY LIST DECODE

        Convert PC format display list to VW format.

        Returns: RET_OK if all went well,
                 else
                  ~RET_OK
*/



dl_decode(sbuf, dbuf)
    register UDLT *sbuf;
    register DLT  *dbuf;

{

    int i, v, ras, cas;                 /* ras = y      cas = x */


    if(sbuf != NULLP && dbuf != NULLP){

        for(i = 0; i < MAXROWS; i++){

            dbuf->a[i].win_on = (v = sbuf->dl[i].win_on) != 0 ? v / WINRES : 0;
            dbuf->a[i].win_off= (v = sbuf->dl[i].win_off) != 0 ? v / WINRES : 0
;

                                /* Some intermediates will speed things up */
            ras = sbuf->dl[i].vpras;
            cas = sbuf->dl[i].vpcas;

                        /* frce col. resolution to be grps of VRES pixels   */
                        /* cnvert the 6 col. bits to middle 6 of 8 bits     */
            cas = Fn1_cas(cas);
```

```
            dbuf->a[i].vpras = (UBYTE)ras;
            dbuf->a[i].vpcas = (cas != ((ras >> 8 & RASMSB) & ~VIDEO_ON));
        }

        return(RET_OK);

    }

    else
        return(~RET_OK);

} /* end display list decode */

/*****************************************************************************
    VIEWPORT ENCODE

        Convert VW format viewport definition to PC format.

        Returns: RET_OK if all went well,
                 else
                  ~RET_OK                                                    */



vp_encode(sbuf, dbuf)
    register BDT *sbuf;
    register VB *dbuf;

{

    int i, cas;                         /* ras = y      cas = x */


    if(sbuf != NULLP && dbuf != NULLP){

        for(i = 0; i < MAXROWS; i++){
            cas = sbuf->a[i].vpcas;

            dbuf->v[i].x = Fn2_cas(cas);
            dbuf->v[i].y = ((cas & 1) << 8) | sbuf->a[i].vpras;

        }

        return(RET_OK);

    }

    else
        return(~RET_OK);


} /* end viewport encode */

/*****************************************************************************
    VIEWPORT DECODE

        Convert PC format viewport definition to VW format

        Returns: RET_OK if all went well,
                 else
                  ~RET_OK                                                    */


vp_decode(sbuf, dbuf)
    register VB *sbuf;
    register BDT *dbuf;
```

```
{
    int i, ras, cas;            /* ras = y      cas = x */

    if(sbuf != NULLP && dbuf != NULLP){

        for(i = 0; i < MAXROWS; i++){

            ras = sbuf->v[i].y; /* Some intermediates will speed things up  */
            cas = sbuf->v[i].x;

                        /* frce col. resolution to be grps of VRES pixels   */
                        /* cnvert the 6 col. bits to middle 6 of 8 bits     */

            cas = Fn1_cas(cas);

            dbuf->a[i].vpras = (UBYTE)ras;
            dbuf->a[i].vpcas = (cas != ((ras >> 8 & RASMSB) & ~VIDEO_ON));

        }

        return(RET_OK);

    }

    else
        return(~RET_OK);


} /* end viewport decode */



/*****************************************************************************
    WINDOW ENCODE

        Convert VW format window definition to PC format

        Returns: RET_OK if all went well,
                 else
                  ~RET_OK                                                    */


win_encode(sbuf, dbuf)
    register WINBUF *sbuf;
    register WB *dbuf;

{
    int i ;


    if(sbuf != NULLP && dbuf != NULLP){

        for( i = 0; i < MAXROWS; i++){

            dbuf->w[i].start = sbuf->w[i].wstart * WINRES;
            dbuf->w[i].end   = sbuf->w[i].wend   * WINRES;
        }

        return(RET_OK);

    }

    else
        return(~RET_OK);


} /* end window encode */
```

```
/*************************************************************************
    WINDOW DECODE

        Convert PC format window definition to VW format

        Returns: RET_OK if all went well,
                 else
                  ~RET_OK                                                 */


win_decode(sbuf, dbuf)
    register WB *sbuf;
    register WINBUF *dbuf;

{
    int i, v;


    if(sbuf != NULLP && dbuf != NULLP){

        for(i = 0; i < MAXROWS; i++){

            dbuf->w[i].wstart = (v = sbuf->w[i].start) != 0 ? v / WINRES : 0;
            dbuf->w[i].wend   = (v = sbuf->w[i].end) != 0 ? v / WINRES : 0;

        }

        return(RET_OK);
    }

    else
        return(~RET_OK);


} /* end window decode */


/*************************************************************************
    MACRO ENCODE

        Convert VW format macro definition to PC format


        Returns: As usual, RET_OK
                           ~RET_OK
*/



macro_encode(sbuf, dbuf)
    register MACRONODE *sbuf;
    register SMACNODE  *dbuf;

{


    IMPORT MACRONODE *mlfront;
    CMACBUF *pmc;

    int i;


    if(sbuf != NULLP && dbuf != NULLP){

        memcpy((char *)&(dbuf->mac), (char *)sbuf, sizeof(MACRONODE));
```

```
        dbuf->mac.clist = NULLP;
        dbuf->mac.next  = NULLP;

        for(i = 0, pmc = sbuf->clist; pmc != NULLP && i < sbuf->ccount; i++){

            memcpy((char *)&(dbuf->cmnd[i]), (char *)pmc, sizeof(CMACBUF));
            dbuf->cmnd[i].next = NULLP;
            pmc = pmc->next;
        }


        return(RET_OK);

    }

    return(~RET_OK);


} /* end macro_encode */


/*****************************************************************************
    MACRO DECODE

        Convert PC format macro definition to VW format


        Returns: As usual, RET_OK
                           ~RET_OK
*/



macro_decode(sbuf, dbuf, newmac)
    register SMACNODE  *sbuf;
    register MACRONODE *dbuf;
    unsigned newmac;

{


    IMPORT MACRONODE *mlfront;

    MACRONODE *tmp;
    int i, n, mnum;


    if(sbuf != NULLP && dbuf != NULLP){

        if(locate_macro(newmac) != NULLP){

            if((n = sbuf->mac.ccount) < MAXMCMND){

                tmp->next = dbuf->next;
                memcpy((char *)dbuf, (char *)&(sbuf->mac), sizeof(MACRONODE));
                dbuf->mnum = mnum = newmac; /* overwrite w/passed in value */
                dbuf->next = tmp->next;

                for(i = 0; i < n; i++){
                    if(append_mcmnd(mnum, &(sbuf->cmnd[i])) == ~RET_OK){
                        delmacro(mnum);
                        return(~RET_OK);
                    }

                }

                return(RET_OK);
            }
```

```
        }

    }

    return(~RET_OK);

} /* end macro_decode */


/*****************************************************************************
    PRTOFB
        Convert (Pixel, Raster) to Frame Buffer address

        This function takes as parameters a pixel value from 0 to MAXCOLS,
        and a raster value from 0 to MAXROWS. It converts this format to
        a frame buffer pixel address and partition number.

        There are 16 partitions. Each partition contains the pixel data for
        a contiguous block of 32 raster lines.
        Partitions are numbered 0 - 15, rasters are numbered 0 - 31

        The frame buffer ram is organized as groups of three valid pixel
        locations followed by an invalid location. The algorithm below takes
        this into account by shifting the 4'th pixel into the 5'th ram location


        Returns: RET_OK, frame buffer address and partition value set.
                 PARM_ERR if error in pixel or raster value                 */


prtofb(pix, ras, fba, partition)
    unsigned pix, ras;
    register unsigned *fba, *partition;

{

    if(pix >= MINCOLS && pix < MAXACQ_COLS
        && ras >= MINROWS && ras < MAXROWS){

        *partition = ras / RASTERS_PER_PARTITION;
        *fba = (ras & MASKSL) * 1024 + pix;

        return(RET_OK);

    }

    else
        return(PARM_ERR);

} /* end prtofb */
```

```
/*****************************************************************************
*                                                                            *
*                                                                            *
*                                                                            *
```

```
    freeze();        /* We must be in a deep freeze to R/W the frame buffer */

    for(i = 0; i < 480; i++){

        prtofb(0, i, &fba, &partition);

        select_partition(partition); /* select a frame buffer partition */

        p = (PIXGRP (far *))(pfrmbuf + fba);

        if( (char)(p->rylsb.luma & 1) == 1 )     /* sync ok on this line */
            map[i] = 'R';

        else
            if( (char)(p->bylsb.luma & 1) == 1 ){
                map[i] = '_';

                for(k = 0; k < 1024; k++){
                    p->bylsb.luma |= 1;

                    c = p->bylsb.chroma;
                    p->bylsb.chroma = p->rylsb.chroma;
                    p->rylsb.chroma = c;

                    c = p->bymsb.chroma;
                    p->bymsb.chroma = p->rymsb.chroma;
                    p->rymsb.chroma = c;

                    ++p;

                }

            }

    }


} /* end mapsync */

/*****************************************************************************/

mapsync()

{

    IMPORT unsigned far *pfrmbuf;

    PIXGRP (far *p);
    unsigned char *map;
    register unsigned i;
    unsigned fba, partition;


    map = malloc(1024);


    freeze();        /* We must be in a deep freeze to R/W the frame buffer */

    for(i = 0; i < 480; i++){

        prtofb(0, i, &fba, &partition);

        select_partition(partition); /* select a frame buffer partition */

        p = (PIXGRP (far *))(pfrmbuf + fba);
```

```
        if( (char)(p->rylsb.luma & 1) == 1 )
            map[i] = 'R';
        else
            if( (char)(p->bylsb.luma & 1) == 1 )
                map[i] = '_';
        else
            if( (char)(p->rymsb.luma & 1) == 1 )
                map[i] = 'r';
        else
            if( (char)(p->bylsb.luma & 1) == 1 )
                map[i] = 'b';

    }


} /* end xmapsync */



/*****************************************************************************
    Frame buffer memory test

        This test writes/ reads/ verifys all valid locations within the video
        frame buffer.

        Input:  a test pattern to write to the memory

        Returns: The absolute address + 1 of the first byte which has failed
                 else null pointer, indicating all locations passed
*/


#define PX 16    /* number of partitions to test */


unsigned far *fbmemtest(ptn, pattern)
    unsigned ptn, pattern;

{


    IMPORT unsigned far *pfrmbuf;


    register unsigned i, k;

    unsigned fba, partition, m, n, readback;


    freeze();        /* We must be in a deep freeze to R/W the frame buffer */

    pattern |= 0xf000;

    if(ptn < NUM_PARTITIONS)
        m = n = ptn;

    else{
        m = 0;
        n = NUM_PARTITIONS - 1;
    }

    for(; m <= n; m++){

        select_partition(m);        /* select a frame buffer partition */

        for(k = 0; k < RASTERS_PER_PARTITION; k++){
```

```
            for(i = 0; i < MAXCOLS; i++){
                prtofb(i, k, &fba, &partition);
                *(pfrmbuf + fba) = pattern;

            /*  if((readback = *(pfrmbuf + fba) | 0xf000) != pattern)
                    return(pfrmbuf + fba + 1); */
            }

        }

    }


    return((unsigned far *)NULLP);


} /* end fbmemtest */

/*****************************************************************************
    Frame buffer fill */


long fbfill()


{


    IMPORT IO_MAP iomap ;
    IMPORT unsigned far *pfrmbuf;

    register unsigned i, j, m;

    PIXEL pix;

    unsigned row, k, count, chroma;
    unsigned fba, partition;


    freeze();        /* We must be in a deep freeze to R/W the frame buffer */


    pix.luma = 60;

    for(k = 0; k < 15; k++ ){                    /* partition */

        select_partition(k);

        for(m = 0; m < 32; m++){                 /* row in partition */

            row = k * 32 + m;

            for(i = 0; i < 768; i += 4){         /* pixel */

                if((k & 1) == 0)
                    for(j = 0; j < 4; j++){

                        pix.luma = (j == 0 || j == 1) ? 0xff : 0;
                        prtofb(i + j, row, &fba, &partition);
                        *(pfrmbuf + fba) = *((unsigned *)&pix);
                    }
                else
                    for(j = 0; j < 4; j++){

                        pix.chroma = (j == 4) ? 0 : 0;
                        prtofb(i + j, row, &fba, &partition);
                        *(pfrmbuf + fba) = *((unsigned *)&pix);
                    }

            }
```

```
        }

    } /* end outer for */

    return;

} /* end fbfill */



    #define SHFT 4

/*************************************************************************
    PUTXIO
        This function writes the specified value to the output port
        selected. It performs the write after first masking the valid data
        bits for this particular IO address and then combining this new
        value with the current value of the data. The code will handle the
        case of all data mask bits being clear( i.e it will only loop 8 times)

        All routines which perform any type of I/O to the devices on the
        windows board should use this routine instead of the standard outp() */


putxio(ldev, val)
    int ldev;
    register unsigned val;

{

    IMPORT siziodev;
    IMPORT unsigned (*iocval)[];
    IMPORT IODEV iodevice[];


    register unsigned bitmask;
    int i, index, device;
    unsigned cval, mask;



                                            /* make sure device is legal */
    if(ldev < siziodev && iodevice[ldev].rwflag == WRITE){

                                            /* logical to physcl convrsn */
        device = index = iodevice[ldev].physadr;

        cval = (*iocval)[index >>= SHFT];

        bitmask = mask = iodevice[ldev].mask;

        for(i = 0; i < 8 && ((bitmask & 1) != 1); i++)
            bitmask >>= 1;


        if(i < 8){
            val <<= i;
            val  &= mask;                   /* mask in new value      */
            cval &= ~mask;                  /* mask out old value     */

            (*iocval)[index] = (cval != val);

            return(outp(device, (*iocval)[index]));
```

```
        }

    } /* end if/else */

    return(~val);

} /* end putxio */

/*****************************************************************************
    GETXIO

        This function READS the specified value from the input port
        selected. After performing the read, it masks out all data bits
        which are not significant and then right justifies the result.

        If the port is write only, the value returned is from the port shadow
        table, and will be the last value WRITTEN to the port.

        All routines which perform any type of I/O to the devices on the
        windows board should use this routine instead of the standard outp()

        Failure to do so will result in BIZZAAAHHHH system behavior !

        And lastly, a read only register cannot be written


        Returns: val.
                 There is no error return                                  */


getxio(ldev)
    int ldev;

{

    IMPORT siziodev;
    IMPORT IODEV iodevice[];
    IMPORT unsigned (*iocva[][];

    register i;
    register bitmask;
    unsigned val;

                                            /* make sure device is legal */

    if(ldev < siziodev &&  [illegible]  >= 0){

        if(iodevice[ldev].[illegible] == READ)
            val = inp(iod[illegible][ldev].physadr);

        else
            val = (*iocva[illegible] [illegible]evice[ldev].physadr >> SHFT)];


        val &= (bitmask = [illegible]ice[ldev].mask);

        for(i = 0; i < 8 && ((bitmask & 1) != 1); i++)
            bitmask >>= 1;

        return(val >> i);

    }

    return(~RET_OK);


} /* end getxio */
```

```
/*****************************************************************************
    WRITE_IM

        Write any WRITABLE IM register

        The parameter list contains a MASK to mask out all other fields,
        a VALUE to set the field to, and of course, the IM address to operate
        on. The value to write is aligned under the mask.

        Masks are defined as manifest constants for the more popular addresses,
        otherwise, you're on your on.

        Returns: value written if successful, otherwise ~value */


write_im(adr, wmask, val, update)
    unsigned adr, wmask, val;
    BOOLEAN update;

{

    IMPORT IMTB imtable;
    IMPORT USHORT (*shdwimt)[];
    IMPORT luma_shadow, saturation_shadow;

    unsigned bitmap, mask, comp, i;
    unsigned long lmask;


    if(adr > 255 || imtable.imreg[adr].r_w_flag == RDONLY)
        return(~val);

    else{
        bitmap = (imtable.imreg[adr].dsize == 1 ) ?  0xff : 0xffff;

        lmask = (mask = (wmask &= bitmap)) << 1;
        comp  = ~mask & (*shdwimt)[adr];

        while((((lmask >>= 1) & 1) == 0) && ((bitmap >>= 1) & 1)){

            mask >>= 1;
            val  <<= 1;

        } /* end while */


        val &= wmask;

        (*shdwimt)[adr] = (val != comp);     /* update the shadow table */

        if(adr != RGBCONTRAST && (adr < BRIGHTNESS || adr > BLUCUTOFF)){
            iwrite(adr, val);                /* send value out to imbus reg */


            if(adr == LUMINANCE)
                luma_shadow = read_im(LUMINANCE, LUMMSK);
            else
                if(adr == SATURATION)
                    saturation_shadow = read_im(SATURATION, SATMSK);

        }

        else
            if(update == VCU_UPDATE)
                vcutofb();       /* registers 16, 17, 18, 19 and 27 have to be
                                    sent to the CVPU through the frame buffer */


        return(val);
```

```
    } /* end if/else */


} /* end write_im */



/*****************************************************************************
    READ_IM

        Read ANY IM register field and RIGHT JUSTIFY THE VALUE
        If the mask parameter is all 'F's, the value read will not
        be right justified.

        The parameter list contains the IM address to read from, and
        a MASK to mask out all other fields within the register. If
        the register selected is write only, the value returned is from
        the shadow table.

        Returns: value read, otherwise
                 ~RET_OK  if IM bus addr selected > 255. Of course, this is a
                  legitimate value and might be indisernable from a valid value
! )
*/


read_im(adr, wmask)
    unsigned short adr, wmask;

{

    IMPORT IMTB imtable;
    IMPORT USHORT (*shdwimt)[];

    unsigned bitmap, comp, val, i;
    unsigned long lmask;


    if(adr < 255){

        if(imtable.imreg[adr].r_w_flag != WRONLY)
            (*shdwimt)[adr] = val = iread(adr);  /* read value from hdwr */
        else
            val = (*shdwimt)[adr];               /* write only, get from shdw */

        bitmap = (imtable.imreg[adr].dsize == 1) ?  0xff : 0xffff;
        lmask = (comp = bitmap & wmask) << 1;
        comp &= val;

        while((((lmask >>= 1) & 1) == 0) && ((bitmap >>= 1) & 1 ))
            comp >>= 1;

        return(comp);
    }

    else
        return(~RET_OK);


} /* end read_im */
```

```
/*****************************************************************************
    WRITE_HSP

        Write ram registers of the ccu's high speed processor

        Always returns RET_OK */


write_hsp(adr, val)
    unsigned adr, val;

{
    int i;


    write_im(HSP_WRITE_R34, 0xffff, adr, VCU_UPDATE);

    for(i = 0; i < 50; i++);     /* need 50 uS wait. This will do */

    write_im(HSP_DATA_R36, 0xffff, val, VCU_UPDATE);


    return(RET_OK);

} /* end write hsp */




/*****************************************************************************
    READ_HSP

        Read ram registers of the ccu's high speed processor

        Returns: value of the HSP register */

#define IMWRITE34 1      /* indicates an IM bus 34 write has occured          */
#define IMWRITE35 2      /* indicates an IM bus 35 write has occured          */
#define IMWRITE36 4      /* indicates HSP has written data into IM bus 36     */


read_hsp(adr)
    unsigned adr;

{
    unsigned i, stat, val;


    if(read_im(HSP_STATUS_R37, 0xffff) == 0){

        write_im(HSP_READ_R35, 0xffff, adr, VCU_UPDATE);

        for(i = 0; i < 50; i++);     /* need 50 uS wait. This will do */

        stat = read_im(HSP_STATUS_R37, 0xffff) &
                (IMWRITE34 | IMWRITE35 | IMWRITE36);

        if(stat == (IMWRITE35 | IMWRITE36))
            val = read_im(HSP_DATA_R36, 0xffff);

    }

    return(val);


} /* end read hsp */
```

```
/*****************************************************************************
    SHDWTOIMREG

        Rewrites all imbus shadow table values out to the imbus.
        Does not rewrite the HSP data.

        NO_VCU_UPDATE parameter tells system to only update the imbus shadow
        table. Transfer to the VCU of applicable registers is then done w/the
        vcutofb function. This little trick speeds up the update process since
        we don't repeatedly rebuild the VCU data tables.


        Returns: RET_OK;

*/


shdwtoimreg(mode)
    int mode;

{

    IMPORT USHORT (*shdwimt)[];

    unsigned i;
    int prvfrz;



    prvfrz = freeze();

    for(i = 0; i < IMB_ENTRIES;
        write_im(i, 0xffff, (unsigned)((*shdwimt)[i]), NO_VCU_UPDATE), i++);

    if(mode == VCU_UPDATE)
        vcutofb();/* Now that table is restored, update VCU in one fell swoop *
/


    if(prvfrz == UNFROZEN)              /* restore previous freeze state */
        unfreeze();

 } /* end shdwtoimreg */


 /*****************************************************************************
     WHATIS_GSTANDARD

         Read graphics hardware to determine the graphics standard we're
         connected to.

         Returns:    VGA || EGA

 */


 whatis_gstandard()

 {

     IMPORT graphics_mode;


     return(graphics_mode);

 } /* end whatis_gstandard */
```

```
/*************************************************************************
    WHATIS_VSTANDARD

        Read hardware to determine what the video standard is we're connected
        to.

        Returns:    NTSC or PAL
*/


whatis_vstandard()

{   return(getxio(L_VSTANDARD));    }


/*************************************************************************
    WHATIS_VACTIVE

    Return: The number of video lines being received, digitized and output
            which are valid.

*/

whatis_vactive()


    IMPORT int user_defined_vbias, sys_vbias;

    return(((whatis_vstandard() == PAL) ? PAL_ACTIVE : NTSC_ACTIVE)
             - user_defined_vbias - sys_vbias);

}


/*************************************************************************
    WHATIS_VPOSSIBLE

    Return: The number of video lines being received, digitized and output
            which are valid.

            This routine differs from the previous in that it bases the
            number of lines received upon the number which it is possible to
            recieve, not the number which are actually good.

*/

whatis_vpossible()

{

    IMPORT int user_defined_vbias, sys_vbias;

    return(((whatis_vstandard() == PAL) ? PAL_REAL : NTSC_REAL)
             - user_defined_vbias - sys_vbias);

}
```

```
/*****************************************************************************
    VTWEAK

        Does just what its name implies. Allows the user to add a programmable
        bias to the number of video lines received. All routines which use
        the whatis_vactive() routine to find out the active number of lines
        will be returned a number reflecting this fine tuning adjustment.

    Returns: The number of active lines, after the adjustment has been made. */


vtweak(nlines)
    int nlines;

{

    IMPORT int sys_vbias, user_defined_vbias;


    if((nlines <= sys_vbias) && (nlines >= sys_vbias * -1))
        user_defined_vbias = nlines;

    return(whatis_vactive());


} /* end tweak




/*****************************************************************************
    WHATIS_VFREQ

        Evaluate current video vertical frequency, i.e the raw vertical
        frequency which the DPU is seeing.

        From the ITT DPU manual, pg 28, (section on vertical syncronization)
        the formula for vertical frequency is given as:

                fV(vertical frequncy) = fM / 1024 * VP(vertical period) * 2

                where fM(NTSC)   = 14.31818 MHz
                      (PAL)      = 17.73448
                      (D2_MAC)= 20.25

                To speed up calculations the constants XXXX_CLOCK have
                already been divided by (1024 * 2).


        Returns: The current vertical frequency, for either NTSC, PAL or D2-MAC
*/


whatis_vfreq()

{

    int clockrate;


    switch(whatis_vstandard()){
```

```
        case PAL:
                clockrate = PAL_CLOCK;
                break;

        case D2_MAC:
                clockrate = D2_MAC_CLOCK;
                break;

        case NTSC:
        default:
                clockrate = NTSC_CLOCK;
                break;

    } /* end switch */


    return(clockrate / read_hsp(HSP_RAM_VP));    /* returns video vertical sync
                                                    frequency as seen by the DPU
                                                 */


} /* end eval_vfreq */




/*****************************************************************************
    FIXGAT
            FIX Graphics AT "n lines"

            Force graphics to be a number of lines LESS than what we
            calculate is the correct number
*/


fixgat(n)

{   return(RET_OK); }   /* Currently unsupported    */




/*****************************************************************************
    SETVDA

        Set graphics sync's and blanking polarities, to match the graphics
        boards.

        Returns: RET_OK
                else
                 ~RET_OK
*/


setvda(vmode)

    int vmode;

{

    switch (vmode){

        case EGA480:
        case EGA400:
```

```
        case EGA350:

        case VGA480:
        case VGA400:
        case VGA350:

                vbwait();
                putxio(L_SYNCMODE, vmode);
                pause(0, 0, 100);
                break;

        default:

                return(~RET_OK);
                break;

    } /* end switch */

    return(RET_OK);

} /* end set video display adapter */


/*****************************************************************************
    ACQUIRE

        This routine sets the read and write acquisition matrix elements.

        The cmode parameter sets the matrix size (i.e. number of element on
        a side). The matrix is always square. As an example, if cmode == 2
        then aquisition can be done to the frame buffer in any one of the
        2 X 2 matrix elements. This routine also incorporates a matrix indexing
        scheme, where by using the the hshift and vshift parameters, the matrix
        elements can be shifted.


        Returns: Always returns RET_OK

*/


acquire(cmode, src, des, hshift, vshift, field)
    int cmode, src, des, hshift, vshift, field;

{

    IMPORT prvcmode, sys_vbias, user_defined_vbias;

    register row, col;
    int vactive, hactive, prvfrz, maxhshift, maxvshift;
    unsigned phase;                     /* controls horizontal blank delay */


    if((cmode != ACQ_1_1) && (cmode != ACQ_2_1) && (cmode != ACQ_4_1))
        cmode = ACQ_0;

    vactive = whatis_vpossible();
    hactive = Whatis_hactive();

    switch(cmode){

        case ACQ_0:
            if((cmode = prvcmode) == ACQ_1_1){
                field = BOTH_FIELDS;
                break;
            }

            /* yes, that's right. Drop through */
```

```
        case ACQ_2_1:
        case ACQ_4_1:
            phase = ACQ_2_PHASE;
            field = (field==EVEN_FIELD || field==ODD_FIELD) ? field :EVEN_FIELD
;
            break;

        case ACQ_1_1:
        default:
            phase = ACQ_1_PHASE;
            cmode = ACQ_1_1;
            field = BOTH_FIELDS;
            break;

    } /* end switch */


    prvcmode = cmode;



    if(src < 0)
        src = 0;

    if(src + sys_vbias + user_defined_vbias >= VDELAYMAX)
        src = VDELAYMAX - sys_vbias - user_defined_vbias;

    src += sys_vbias + user_defined_vbias;


    des = (des <= (cmode * cmode) && (des > 0)) ? des : 1;


    maxvshift = vactive / cmode;

    vshift = (vshift >= 0 && vshift < /* = */maxvshift) ? vshift : maxvshift;

    row = (des - 1) / cmode;
    col = (des - 1) - (row * cmode);

    row = (row * (vactive / cmode) + vshift) >> 1;
    col = col * (hactive / cmode);

    maxhshift = /* MAXACQ_COLS - */ (hactive / cmode) /* - col*/;
    hshift = (hshift >= 0 && hshift <= maxhshift) ? hshift : maxhshift;
    col = (col + hshift) >> 2;


    switch(cmode){

        case ACQ_2_1:
            cmode = COMPRESS_2_1;
            break;

        case ACQ_4_1:
            cmode = COMPRESS_4_1;
            break;

        default:
            cmode = COMPRESS_1_1;
            break;

    } /* end switch */


    prvfrz = freeze();                  /* NO writes to postn regs while live  */

    putxio(L_VERT_DELAY, ~(src / 2));/* delay writes to FB for src # lines  */
```

```
    putxio(L_ACQ_VPOS, row);          /* update the position regs          */
    putxio(L_ACQ_HPOS, col);

    putxio(L_FBSIZ, cmode);
    putxio(L_FIELD, field);

    if(prvfrz == UNFROZEN)            /* restore previous freeze state     */
        unfreeze();


    return(RET_OK);


} /* end acquire */

/*****************************************************************************
- . ALIGN

        Allows setting of the horizontal alignment of the video with the
        graphics.


        Returns: value it received

*/


#define HICLK     1
#define LOCLK     0
#define ENABLE    1
#define DISABLE   0



align(position, update)
    unsigned position;
    BOOLEAN update;

{

    IMPORT align_nominal;

    register int i, n;

    if((n = position) <= 255){

        putxio(L_ALIGNXFR, ENABLE);


            for(i = 0; i   ; i++){

                putxio(L_ALIGNDATA, ~n); /* drive data to proper lvl */

                putxio(L_ALIGNCLK, HICLK);
                putxio(L_ALIGNCLK, LOCLK);

                n >>= 1;

            } /* end for */


        putxio(L_ALIGNXFR, DISABLE);

        if(update == YES)
            align_nominal = position;

        return(position);

    }
} /* end align() */
```

```
/*****************************************************************************
    DBG
        debug print utility

        output a string and parameter to a buffer


        Always returns: RET_OK */


dbg(str, val)
    register char *str;
    int val;

{

    #ifndef ROMVERSION

        IMPORT char *dbgbuf;

        BOOLEAN flag;

        register char *dbuf;
        static i = 0;


        dbuf = dbgbuf;

        while((flag = (++i < SIZDBGBUF - 10)) && (dbuf[i] = *str++));

        if(!flag)
            i = 0;

        *((int *)(&dbuf[++i])) = val;
        i += 2;

    #endif


    return(RET_OK);


} /* end dbg */
```

```
/*****************************************************************************
*                                                                            *
*                                                                            *
*                                                                            *
*                    N e w   M e d i a   G r a p h i c s                     *
*                    ----------------------------------                      *
*                                                                            *
*                        V I D E O   W I N D O W S                           *
*                        -------------------------                           *
*                                                                            *
*                                                                            *
*       Module name: VWDMA.C                                                 *
*       Version:     1.00                                                    *
*       Revision:    0                                                       *
*       Date:        Jan-88                                                  *
*       *                                  *
*       Author:      R. Tricca                                               *
*                                                                  *
*                                                                            *
*                                                                            *
*****************************************************************************/


#include <vwinc.h> #include <atmplts.h> #include <define.h>

#ifdef HDRCHK

    #include "vwmodhdr.h"

#endif



/*****************************************************************************
    CONFIG_DMA

        Configure an 80188 dma channel

            ch: channel to configure, either VIDEO or COMM
            src: source address, either an I/O port or real address
            des: destination address, either an I/O port or real address
            tc:  terminal count
            control: control word to control actual transfer

            Returns: RET_OK if all went well
                     PARM_ERR parameter error if one of the parameters is bad
*/


config_dma(ch, src, des, tc, control)
    unsigned ch, tc, control;
    char far *src, far *des; {

    IMPORT IO_MAP iomap;
    register DMA188 *p;

    if((ch != VIDEO && ch != COMM) || src == NULLP || des == NULLP)
        return(PARM_ERR);

    p = (ch == VIDEO ? iomap.vdma : iomap.cdma); /* select a dma channel */


    outpw(p->dma_desl, (int)des);                          /* low word  */
    outpw(p->dma_desh, (int)((long)(des)/0x10000000));     /* high word */

    outpw(p->dma_srcl, (int)src);
    outpw(p->dma_srch, (int)((long)(src)/0x10000000));
```

```
    outpw(p->dma_count, tc);

    /* ha ha ha, I get the last word in about who has channel priority ! */
    outpw(p->dma_ctrl,ch == VIDEO ? control != PRIORITY : control & ~PRIORITY);

    return(RET_OK);

} /* end configure dma */

/*****************************************************************************
    START_DMA

        Start either dma channel (VIDEO or COMM)

        Pass in the channel to be started and we'll start it immediately

        Returns either: RET_OK
                     or ~RET_OK                                              */

start_dma(ch)
    int ch ; {


    IMPORT IO_MAP iomap;
    register DMA188 *p;


    if( ch != VIDEO && ch != COMM )
        return (~RET_OK);

    p = ( ch == VIDEO ? iomap.vdma : iomap.cdma ); /* select a dma channel */

    outpw( p->dma_ctrl, inpw( p->dma_ctrl ) | STRT_STOP | CHANGE );

    return(RET_OK);


} /* end start dma */

/*****************************************************************************
    STOP_DMA

        Stop either dma channel (VIDEO or COMM)

        Pass in the channel to be stopped and we'll stop it immediately

        Returns either: RET_OK
                     or ~RET_OK                                              */

stop_dma(ch)
    int ch;

{
    IMPORT IO_MAP iomap;
    register DMA188 *p;

    if( ch != VIDEO && ch != COMM )
        return (~RET_OK);

    p = (ch == VIDEO ? iomap.vdma : iomap.cdma); /* select a dma channel */

    outpw(p->dma_ctrl, inpw(p->dma_ctrl) & ~STRT_STOP | CHANGE);

    return(RET_OK);


} /* end stop dma */
```

```
/*************************************************************************
*                                                                        *
*                                                                        *
*                                                                        *
*                    N e w   M e d i a   G r a p h i c s                 *
*                    ----------------------------------                  *
*                                                                        *
*                        V I D E O   W I N D O W S                       *
*                        -------------------------                       *
*                                                                        *
*                                                                        *
*       Module name: TASKS3.C                                            *
*       Version:     1.00                                                *
*       Revision:    0                                                   *
*       Date:        MAY-88                                              *
*                                                                        *
*       Author:      R. Tricca                                           *
*                                                                        *
*                                                                        *
*                                                                        *
*************************************************************************

    This module contains hardware dependent functions. Functions in this
    module directly affect the base functionality of the Video Windows
    system. It is not recommended that these functions be altered.

*/



#include <stdio.h>
#include <vwinc.h>
#include <atmplts.h>
#include <dma_def.h>
#include <ioport.h>
#include <define.h>
#include <cstruct.h>
#include "common.h"

#ifdef HDRCHK

    #include "vwmodhdr.h"

#endif



    IMPORT BDT *dspscrn;
    IMPORT unsigned int cycles_leftover;



/*************************************************************************

    VCU data to FRAME BUFFER

    This function copies imbus register information to the frame buffer
    during coldstart or when imregister changes alter the data in the
    vertical flyback data structure.

    This information must be written to the frame buffer at addresses
    corresponding to rasters 509 and 511. These are the last two rasters in
    the frame buffer. The data written to these lines is then pointed to by
    the display list.
```

```
    Remember: Writes to the frame buffer must be done while screen is frozen.

    P.S.  Unfortunately, this routine contains a lot of very hardware dependant
          stuff in it. I.e. bitwide chroma info, luma info and all sorts of
          nasty VCU clocking information. I have attempted to at least make it
          easy to follow. My advice to you is to not touch it unless you REALLY
          think it needs to be changed & you understand the implications of
          your changes.

    P.P.S Cheer up. If you can understand how this routine works, the rest of
          the code will be a piece of cake !


    Returns: The frame buffer raster line Vcu data begins at
             else
             ERR_NULLP if passed a null display list pointer.

*/



    #define VCUCLK  1
    #define VCUDATA 8
    #define BIT7    0x80


vcutofb()

{

    IMPORT unsigned far *pfrmbuf;        /* pointer to base of frame buffer  */
    IMPORT vpmax;

    VFDATA vcudat;                       /* vertical flyback data table      */
    UBYTE *vfp, pdata;

    PIXEL pix;                           /* pixel luma and chroma info; cast */
                                         /* down later on                    */

    BOOLEAN tflag;                       /* timing flag set true, if pll's
                                            need to be adjusted              */

    register unsigned i;



    unsigned fba, partition, ras;
    unsigned xfrwidth;                 /* Width of vcu data (72 bits * 4)- 4 */

    int null_row;                      /* VCU transfer row must be preambled */
                                       /* with a row of null data. This param*/
                                       /* indicates that row                 */
    int  j, bitno, prvfrz, lo, hi;


    /* OK. Before we start, I'm going to give you one last warning. Don't screw
       around with this routine !!! Love Rick                                  */


    if(dspscrn != NULLP){


        /* Calculate frame buffer row we must create the VCU 'null' line at.
           Find out where this address/partition is located                 */

        whatis_lastrow();
        null_row = vpmax++;
```

```
/* scan for first VCU line previously written to display list(we may
    or may not find one)                                                  */

i = 0;

do{
    ras = ((dspscrn->a[i].vpcas & RASMSB) << 8) + dspscrn->a[i].vpras;

} while(i++ < MAXROWS && ras != VCU_LINE);


/* Write some null line pointers into the display list                   */
/* Overwrite any vcu_line pointers which currently exist w/null lines*/
/* Only one vcu_line pointer is permissible per display list             */

for(i = i < null_row ? i - VCU_DELTA : null_row; i < MAXROWS; i++){

    dspscrn->a[i].win_on  = 0;
    dspscrn->a[i].win_off = 0;
    dspscrn->a[i].vpras = NULL_LINE;
    dspscrn->a[i].vpcas = NULL_LINE >> 8;
}


build_vcu(&vcudat);      /* First, create a vcu data structure */


                         /* Insure standard timing, otherwise we'll blow
                            ourselves out of the water                    */
tflag = FALSE;
lo = getxio(L_PLLV_LO);
hi = getxio(L_PLLV_HI);
if(lo + (hi << 8) != PLLV_NOMINAL){
    putxio(L_PLLV_LO, PLLV_NOMINAL);
    putxio(L_PLLV_HI, PLLV_NOMINAL >> 8);
    tflag = TRUE;
}


prvfrz = freeze();       /* Can't write to frame buffer while its live*/


/* Write the VCU null line data to the frame buffer. Null line data
   should always be the second to last line in the frame buffer      */

prtofb(0, NULL_LINE, &fba, &partition);
select_partition(partition);

pix.luma = 0;
pix.chroma = 1;

for(i = 0; i < MAXACQ_COLS; i++){
    prtofb(i, NULL_LINE, &fba, &partition);
    *(pfrmbuf + fba) = *((unsigned *)&pix);
}


/* Write the VCU control line to the frame buffer. Vcu line data is
   usually the last line in the frame buffer                         */

prtofb(0, VCU_LINE, &fba, &partition);
select_partition(partition);

pix.luma = 0;
pix.chroma = 1;

vfp = (UBYTE *)&vcudat;
```

```
    for(i = 0; i < VCU_DATA_OFFSET; i++){
        prtofb(i, VCU_LINE, &fba, &partition);
        *(pfrmbuf + fba) = *((unsigned *)&pix);
    }

    for(bitno = 0, xfrwidth = i+284, pdata = *vfp; i <= xfrwidth; i += 4){

        pix.chroma = ((pdata & BIT7) != 0) ? VCUDATA : 0;

        for(j = 0; j < 4; j++){

            pix.chroma = j==2 ? pix.chroma & ~VCUCLK : pix.chroma | VCUCLK;
            prtofb(i + j, VCU_LINE, &fba, &partition);
            *(pfrmbuf + fba) = *((unsigned *)&pix);
        }

        pdata <<= 1;                    /* get the next data bit */

        if(++bitno > 7){
            bitno = 0;
            pdata = *(++vfp);           /* get next VCU data item */
        }

        pix.luma = 0;
        pix.chroma = 1;

        for(; i < MAXACO_COLS; i++){
            prtofb(i, VCU_LINE, &fba, &partition);
            *(pfrmbuf + fba) = *((unsigned *)&pix);
        }


        /* write VCU control line pointer into the display list */

        dspscrn->a[null_row + VCU_DELTA].vpras = VCU_LINE;
        dspscrn->a[null_row + VCU_DELTA].vpcas = VCU_LINE >> 8;


        putxio(L_VCUCLKEN, ~0);         /* enable VCU clocking                  */

            vbprgmwait(1);              /* do for 2 fields and change           */
            vbprgmwait(1);

        putxio(L_VCUCLKEN, 0);          /* disable VCU clocking                 */

        vbprgmwait(1);                  /* holdoff any new vcu writes until     */
                                        /* interrupt handler vblanksvc has had  */
                                        /* a chance to resample graphics mode   */

        if(prvfrz == UNFROZEN)          /* restore previous frz state           */
            unfreeze();


        if(tflag == TRUE){              /* restore previous timing              */
            putxio(L_PLLV_LO, lo);
            putxio(L_PLLV_HI, hi);
        }


        return(null_row);


    } /* end outer if */


    else

        return(0);


} /* end vcutofb */
```

```
/*****************************************************************************
    BUILD_VCU

        This routine reads current IMBUS values to be transfered from the CVPU
        to the VCU during the vertical blanking period and builds a table of
        them.

        Returns: RET_OK if all went well
                 ~RET_OK if the pointer was null.
*/


build_vcu(pvcu)
    register VFDATA *pvcu;


{

    register unsigned imr;


    if(pvcu != NULLP){

        imr = read_im(16, ~0);     /* brightness and bit data come from R16 */
        pvcu->bright = imr;
        pvcu->bdata  = imr >> 8;

        imr = read_im(17, ~0);
        pvcu->reddriv = imr;
        pvcu->redcutoff = imr >> 8;

        imr = read_im(18, ~0);
        pvcu->grndriv = imr;
        pvcu->grncutoff = imr >> 8;

        imr = read_im(19, ~0);
        pvcu->bludriv = imr;
        pvcu->blucutoff = imr >> 8;

        imr = read_im(27, ~0);
        pvcu->contrast = imr;

        return(RET_OK);
    }

    else
        return(~RET_OK);


} /* end build_vcu */


/*****************************************************************************
    Whatis lastrow

        This routine returns the number of the last raster which is actively
        being displayed. This number does NOT include the VCU data and null
        lines which become active when VCUCLKEN becomes active.

        Returns: Number of lines being displayed  */


whatis_lastrow()

{

    IMPORT unsigned maxrows;
    IMPORT vpmax;
```

```
    vpmax = ((GRAPHICS_CYCLES - cycles_leftover) / sizeof(ADT)) - 2;

    if(vpmax < MINRAS)
        vpmax = MINRAS;

    maxrows = vpmax - 1;

    return(maxrows);

} /* end whatis_lastrow */


;*****************************************************************************
*
;*                                                                           *
;*                                                                           *
;*                                                                           *
;*                  N e w   M e d i a   G r a p h i c s                      *
;*                  ----------------------------------                       *
;*                                                                           *
;*                      V I D E O   W I N D O W S                            *
;*                      -------------------------                            *
;*                                                                           *
;*                                                                           *
;*      Module name:  INTSVC.ASM                                             *
;*      Version:      1.00                                                   *
;*      Revision:     0                                                      *
;*      Date:         Dec-88                                                 *
;*      Author:       R. Tricca                                              *
;*                                                                           *
;*                                                                           *
;*                                                                           *
;*                    This module handles all interrupts generated by        *
;*                    hardware sources                                       *
;*                                                                           *
;*                                                                           *
;*****************************************************************************

    TITLE  intsvc

    .286c
    .287

_TEXT   SEGMENT  BYTE PUBLIC 'CODE'
_TEXT   ENDS
_DATA   SEGMENT  WORD PUBLIC 'DATA'
_DATA   ENDS
CONST   SEGMENT  WORD PUBLIC 'CONST'
CONST   ENDS
_BSS    SEGMENT  WORD PUBLIC 'BSS'
_BSS    ENDS


DGROUP  GROUP   CONST,  _BSS,   _DATA
    ASSUME  CS: _TEXT, DS: DGROUP, SS: DGROUP, ES: DGROUP


    PUBLIC  _rtcsvc                 ; real time clock int service routine
    PUBLIC  _vblanksvc              ; vertical blank          "
    PUBLIC  _comsvc                 ; communications          "
    PUBLIC  _vcountsvc              ; count graphics vertical blank requests
    PUBLIC  _vvcntsvc               ; count video vertical blank requests
    PUBLIC  _pcrqsvc
    PUBLIC  _dvbsvc
    PUBLIC  _nosvc
    PUBLIC  _wsemsvc                ; write semaphore register
    PUBLIC  _video_fault
    PUBLIC  _div_fault
```

```
EXTRN   _vcstat:WORD            ; video channel DMA status
EXTRN   _abtcomm:WORD           ; abort pc communications driver
EXTRN   _iomap:BYTE             ;
EXTRN   _dspscrn:WORD           ; source address for video dma
EXTRN   _video_tc:WORD          ; VIDEO dma Terminal Count
EXTRN   _cycles_leftover:WORD   ;
EXTRN   _lbyte:BYTE             ; last byte read/written during transfer
EXTRN   _pktdone:WORD           ; indicate lbyte valid
EXTRN   _cdir:WORD              ; xmission direction indicator.
EXTRN   _rtc_count:DWORD        ; Real time clock counter.
EXTRN   _tick_rate:WORD         ; mS per tick. We count in pure mS.
EXTRN   _semstate:WORD          ; Track writes to semaphore register
EXTRN   _semval:WORD            ; field selector
EXTRN   _semx:WORD              ; field polarity selector
EXTRN   _pcrqcnt:WORD
EXTRN   _scmndrqst:WORD         ; Set ONLY by pcrqsvc,clrd ONLY by endcomm(
)
EXTRN   _prvsemin:WORD          ; previous input semaphore state
EXTRN   _vsync_count:WORD       ; running total of vsync requests
EXTRN   _vvblank_count:WORD     ; running total of vvblank requests
EXTRN   _vblank_serviced:WORD   ; indicates vblank serviced
EXTRN   _div_by0_err:WORD       ; set this flag when div by 0 err occurs
EXTRN   _vsf_count:WORD         ; Vertical sync fault svc count
EXTRN   _vsf_time:WORD          ; Elapsed time since vertical sync failure


DOABORT EQU 1
FAULT   EQU 1

BLO     EQU 4
BHI     EQU 2

VBTOFFSET  EQU 4        ; these are offsets within the io map
VDMAOFFSET EQU 8

.XLIST
    INCLUDE ..\imbasm\imiodef.asm
.LIST

_TEXT   SEGMENT

;*****************************************************************************
; Video
dma channel fault service ;  ; This routine handles fault conditions generated
by the
video dma channel. ; Currently a fault is defined simply by the terminal count
reaching
zero ; and this handler being activated. Terminal count will reach zero when vs
ync  ;
interupt requests stop for some reason( if the graphics board is switched to ;
an
improper mode, for instance)hsync ; requests con ;  ; Right now, we simply mark
the fact
that the controller ran out of cycles

_video_fault    PROC NEAR

    push    ax
    mov     _vcstat,FAULT       ; set video channel status to fault condition
    mov     _vsf_count,0        ; Every time a vertical sync fault occurs,
    mov     _vsf_time,0         ; reset these.

    mov     ax,EOI_CLEAR        ; EOI register
    out     EOI,ax

    pop     ax

    sti
    iret

_video_fault    ENDP
```

```
;*************************************************************************** ;
 Vertical
blank service ; ; This handler resets the video dma channel and makes adjustmen
ts to the
; dma parameters each vertical blank period. ;


_vblanksvc  PROC NEAR

    push    ax
    push    bx
    push    dx


    mov bx,WORD PTR _iomap+VDMAOFFSET   ; p = iomap.vdma

    sub dh,dh                           ; inpw(p->dma_ctrl)
    mov dl,[bx + 5]                     ; get dma control word
    in  ax,dx
    push ax                             ; save control word

    cmp _vcstat, FAULT                  ; Have we previously faulted ?
    jne $30

    inc _vsf_count                      ; keep track of vsyncs since failure
    cmp _vsf_count, 40

    jle $31                             ; if le, then count not high enough yet

    mov _vcstat, 0                      ; OOOHHH, lets start 'er up again
    pop ax
    or  ax, STRT_STOP                   ;
    push ax


$30:
    and ax, NOT STRT_STOP               ; outpw(p->dma_ctrl, c & ~STRT_STOP)
    or  ax, CHANGE
    out dx,ax                           ; stop dma activity
    in  ax,dx                           ; a = inpw(p->dma_count)
    mov _cycles_leftover,ax

    mov ax,_video_tc                    ; get transfer count
    out dx,ax                           ; write back updated transfer count

    mov ax,_dspscrn                     ; get source address low word
    mov dl,[bx]
    out dx,ax                           ; outpw(p->dma_srch, dspscrn)

    mov ax,0                            ; source addr hi word always zero for now
    mov dl,[bx + 1]
    out dx,ax                           ; outpw(p->dma_srch, dspscrn)

$31:
    pop ax                              ; get control word back
    or  ax,CHANGE                       ; outpw(p->dma_ctrl, a | CHANGE)
    mov dl,[bx + 5]                     ; Remember, if count reaches zero, its an
    out dx,ax                           ; error, and we won't restart because TC
                                        ; will reset START to STOP

    inc WORD PTR _vblank_serviced       ; indicates to high level routines that a
                                        ; graphics vertical blank has just occured
                                        ;
    mov ax,EOI_CLEAR
    out EOI,ax

    pop dx
    pop bx
    pop ax
```

```
    sti                                ; enable interrupts
    iret                               ; see ya

_vblanksvc  ENDP


;*************************************************************************;
    Vertical blank counter service  ( GRAPHICS source blanking )
; ; This routine simply counts dvsync requests over a given time period.
; ; It is up to the user to install this handler, clear the counter, and
;   enable/ disable it
; ;

_vcountsvc  PROC NEAR

    push    ax

    add     _vsync_count,1             ; Every time we get a vsync, increment
                                       ; counter

    mov     ax,EOI_CLEAR               ; non-specific interrupt clear
    out     EOI,ax

    pop     ax

    sti
    iret

_vcountsvc  ENDP

;*************************************************************************;
    Vertical blank counter service  ( VIDEO source blanking )
; ; This routine simply counts video vertical blank requests over a given
;   time period.
; ; Since this routine is not normally enabled, the count only indicates
;   blank periods which have occured while the handler is enabled
; ; It is up to the user to install this handler, clear the counter, and
;   enable/ disable it
;

_vvcntsvc   PROC NEAR

    push    ax

    add     _vvblank_count,1           ; Every time we get a video vsync,
                                       ; increment counter

    mov     ax,EOI_CLEAR               ; non-specific interrupt clear
    out     EOI,ax

    pop     ax

    sti
    iret

_vvcntsvc   ENDP


;*************************************************************************;
    Real time clock service ;  ;
    This routine handles the timer 2 interrupt generated to maintain the ;
    real time clock.  ; ;
    Once timer 2 times out, it generates an interrupt which is processed  ;
    here.
```

```
_rtcsvc PROC NEAR

    push    ax

    mov     ax,_tick_rate
    add     WORD PTR _rtc_count,ax      ; Every time we get a tick, increment
    adc     WORD PTR _rtc_count+2,0     ; the real time clock counter

    mov     ax,EOI_CLEAR                ; non-specific interrupt clear
    out     EOI,ax

    pop     ax

    sti
    iret                                ; quick, eh ?


_rtcsvc ENDP


;*****************************************************************************
; PC <-->
VW communications handler ; ; This routine handles the 'end of dma transfer' in
terrupt
generated by the ; 80188 dma communications channel. For the recieve data and r
eceive
command ; cases, it reads the last byte of data from the PC without issuing ano
ther ;
request for data, then sets a global flag indicating the byte has been read  ;
and the
packet transmission has run to completion. For the send data case, ; it transfe
rs all but
the last byte normally, then sends the last byte over  ; without requesting any
more
transfers. ; ; All this is done under the auspices of the cdir flag, which indi
cates the
; current transfer direction.


_comsvc     PROC NEAR

    push    ax
    push    dx


    mov     dx,DMA_NODRQ            ; We'll need this in a moment

    in      al,dx                   ; read last byte of transfer, don't issue drq
    mov     _lbyte,al

    mov     _pktdone,1              ; indicate completely rcvd/sent packet

    mov     ax,EOI_CLEAR
    out     EOI,ax

    pop     dx
    pop     ax

    sti
    iret                            ; and we're off !

_comsvc ENDP
```

```
;*****************************************************************************;*
;*                                                                            *
;*                                                                            *
;*                          New Media Graphics                                *
;*                                                                            *
;*                            VIDEO WINDOWS                                   *
;*                                                                            *
;*                                                                            *
;*                                                                            *
;*   Module name: IMMAIN.ASM                                                  *
;*   Version:     3.3                                                         *
;*   Revision:    Jun-89                                                      *
;*   Date:        Dec-88                                                      *
;*   Author:      R. Tricca, PSI                                              *  *
;*

;*                                                                            *
;*                                                                            *
;*                This module contains kernel startup code, system            *
;*                code, powerup tests and code to drive the IM bus            *
;*                                                                            *
;*                                                                            *
;*                                                                            *
;*****************************************************************************


; defining these things public makes things much easier when emulating

PUBLIC      PWRON PUBLIC
            START PUBLIC
            PWR05 PUBLIC
            PWR09 ;PUBLIC
            FAULT PUBLIC  PWR30 ;PUBLIC
            PWR99 PUBLIC
            RESTART PUBLIC
            RUN


; This group of symbols referenced by the C code, origin is here

PUBLIC      _start
PUBLIC      _prg_chksum
PUBLIC      _imtable
PUBLIC      _stktop PUBLIC
            _stkbot PUBLIC _iminit PUBLIC _sramtest PUBLIC _chktest

; Referenced by iminterface.asm

PUBLIC      IMREAD
PUBLIC      IMWRITE

      INCLUDE IMDEFINE.ASM


            .XLIST
            SUBTTL  Code Segment
            .LIST
            PAGE


; This group of symbols referenced by this code, origin in C sources

EXTRN _main:NEAR EXTRN _rom_xfer:NEAR

EXTRN _test:WORD EXTRN _heaptop:WORD EXTRN _heapbase:WORD EXTRN
_warmstart:WORD

_CODE SEGMENT
      ASSUME CS: _CODE, DS: DGROUP, ES: DGROUP

; PWRON is the reset routine.  It has been placed in its own segment so that
; it may be placed by the locater in the top 1K of memory.  During an 80188 ;
reset, only this top 1K of memory works.  This small section of code is used ;
to fire up the rest of the system memory and peripheral control lines.


pwron:
      mov dx,pwrio_base+rlcr
      mov ax,rlcr_init
```

```
out dx,ax                          ; initialize relocation register
mov ax,pacs_init

pwr05:                             ; this label needed for emulation
      out pacs,ax                  ; initialize pcs range
      mov ax,mmcs_init
      out mmcs,ax                  ; initialize mcs range
      mov ax,umcs_init
      out umcs,ax                  ; initialize ucs range
      mov ax,mpcs_init
      out mpcs,ax                  ; initialize ms and ex

pwr09:
      mov sp,ram_base+ram_size-2   ; initialize stack pointer

      jmp far ptr pwr10

_code ends

_text segment
      assume cs: _text, ds: dgroup, es: dgroup

; The first 2 bytes of the prom contain the program prom checksum. ; This
value is not included in the solved checksum, so it may be  ; easily updated.

_prg_chksum dw 0

; START is the start of the powerup diagnostics code.  It runs a series of  ;
diagnostics.  If no errors are encountered, control is passed to the RUN ;
procedure.  If an error is encountered, the processor will halt with the  ;
FAULT status line set true and the FAULT indicator lit.

_start: START: PWR10:

;isdef ROM VERSION

if2
%out
%out **** ROM firmware checksum implemented ****
endif
      cmp _warmstart,STARTUP_COMPLETE ; don't do memory tests on warmstart
      jne pwr11

      jmp far ptr pwr310

pwr11:
      mov ax,0
      mov bx,offset _prg_chksum+2

;we skip first word .

      sub dh,dh

chksum_test:                       ;calculate full firmware checksum and test
      mov dl,cs:[bx]
      add ax,dx
      inc bx
      jnz chksum_test

      mov cx,ax                    ;save the value
      mov bx,offset _prg_chksum    ;point at checksum
      cmp cx,cs:[bx]               ;compare to solved one
      jnz chkfail

      mov word ptr _chktest, PASS
      ja pwr 30

chkfail:
      mov word ptr _chktest, FAIL  ;mark the test results structure
      ja pwr30

; endif

pwr30:
      cmp _warmstart,startup_complete    ; needed for emulator
      je pwr310

      mov ax,5555h                       ; alternate bit test
      call sram_test

      not ax                             ; invert bits, try again
      call sram_test

      mov ax,0ffffh                      ; test all set
```

```
      mov ax,0ffffh           ; test all set
      call sram_test


      not ax                  ; test all clear
      call sram_test

      mov word ptr _sramtest, PASS  ; mark memory pass in test results
      mov word ptr _sramtest+2, PASS; this actually considered a long null
pntr

pwr31:
      jmp  pwr99


sram_test:
      mov cx,(ram_size-ram_start-16)/2   ;the 16 is for a tiny bit of stk
space
      mov di,ram_start

      rep stos word ptr dgroup:ram_start ;fill static ram with pattern (in ax)

      mov cx,(ram_size-ram_start-16)\2
      mov bx, ram_start
      mov di,0

srt1:
      cmp ax,[bx+di]                      ; see if ram data ok
      jnz srt2
      inc di
      inc di
      loop srt1
      ret

srt2:
      mov ax,[bx][di]
      mov _sramtest,ax                    ; mark first memory error address
      mov _sramtest+2,seg dgroup:_data    ; in test results

      jmp pwr31                           ; abort memory testing and continue

; Test DMA operation

; move static ram to static ram w/ch 0 (in normal operation, this channel ;
used for video)

PWR99:

    . MOV SI,OFFSET DGROUP:_DATA          ; Source offset
      MOV DI,OFFSET DGROUP:_DATA+500h     ; Destination offset
      MOV CX,500h                         ; Number of bytes to move
      MOV DX,DEST_MIO+DEST_INC+SRC_MIO+SRC_INC+CHANGE+STRT_STOP+B_W
      CALL RUN_DMAO                       ; Run ch O DMA transfer
      IN AX,DMAO_CTRL
      AND AX,STRT_STOP

      JMP pwr310                          ; onward

      MOV AL,DMAOE1_CODE
      JMP FAULT

PWR310:
      CALL RESTART              ; Turn off timers, DMA, INTs
      JMP  RUN                  ; Go do the real stuff

      PAGE

; Maskable hardware interrupt service routines (for PWRON diagnostics)

DMAO_SERV   PROC

      PUSH    AX
      MOV INT_ID,DMAO_CODE      ; Just load the code
      MOV AX,EOI_CLEAR
      OUT EOI,AX                ; Non-specific EOI
      POP AX
      STI
      IRET

DMAO_SERV  ENDP

DMA1_SERV  PROC
```

```
        PUSH   AX
        MOV INT_ID,DMA1_CODE     ; Just load the code
        MOV AX,EOI_CLEAR
        OUT EOI,AX               ; Non-specific EOI
        POP AX
        STI
        IRET

DMA1_SERV  ENDP


; TMR_STAT puts the value of timer 0 RIU in AX bit 0, and the value of timer ;
1 RIU in AX bit 1. Remainder of AX is cleared

TMR_STAT   PROC

        PUSH   CX
        IN AX,T0_CTRL
        AND AX,RIU               ; Isolate timer 0 RIU bit
        MOV BX,AX
        IN AX,T1_CTRL
        AND AX,RIU               ; Isolate timer 1 RIU bit
        ADD AX,AX
        ADD AX,BX                ; Combine the bits
        MOV CL,4
        ROL AX,CL                ; Move to LSOs
        POP CX
        RET

TMR_STAT   ENDP

; RUN_DMAx start memory-to-memory unsynchronized DMA transfers using the lower
; 64K address area.  SI contains the source address offset from DS, DI
contains ; the destination address offset from ES, CX has the transfer count,
and DX has ; the command.

RUN_DMA0  PROC

        MOV AX,SI
        OUT DMA0_SRCL,AX         ; Write source address
        MOV AX,0
        OUT DMA0_SRCH,AX
        MOV AX,DI
RUN_DMA0  PROC

        MOV AX,SI
        OUT DMA0_SRCL,AX         ; Write source address
        MOV AX,0
        OUT DMA0_SRCH,AX
        MOV AX,DI
        OUT DMA0_DESTL,AX        ; Write destination address
;       MOV AX,VIDEO_RAM_BASE/256
        MOV AX,0
        OUT DMA0_DESTH,AX
        MOV AX,CX
        OUT DMA0_COUNT,AX        ; Write count
        MOV AX,DX
        OUT DMA0_CTRL,AX         ; Write command
        RET

RUN_DMA0   ENDP

RUN_DMA1   PROC

        MOV AX,SI
        OUT DMA1_SRCL,AX         ; Write source address
        MOV AX,0
        OUT DMA1_SRCH,AX
        MOV AX,DI
        OUT DMA1_DESTL,AX        ; Write destination address
        MOV AX,VIDEO_RAM_BASE/256
        OUT DMA1_DESTH,AX
        MOV AX,CX
        OUT DMA1_COUNT,AX        ; Write count
        MOV AX,DX
        OUT DMA1_CTRL,AX         ; Write command
        RET

RUN_DMA1   ENDP


; FAULT clears the external control port and halts.  If debug, the fault code
; is output to the debug display.  It must reside in the top 1K of memory.
```

```
FAULT  PROC

      CLI

      mov dx,6f0h
      out dx,al

      jmp $

FAULT  ENDP


; RESTART puts the significant internal registers back to their RESET state. ;



restart proc

      mov ax,no_inh
      out t0_ctrl,ax                ; turn off timers
      out t1_ctrl,ax
      out t2_ctrl ,ax

      mov ax,change                 ; turn off dma
      out dma0_ctrl,ax
      out dma1_ctrl,ax

      mov ax,pr0+pr1+pr2+msk        ; set to low priority, and masked
      out tmr_i_ctrl,ax             ; turn of interrupt controller
      out dma0_i_ctrl,ax
      out dma1_i_ctrl,ax
      out int0_i_ctrl,ax
      out int1_i_ctrl,ax

      out int_stat,ax               ; reset dhlt

      ret

restart endp

INTO_SERV  PROC

      PUSH   AX
      MOV INT_ID,INTO_CODE          ; Just load the code
      MOV AX,EOI_CLEAR
      OUT EOI,AX                    ; Non-specific EOI
      POP AX
      STI
      IRET

INTO_SERV  ENDP

INT1_SERV  PROC

      PUSH   AX
      MOV INT_ID,INT1_CODE          ; Just load the code
      MOV AX,EOI_CLEAR
      OUT EOI,AX                    ; Non-specific EOI
      POP AX
      STI
      IRET

INT1_SERV  ENDP
         PAGE

; Software-generated interrupt service routines (for PWRON diagnostics)

BAD_INT_SERV  PROC

      MOV CL,INT_ID
      IN AX,INT_REQ
      MOV CH,AL
      MOV AL,INTE1_CODE
      JMP FAULT

BAD_INT_SERV   ENDP

SW_INT_SERV PROC

      MOV INT_ID,SW_INT_CODE        ; Just load the code
      STI
      IRET

SW_INT_SERV ENDP
```

```
ESC_SERV  PROC

      MOV INT_ID,ESC_CODE          ; Load the code
      POP AX                       ; Pop the return address
      ADD AX,4                     ; Modify for return
      ADD SP,4                     ; Fix the stack pointer
      STI
      JMP AX                       ; Psuedo-return (AX modified)

ESC_SERV   ENDP

TMRO_SERV  PROC

      PUSH  AX
      IN  AX,TO_CTRL
      AND AX,NOT TMR_INT           ; Turn off TO interrupt
      OUT TO_CTRL,AX
      MOV INT_ID,TMRO_CODE         ; Load the code
      MOV AX,EOI_CLEAR
      OUT EOI,AX                   ; Non-specific EOI
      POP AX
      STI
      IRET

TMRO_SERV  ENDP

TMR1_SERV  PROC

      PUSH  AX
      IN  AX,T1_CTRL
      AND AX,NOT TMR_INT           ; Turn off T1 interrupt
      OUT T1_CTRL,AX
      MOV INT_ID,TMR1_CODE         ; Load the code
      MOV AX,EOI_CLEAR
      OUT EOI,AX                   ; Non-specific EOI
      POP AX
      STI
      IRET

TMR2_SERV  ENDP

; WAIT A SPECIFIED INTERVAL ;ON ENTRY, THE WAIT INTERVAL IS IN AX ;ONE WAIT
INTERVAL = 400 NS.

DO_WAIT   PROC

      OUT T2_MCA,AX                ;SET THE TERMINAL COUNT
      MOV AX,0                     ;SET THE STARTING COUNT TO 0
      OUT T2_COUNT,AX
      MOV WAIT_FLAG,AL             ;SET WAIT FLAG
      MOV AX,NO_INH+EN+TMR_INT     ;SET THE ENABLE BITS
      OUT T2_CTRL,AX               ;OUTPUT THEM
WAITO:  MOV AL,WAIT_FLAG           ;WAIT FOR FLAG TO BE SET
      AND AL,AL
      JZ  WAITO
      RET

DO_WAIT   ENDP

;HANDLE THE TIMER 2 INTERRUPT

WAIT_SERVE PROC

      PUSH   AX
      MOV AX,NO_INH                ;TURN OFF TIMER
      OUT T2_CTRL,AX
      MOV AX,EOI_CLEAR
      OUT EOI,AX                   ;MUST CLEAR NON-SPECIFIC INT
      MOV AL,1                     ;SET THE WAIT FLAG
      MOV WAIT_FLAG,AL
      POP AX
      STI
      IRET

WAIT_SERVE  ENDP
```

```
;ROUTINE TO OUTPUT A VALUE TO THE IM BUS ;NOTE - THIS ROUTINE IS USED BY
IMWRITE TO OUTPUT SECTIONS OF A VALUE ; USE PROCEDURE IMWRITE TO OUTPUT IM
VALUES, NOT THIS ONE ;
;INPUT -AX CONTAINS DATA TO BE WRITTEN TO BUS ; BL CONTAINS VALUE OF ID BIT TO
USE ; CX CONTAINS # OF BITS TO TRANSFER, 8 OR 16 ; ;OUTPUT - BYTE OR WORD
WRITTEN TO IM BUS ;

DATAOUT   PROC
      PUSH AX                         ;SAVE DATA VALUE
      MOV AL,_iminit                  ;GET INITIAL PORT VALUE
      AND AL, NOT IM_ID               ;CLEAR OUT THE ID BIT LOCATION
      OR AL,BL                        ;PUT IN ID STATE
      MOV DX,IM_PORT                  ;POINT AT IM CONTROL PORT
      OUT DX,AL                       ;SET THE ID STATE
      POP BX                          ;GET BACK THE DATA VALUE


DATAOUT1:
      TEST BX,1                       ;CHECK THE LOW ORDER BIT OF DATA
      JNZ $1                          ;JUMP IF BIT IS SET
      AND AL,NOT IM_DATA              ;SET BIT TO OUTPUT A O
      JMP SHORT DATAOUT2 $1:
      OR AL,IM_DATA                   ;SET BIT TO OUTPUT A 1

DATAOUT2:
      OUT DX,AL                       ;OUTPUT THE DATA BIT
      NOP
      NOP                             ;WAIT A BIT
      NOP
      AND AL,NOT IM_CLOCK             ;CLEAR THE CLOCK BIT
      OUT DX,AL;                      ;OUTPUT INACTIVE CLOCK
      NOP
      NOP
      NOP                             ;WAIT A BIT
      NOP
      OR  AL,IM_CLOCK                 ;PUT IN CLOCK BIT
      OUT DX,AL                       ;AND OUTPUT IT
      NOP
      NOP
      NOP                             ;WAIT A BIT
      NOP
      SHR BX,1                        ;SHIFT TO NEXT DATA BIT
      LOOP  DATAOUT1                  ;OUTPUT ALL DATA BITS

      mov al,_iminit                  ;reset everything_

      OUT DX,AL          ;ALL DONE
      RET

DATAOUT    ENDP


; routine to signal end of imbus transaction ; ; output - imbus ident line is
pulsed to signal end of transaction

set_ident  proc

      mov dx,im_port     ;point at im control port
      mov al,_iminit     ;get initial value
      and al, not im_id ;terminate by toggling id bit
      out dx,al
      nop
      nop                ;wait a bit
      nop
      nop
      mov al,_iminit     ;final value to output
      out dx,al
      ret

set_ident endp



;routine to output a value to an im bus address ; ;input - ax contains data
value ;
     bx contains im bus address ; ;output - value is written to selected im
     bus register
;

imwrite    proc

      push si
      push cx
      push dx            ;save those regs
      push ax            ;save data value
```

```
      mov ax,bx          ;get the im bus address
      shl bx,1           ;mult by 4 to point into table
      shl bx,1
      mov si,offset _imtable  ;point at table start
      add si,bx               ;point at this entry

      cmp byte ptr ds:[si+2],read  ;get read/write bit
      je imw_exit        ;jump if read address

      mov bl,0           ;no id bit in this transfer
      mov cx,8           ;# of bits in address
      call dataout       ;output the address field (address phase)
      pop ax             ;data value for this address
      mov bl,im_id       ;use the id bit for this transfer (data phase)
      mov cx,16
      mov dl,ds:[si+3]   ;get byte count
      cmp dl,2
      jz imwrite3        ;jump if 2 bytes
      mov cx,8           ;setup for 1 byte
imwrite3:
      call dataout       ;output the data value

      call set_ident     ;indicate end of transaction

imw_done:
      pop dx             ;restore saved regs
      pop cx
      pop si
      ret

imw_exit:
      pop ax             ;clear that stack
      jmp imw_done

imwrite     endp


;routine to input a value from the im bus address1 ; ;input - ax contains im
bus address
; ;output - ax contains value from selected im bus register ;

imread proc

      push si
      push cx
      push dx            ;save those regs
      push bx


;routine to input a value from the im bus address1 ; ;input - ax contains im
bus address
; ;output - ax contains value from selected im bus register ;

imread proc

      push si
      push cx
      push dx                 ;save those regs
      push bx
      push ax                 ;save address valu


      shl ax,1                ;mult by 4 to point into table
      shl ax,1
      mov si,offset _imtable  ;point at table start
      add si,ax               ;point at this entry
      cmp byte ptr ds:[si+2],writ   ;get read/
```

Having described the invention what is claimed is:

1. A windowing system for a video/graphic system which combines video information with graphic information for presentation to a display monitor, the windowing system comprising:

A. a random access memory for storing window information, the window information comprising entries, where each window entry comprises information concerning start and stop locations of a window element for a given line of the associated monitor; and B. means for combining the video and graphic information, said means comprising, 1. a window control module for receipt of the window entries, 2. means, interconnected to the window control module, for receipt of control information from the window control module so as to generate select video window control signals and select graphic window control signals associated with displaying video and graphic information inside and outside respectively, and 3. means for presenting the video information and graphic information to the display monitor, said presenting means including means, responsive to select video window control signals, for providing video information inside the start and stop locations of the window element and graphic information outside the start and stop locations for each line of the associated monitor, and further responsive to select graphic window control signals, for providing graphic information inside the start and stop locations of the window element and video information outside the start and stop locations for each line of the associated monitor.

2. A windowing system for a video/graphics system as defined in claim 1, wherein each window entry comprises two bytes associated with the start and stop locations of the window element for a given line of the associated monitor, and wherein the random access memory for each window entry further includes a single bit of information which determines whether the defined window element for a given line of the monitor is to be enabled or disabled.

3. A windowing system for a video/graphics system as defined in claim 2, wherein the windowing system further comprises a frame buffer; and the windowing system includes a viewport system, the viewport system including viewport information that defines the row and column of the frame buffer to be presented at a starting position of a given line of the associated monitor, the viewport system including means for reading the viewport information for each line to be displayed on the monitor, means for accessing the frame buffer at the specified row and column address, means for reading the video data within the frame buffer at the specified row and column address, and means for transferring the read data to the means for presenting the video information and graphic information to the display monitor; whereby any video data stored within the frame buffer can be assessed for presentation on any desired line of the associated monitor.

4. A video/graphic system for providing video information and graphic information on a display monitor, comprising:

(a) window control module means, responsive to start window line control signals and stop window line control signals that define a window in the display monitor, for providing window element enabling control signals;

(b) video and graphic selection control means responsive to the window element enabling control signals, for providing select video window control signals and select graphic window control signals; and (c) video and graphic signal generating means, responsive to the select video window control signals, for providing video information inside the window and graphic information outside the window of the display monitor, and responsive to select graphic window control signals, for providing graphic information inside the window and video information outside the window of the display monitor.

5. A video/graphics system according to claim 4, the system further comprises random memory means for storing start window line control signals and stop window line control signals.

6. A video/graphics system according to claim 5, wherein the window control module means further provides DMA request control signals;

the system further comprises direct memory access (DMA) controller means, responsive to DMA request control signals, for providing DMA memory control signals; and the random memory means in responsive to the DMA memory control signals, for providing the start window line control signals and stop window line control signals to the window control module means.

7. A video/graphics system according to claim 6, wherein window control module means includes a window start counter and a window stop counter.

8. A video/graphics system according to claim 4, wherein each window start and stop line control signal defines a respective window element on one line of a plurality of lines of the display monitor, and the respective window elements combine to form a window in the display monitor.

9. A video/graphics system according to claim 4, wherein the video and graphic section control means is a table look-up means.

10. A video/graphics system according to claim 4, wherein video and graphic signal generating means are keyers.

* * * * *

UNITED STATES PATENT AND TRADEMARK OFFICE

CERTIFICATE OF CORRECTION

PATENT NO. : 5,258,750

DATED : November 2, 1993

INVENTOR(S) : Ronald D. Malcolm, Jr.
Richard R. Tricca

It is certified that error appears in the above-identified patent and that said Letters Patent is hereby corrected as shown below:

At column 9, line 42, please insert --"-- before the word "INPUT".

At column 9, line 52, please insert --"-- after the word "DECLARATIONS".

At column 9, line 43, please delete "x" before the word "Graphics".

At column 182, line 3, please insert --,-- after the word "means".

Signed and Sealed this

Twenty-fifth Day of October, 1994

*Attest:*

Bruce Lehman

BRUCE LEHMAN

*Attesting Officer*

*Commissioner of Patents and Trademarks*